US012674390B2

(12) United States Patent
Maclean et al.

(10) Patent No.: US 12,674,390 B2
(45) Date of Patent: Jul. 7, 2026

(54) ACOUSTIC RECEIVER

(71) Applicant: Raptor Data Limited, Aberdeenshire (GB)

(72) Inventors: Colin Maclean, Aberdeenshire (GB); Frazer Geddes, Aberdeenshire (GB); Gordon Cowie, Aberdeenshire (GB)

(73) Assignee: Raptor Data Limited, Aberdeen (GB)

( * ) Notice: Subject to any disclaimer, the term of this patent is extended or adjusted under 35 U.S.C. 154(b) by 0 days.

(21) Appl. No.: 18/293,440

(22) PCT Filed: Aug. 2, 2022

(86) PCT No.: PCT/GB2022/052032
§ 371 (c)(1),
(2) Date: Jan. 30, 2024

(87) PCT Pub. No.: WO2023/012470
PCT Pub. Date: Feb. 9, 2023

(65) Prior Publication Data

US 2025/0116189 A1 Apr. 10, 2025

(30) Foreign Application Priority Data

Aug. 6, 2021 (GB) ..... 2111406

(51) Int. Cl.
*E21B 47/16* (2006.01)
*E21B 47/01* (2012.01)
*E21B 47/017* (2012.01)

(52) U.S. Cl.
CPC ..... *E21B 47/16* (2013.01); *E21B 47/017* (2020.05)

(58) Field of Classification Search
None
See application file for complete search history.

(56) References Cited

U.S. PATENT DOCUMENTS

| | | | | |
|---|---|---|---|---|
| 5,592,438 | A | 1/1997 | Rorden et al. | |
| 6,354,146 | B1 * | 3/2002 | Birchak | G01F 1/74 73/61.79 |
| 2004/0246141 | A1 | 12/2004 | Tubel et al. | |
| 2011/0149687 | A1 | 6/2011 | Rayssiguier et al. | |
| 2014/0136126 | A1 * | 5/2014 | Ao | G01N 9/00 73/861.04 |
| 2018/0206033 | A1 * | 7/2018 | Kim | H04R 1/406 |
| 2019/0153858 | A1 * | 5/2019 | Kinn | E21B 47/16 |
| 2020/0370943 | A1 * | 11/2020 | Demchenko | G01F 23/2961 |

OTHER PUBLICATIONS

Nov. 3, 2022 (PCT) International Search Report—App. PCT/GB2022/052032.

* cited by examiner

*Primary Examiner* — Steven Lim
*Assistant Examiner* — Jerold B Murphy
(74) *Attorney, Agent, or Firm* — Banner & Witcoff, Ltd.

(57) ABSTRACT

An acoustic receiver is provided for receiving acoustic signals from an acoustic communication channel. The acoustic receiver comprises a waveguide; and at least first and second sensors for sensing the acoustic signals, the sensors being in acoustic communication with the waveguide. The first and second sensors are acoustically coupled to the waveguide at respective first and second positions spaced from each other along a length of the waveguide. The length of the waveguide between the first and second positions follows a path that changes direction to thereby limit an extent of the waveguide.

18 Claims, 21 Drawing Sheets

ACOUSTIC RECEIVER

BACKGROUND

In acoustic communications, where a communication signal may form a standing wave on an acoustic communication channel, it can be difficult to predetermine where the peaks and nulls of signal strength will occur on the communication channel. This is particularly true for downhole acoustic communications, which may use existing solid components such as a drill-string, casing or production tubing to form at least part of the communication channel. This is because the transfer function of the communication channel may change as a result of changes in operating conditions of the components of the communication channel, such as changes in the stresses and strains or changes in bending, touch points, compression or tension on the drill string, which may for example be dependent on whether the drill string is being used to drill during propagation of the communication signals. Accordingly, it can be difficult to determine where to acoustically couple an acoustic sensor to the communication channel in order to reliably receive acoustic communication signals from the acoustic communication channel with sufficient signal strength. This can result in sub-optimum received signal strengths, which can in turn limit the usable communication signal bandwidth.

BRIEF INTRODUCTION OF THE DRAWINGS

Example implementations are described below with reference to the accompanying drawings, in which.

Figure 11A:
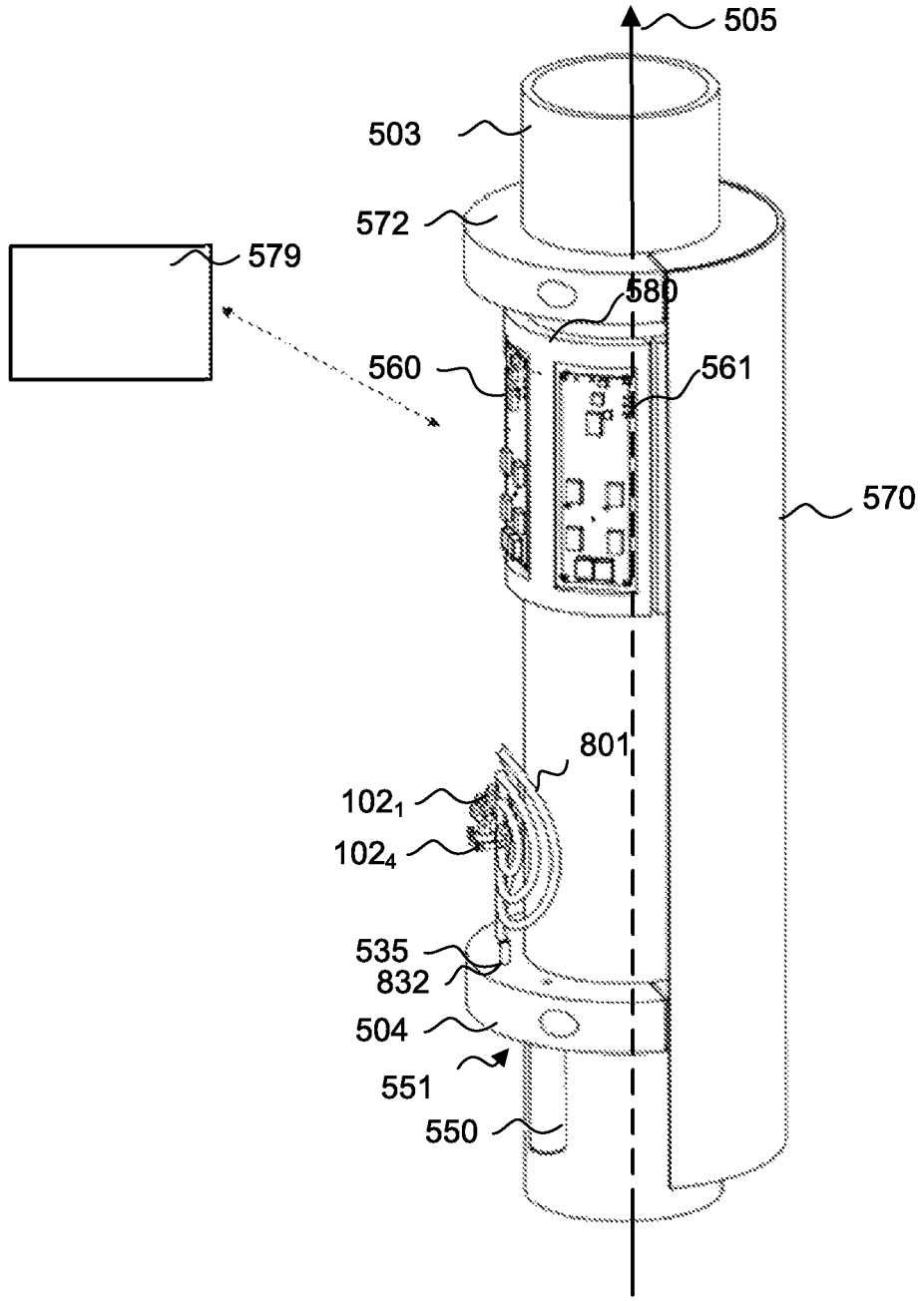
Figure 11B:
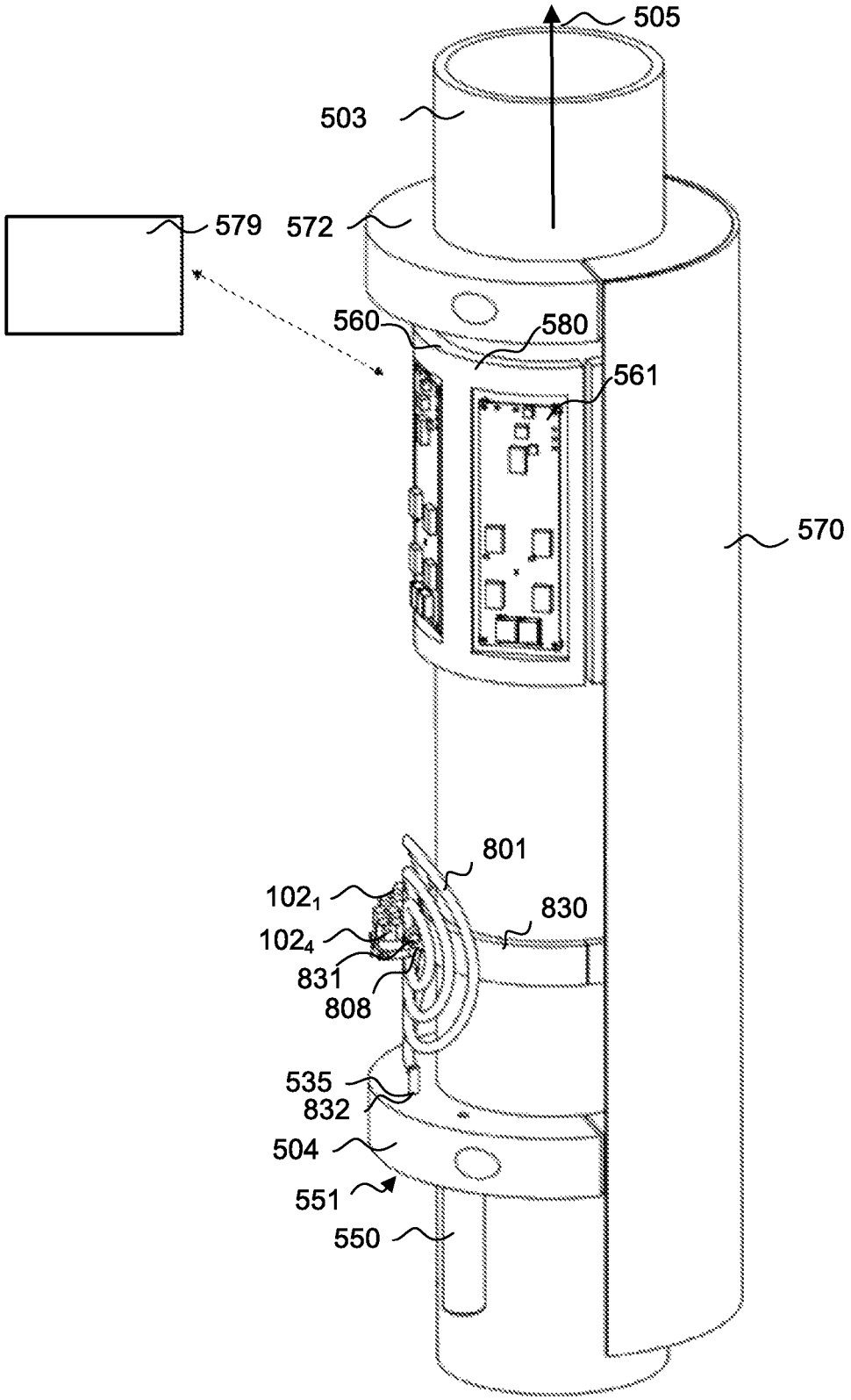
Figure 11C:
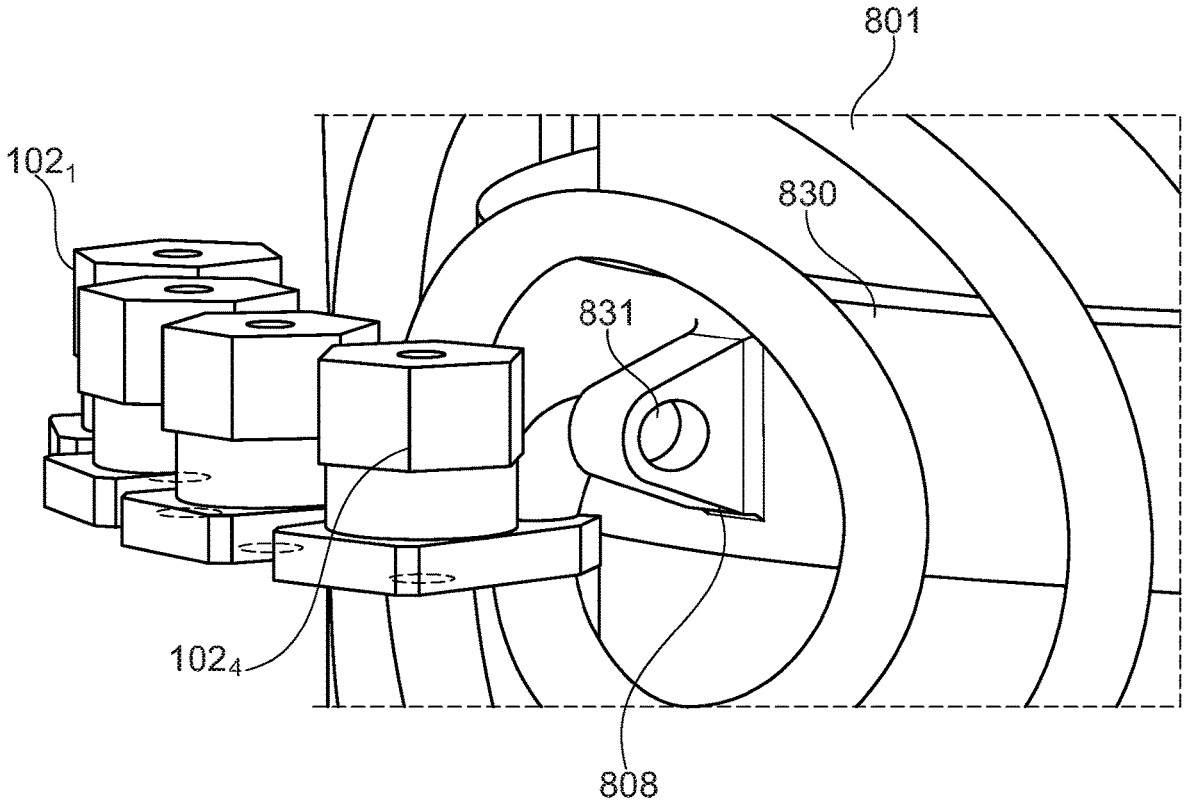

FIG. 11*a* is a schematic diagram of a further example assembly;

FIG. 11*b* is a schematic diagram of a further example assembly;

FIG. 11*c* is a close-up view of the holder of the assembly of FIG. 11*b;*

Figure 12:
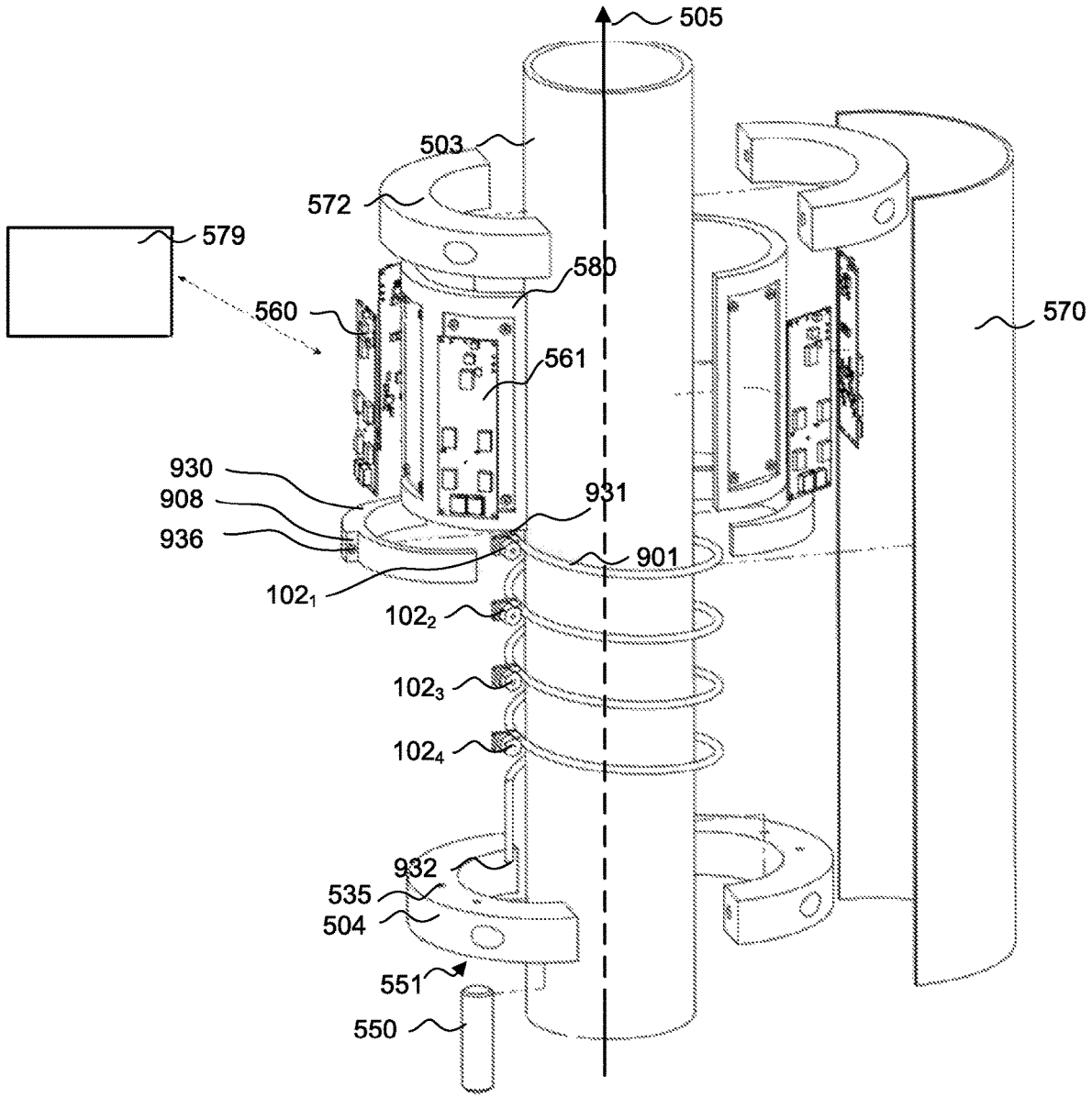
Figure 13:
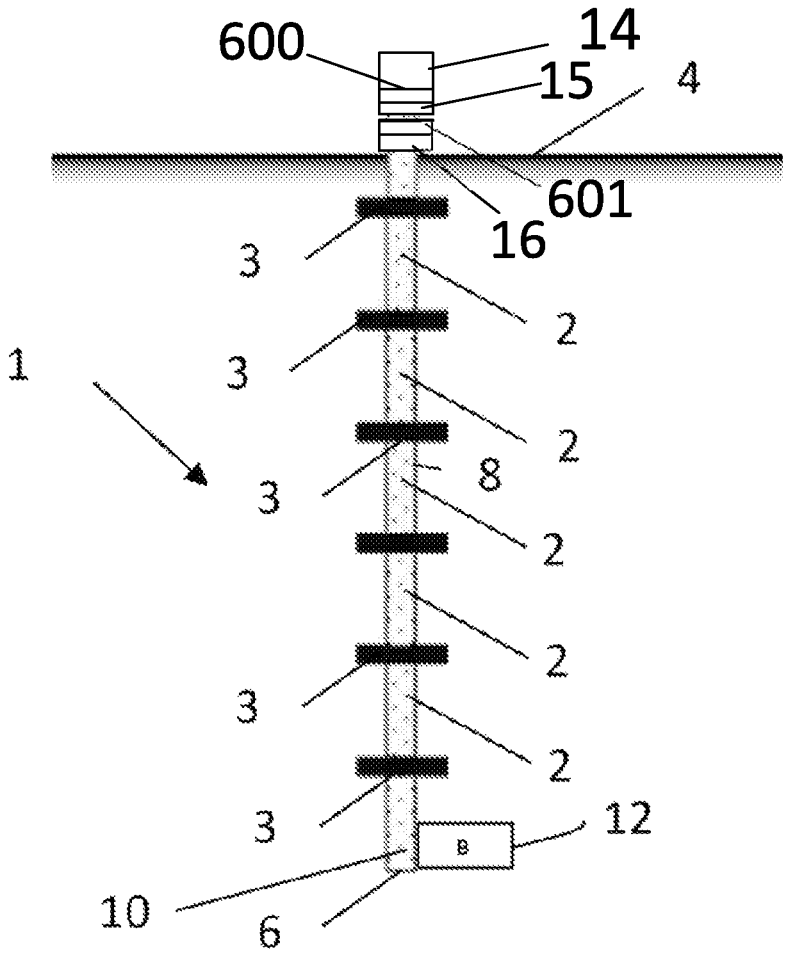
Figure 14:
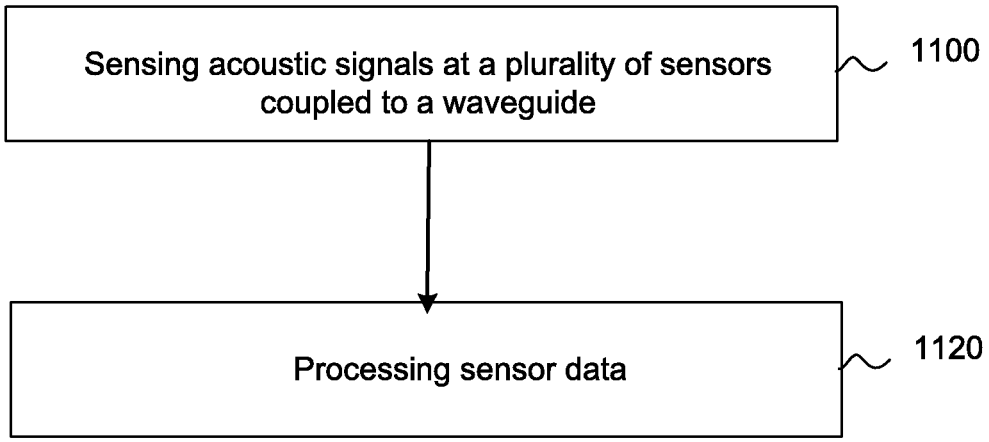

FIG. 12 is a schematic diagram of a de-constructed view of a further example assembly;

FIG. 13 is a schematic diagram of an example drilling rig comprising axially spaced first and second acoustic receivers; and FIG. 14 is a flow chart illustrating a method of receiving acoustic communications signals from an acoustic communication channel.

Figure 15:
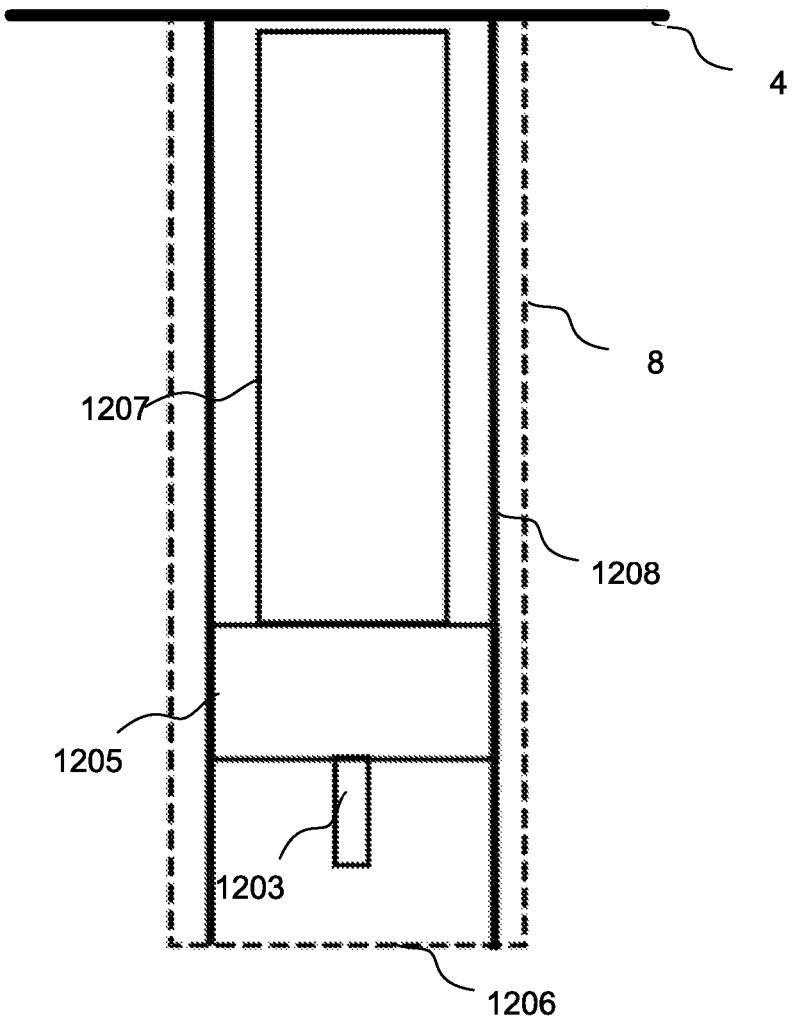
Figure 16A:
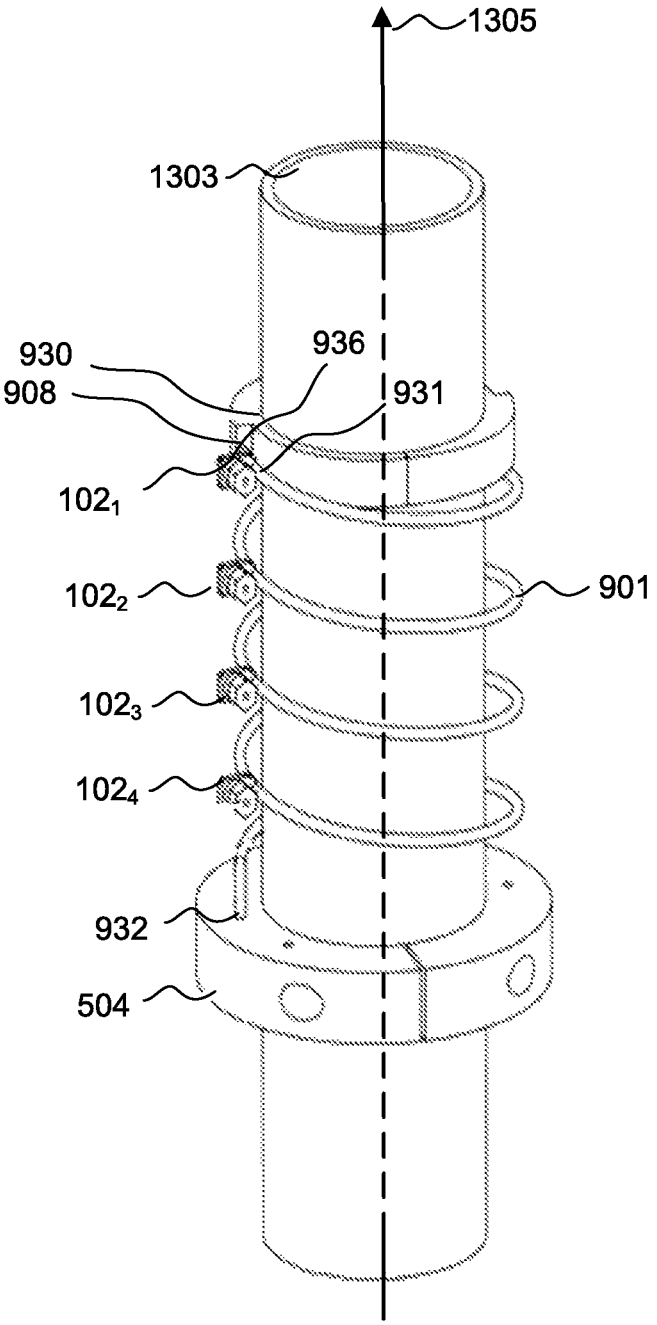
Figure 16B:
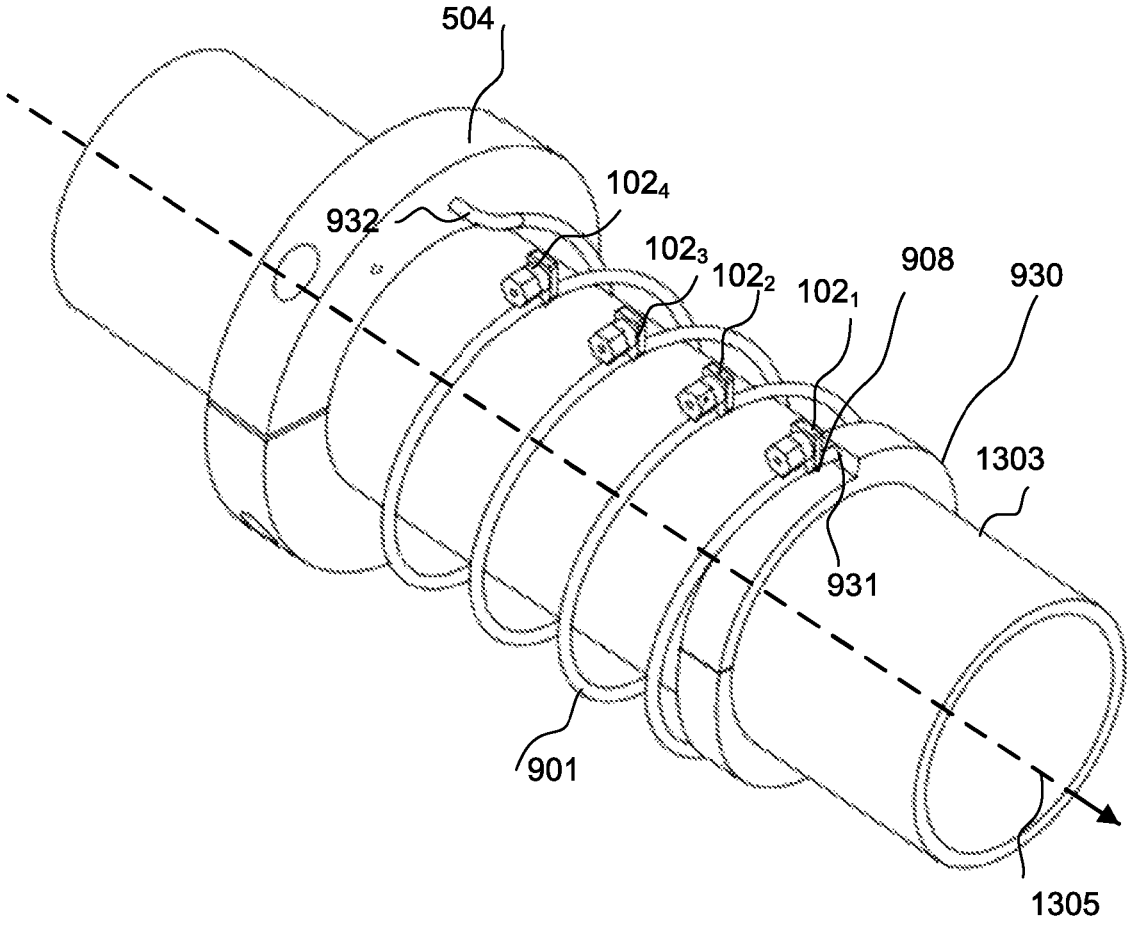
Figure 17A:
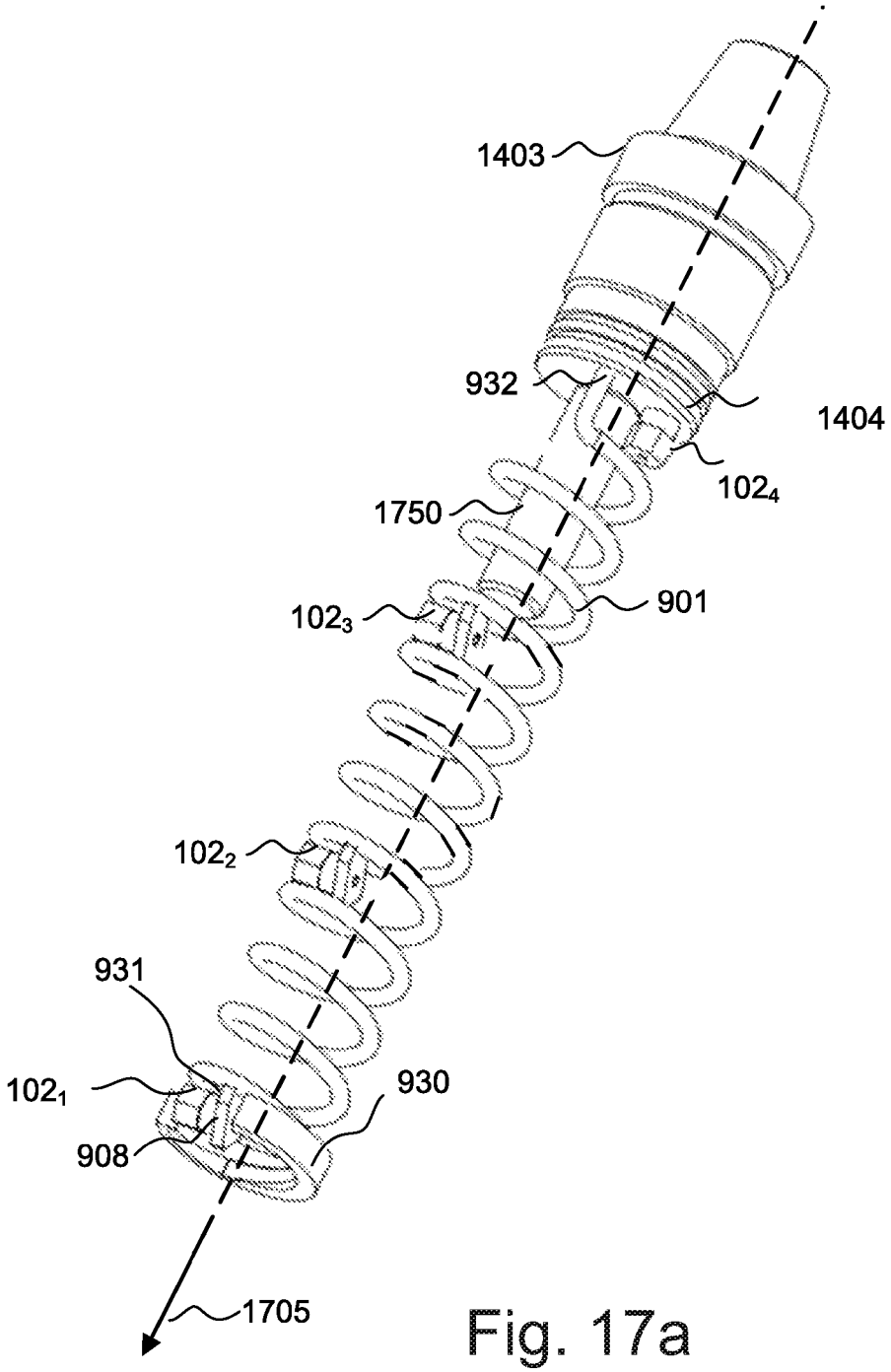
Figure 17B:
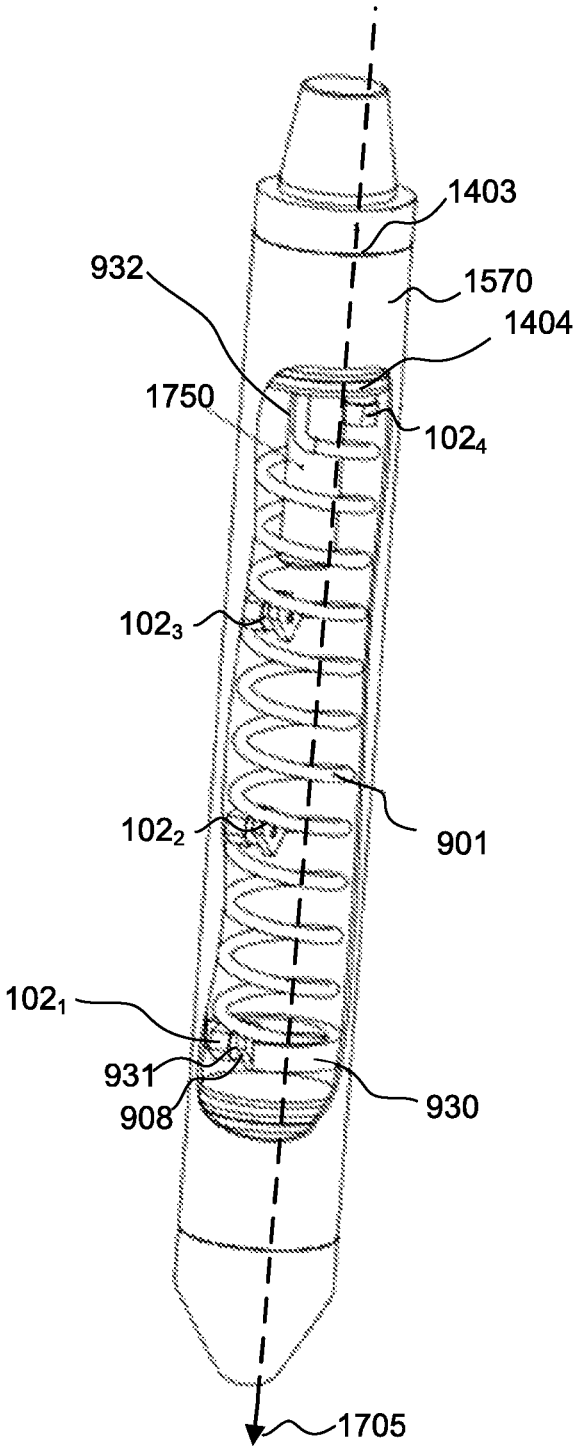

FIG. 15 is a schematic diagram of an example downhole apparatus;

FIG. 16*a* is a schematic view of a further example assembly provided beneath the surface (downhole);

FIG. 16*b* is a schematic diagram of the example assembly of FIG. 16*a* illustrated in a different orientation;

FIG. 17*a* is a schematic diagram of a view of a further example assembly where an acoustic receiver is coupled to a top-sub of a downhole tool; and FIG. 17*b* is a schematic diagram of a view of the example assembly of FIG. 17*a* having an outer jacket.

DETAILED DESCRIPTION

The present disclosure may be applicable to any suitable type of acoustic receiver. The acoustic receiver may be provided as part of or integrable with, for example, any suitable acoustic communication system. For example, the acoustic receiver may be provided as a part of a downhole communication apparatus, for deployment in downhole applications, such as drilling, production, completion (e.g. liner hanger) apparatus or mining environments. For example, the acoustic receiver may be part of or integrable with a communication system of a drilling rig such as the drilling rig of FIG. 1.

Figure 1:
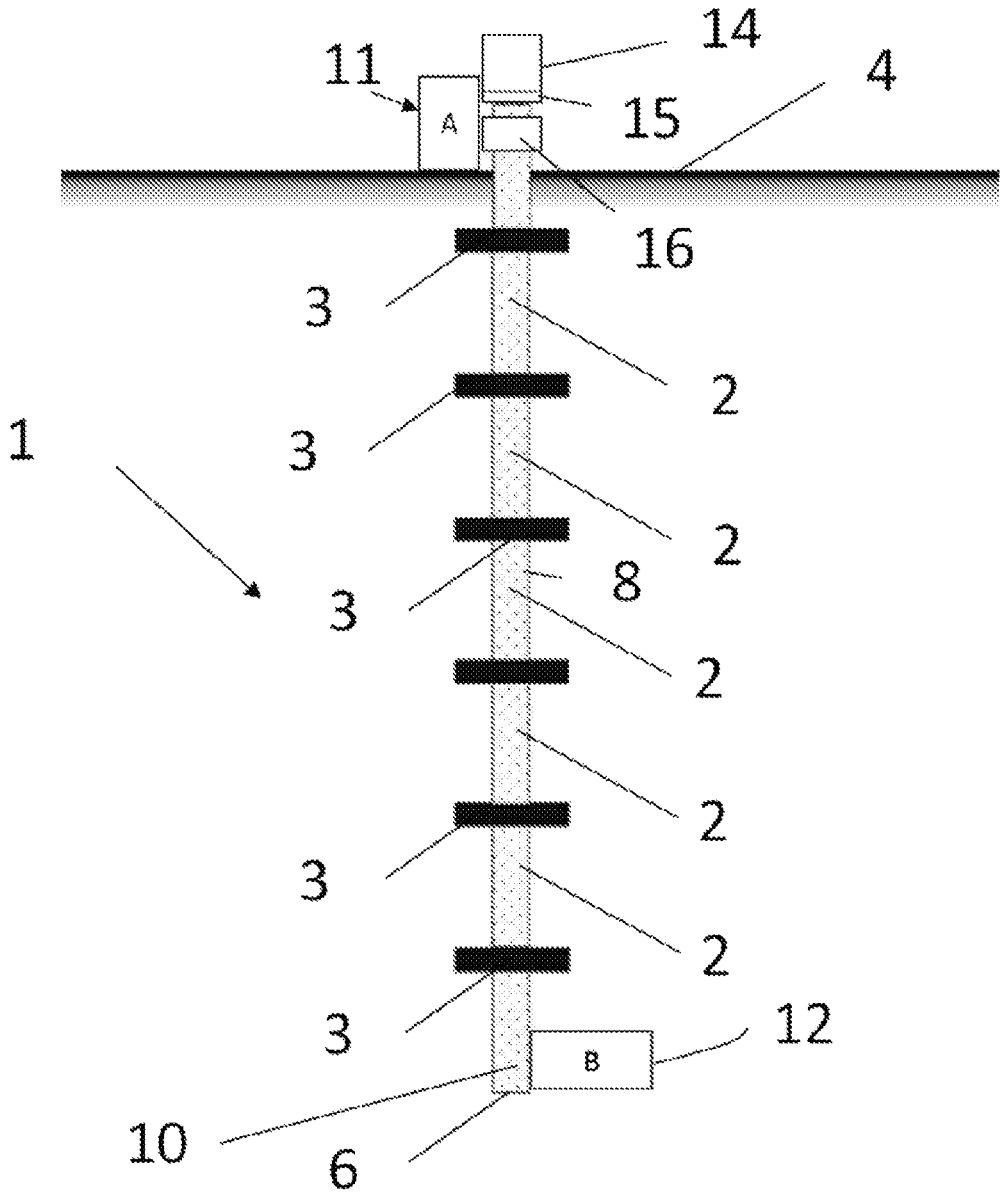
FIG. 1 is a schematic diagram of an example drilling rig.

The drilling rig of FIG. 1 has a drill string 1 extending longitudinally down a borehole 8, the drill string 1 comprising a drill bit 10 at a downhole longitudinal extent thereof and plurality of solid, hollow, tubular drill string sections 2 connected to each other longitudinally by couplings 3 and to the drill bit 10, the drill string 1 extending between a surface 4 and a lower longitudinal extent 6 of the borehole (or wellbore) 8, the borehole 8 being drilled by the drill bit 10. Downhole equipment (not shown) may be provided down the borehole 8, such as any one or more of: sensors, such as temperature sensors or pressure gauges; valves; chokes; firing heads; packers; perforators; samplers; flow meters; fluid analysers. The surface 4 may be a land surface or a surface of a sea bed, for example. The drill string sections 2 each have bores defined by solid, tubular walls and the sections 2 may be coupled together such that their bores are in fluid communication with each other and, typically, such that fluid tight seals are provided at the joints between sections 2. Drilling fluid may be transmitted through the bores of the tubular sections 2 from the surface 4 to the drill bit 10 and circulated back up to the surface 4 through an annular gap between the tubular drill string sections 2 and the side walls of the borehole 8. Torque may be applied to the drill bit 10 by way of torque applied to the tubular sections 2 of the drill string 1, for example by a top drive 14. The drill string 1 may be rotatable by the top drive 14 to thereby rotate the drill bit 10. The top drive 14 is connected to the top section 2 of the drill string 1 by way of a saver sub 15. A cement head 16 may be provided between the top drive 14 or saver sub 15 and the drill string or between two sections 2 of the drill string 1 provided above the surface 4. In this case, the drilling rig including the cement head 16 may be provided as part of a completion or liner hanger. The cement head 16 may be a device which holds a cement plug before it is pumped down the casing during a cementing operation. The drill string 1, top drive 14, saver sub 15 and cement head 16 may comprise acoustic conductors.

A first communications node 11 may be provided above the surface 4 and a second communications node 12 may be provided at a lower longitudinal extent 6 of the borehole 8. The second node 12 may be communicatively coupled to downhole equipment. It will be understood that the first communications node 11 may alternatively be provided beneath the surface 4, while the second communications node 12 may be provided above the lower extent 6 of the borehole 8. The first communications node 11 may be provided vertically closer to the surface 4 than the second communications node 12 is to the surface 4. The drill string 1 may be connected to a wellhead (not shown) at the surface 4. It will be understood that the first communications node 11 may be in acoustic communication with a plurality of downhole communication nodes.

Data, such as telemetry data or command or control data, or command acknowledgement or monitoring payload data, may be communicated acoustically between the first and second nodes 11, 12 by way of an acoustic communications channel. For example, command or control data may be transmitted from the first node 11 to the second node 12, for example to control or modify the operation of downhole equipment (e.g. a test valve) or to request sensor data from downhole monitoring equipment, for example in a downlink communication from the first node 11 to the second node 12. In this case, it may be that the second node 12 is communicatively coupled to the said downhole equipment, and may be configured to forward command or control data received from the first node 11 to the downhole equipment. In another example, command acknowledgement or monitoring data such as sensor data from downhole equipment may be transmitted from the second node 12 to the first node 11, for example in an uplink communication from the second node 12 to the first node 11. Again in this case, it may be that the second node 12 is communicatively coupled to the downhole equipment such that the second node 12 can receive the command acknowledgement or monitoring data from the downhole equipment and forward it to the first node 11.

It will be understood that the first node 11 may communicate with the second node 12 (or with any other node(s) it is in acoustic communication with) directly by way of the communication channel in a point-to-point arrangement, or alternatively via one or more other communication nodes.

As mentioned above, data is communicated between the first and second communications nodes 11, 12 by way of acoustic signals transmitted and received through the acoustic communication channel. The communication channel comprises an acoustic communications medium. For example, the communication channel may comprise the solid longitudinal walls of the drill string sections 2 extending from the surface 4 to the lower longitudinal extent 6 of the borehole 8. An additional or alternative acoustic communication channel to the drill string 1 may be provided for example by coiled tubing or production tubing or casing which may extend between the first and second communications nodes 11, 12. Thus, the communication channel may comprise or consist of solid matter extending between the first and second communications nodes 11, 12. It may be that the communication channel comprises a solid communication channel which may include any one or more of the drill string 1, top drive 14, saver sub 15, cement head 16, a casing of the borehole 8, production tubing, a riser, coiled tubing extending between the first and second nodes 11, 12, production tubing, slips supporting the drill string 1 below the top drive 14.

It may be that the communication channel has a temporally and dynamically variable transfer function which may for example depend on the operating conditions of the drilling rig. It may be that one or more frequency band(s) which are open for data communication by way of the communication channel change dynamically over time. It may be that the communication channel is noisy, lossy or noisy and lossy.

Figure 2:
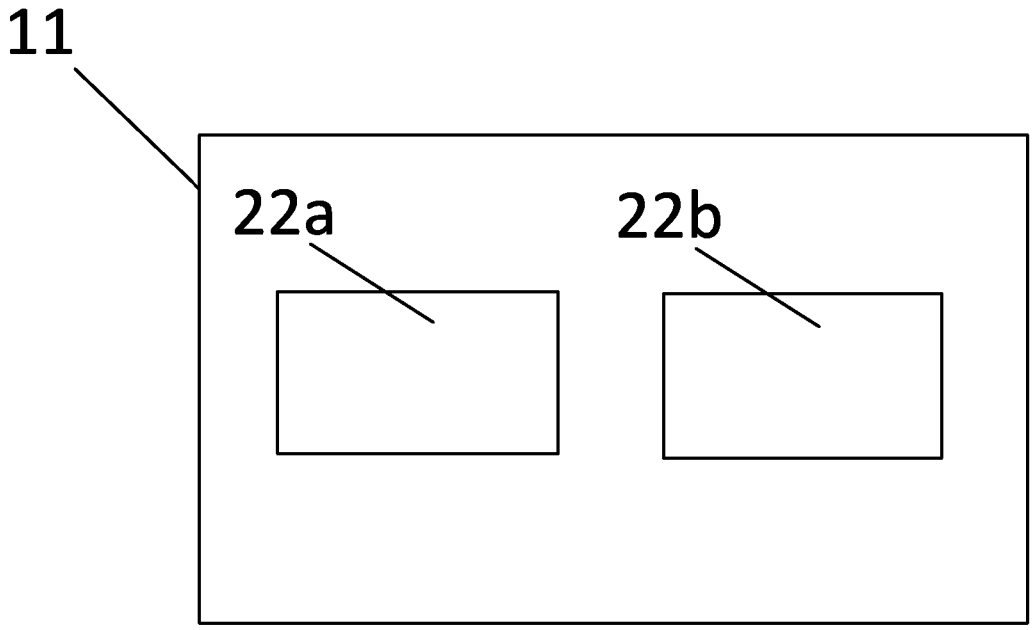
FIG. 2 is a schematic block diagram of an example communications node.

FIG. 2 schematically illustrates example apparatus of the first communications node 11. The second communications node 12 may have apparatus comprising the same or similar features. Indeed, it will be assumed in the following discussion that the second communications node 12 has apparatus comprising the same features as those shown in FIG. 2. As such, the second communications node 12 will not be described separately here.

The first communications node 11 may comprise an acoustic transmitter 22*a* and an acoustic receiver 22*b* configured to transmit and receive acoustic signals respectively by way of the acoustic communication channel. The transmitter 22*a* and receiver 22*b* may be communicatively coupled to the communication channel by one or more acoustically conductive couplers. The transmitter 22*a* and receiver 22*b* may comprise a discrete transmitter and a discrete receiver. The transmitter 22*a* may comprise one or more acoustic transducers such as one or more piezo-electric transducers. The receiver 22*b* may comprise acoustic sensors such as accelerometers, strain gauges, piezo-electric transducers, or fibre-optic acoustic sensors. It may be that the one or more transducers of the transmitter 22*a* are configured to convert electrical signals to acoustic signals. It may be that the sensors of the receiver 22*b* are configured to convert received acoustic signals to electrical signals. The transmitter 22*a* and receiver 22*b* may be operable to transmit and receive signals over a plurality of frequency bands.

Figure 3:
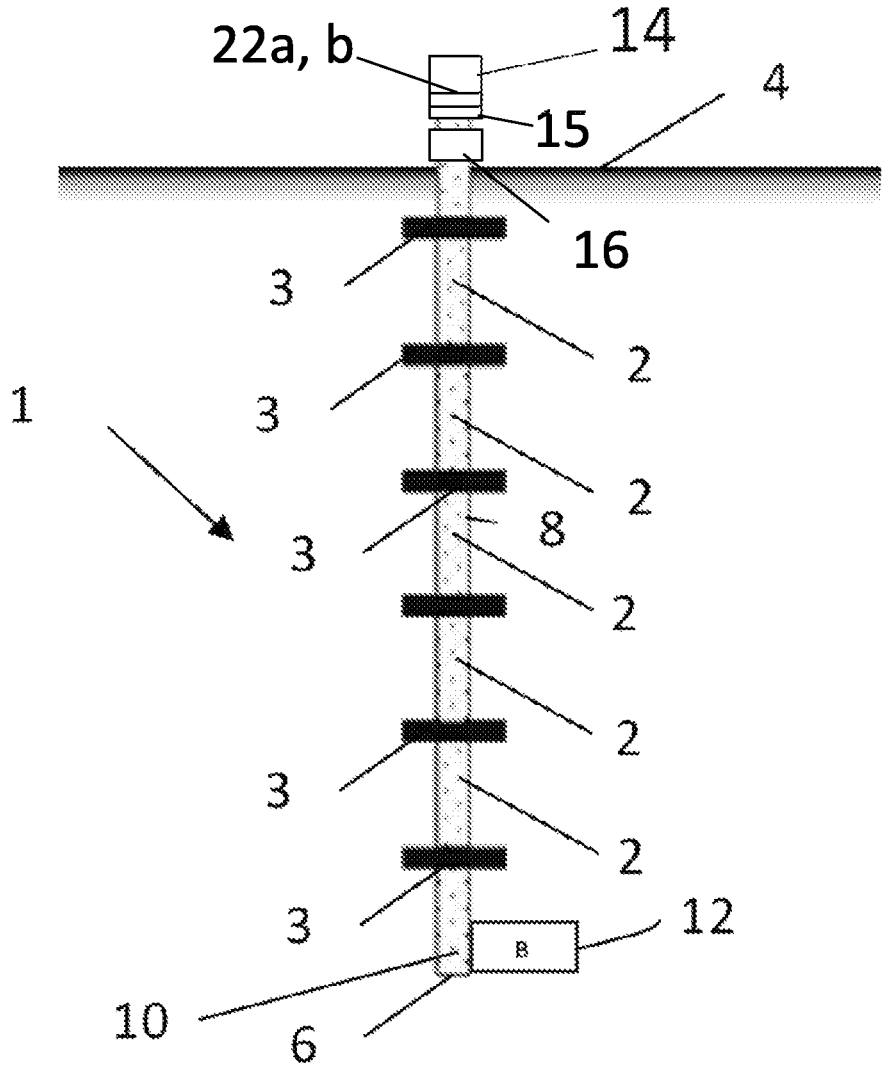
FIG. 3 is a schematic diagram of a further example drilling rig.

The transmitter 22*a* and receiver 22*b* are provided in acoustic communication with an acoustic conductor of the acoustic communication channel (e.g., by way of one or more couplers) so as to transmit and receive acoustic signals by way of the communication channel. For example, the transmitter 22*a* and receiver 22*b* may be acoustically coupled to any of the top drive 14, the saver-sub 15, the cement head 16, above or below slips supporting the drill string 1 below the top drive, or directly with the drill string 1 or coiled or production tubing. The transmitter 22*a* and receiver 22*b* may be provided in acoustic communication with the same acoustic conductor of the acoustic communication channel or with different acoustic conductors of the acoustic communication channel. The transmitter 22*a* and receiver 22*b* may be mounted to the acoustic conductor of the communication channel to which they are acoustically coupled. In the example of FIG. 3, the transmitter 22*a* and receiver 22*b* are mounted to the saver-sub 15, which as discussed above is a component of the drilling rig provided above the surface 4 between the top drive 14 and the drill string.

A number of example acoustic receivers and assemblies will now be discussed with reference to the acoustic receivers and assemblies of FIGS. 4-13. It will be understood that the acoustic receivers and assemblies discussed herein are suitable for the acoustic receiver 22*b* described above with reference to FIGS. 1-3 or for any other suitable application. The receivers and assemblies of FIGS. 4-13 may have features in common; corresponding features are referred to by the same reference numerals.

Figure 4:
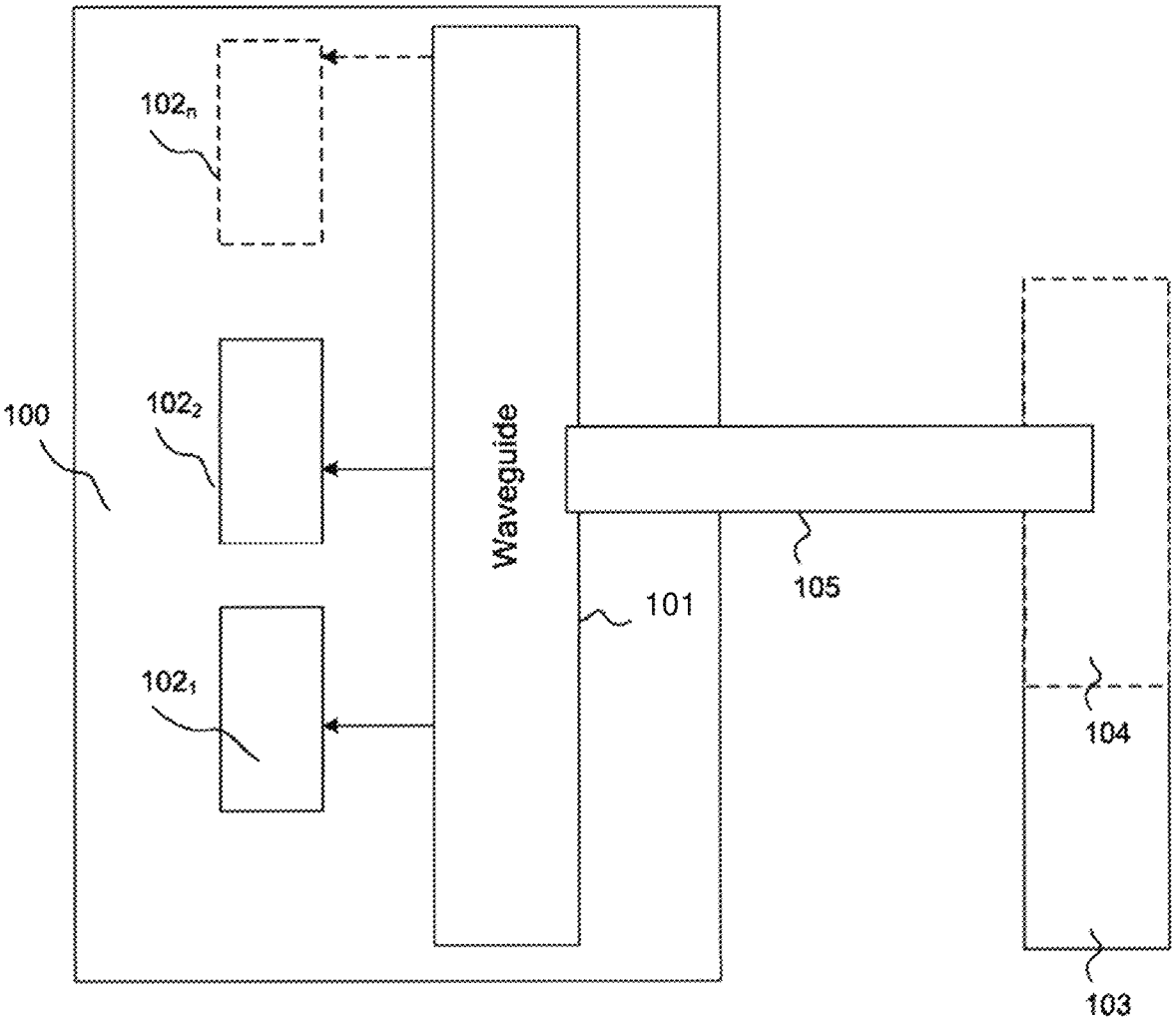
FIG. 4 is a schematic diagram of functional blocks of an example acoustic receiver.

FIG. 4 is a schematic diagram of functional blocks of an acoustic receiver 100. The acoustic receiver 100 may be configured to receive acoustic signals from an (e.g. solid) acoustic communication channel 103, such as (but not limited to) a downhole communication channel at least a portion of which is provided downhole beneath a surface, for example from a communication node, such as a downhole communication node. The receiver 100 may be provided above the surface. As discussed above, the acoustic signals may comprise telemetry data or command or control data, or command acknowledgement or monitoring payload data. The communication channel 103 may be substantially straight along its length. In an alternative example, the communication channel 103 may follow a path which changes direction along its length. For example, the communication channel may comprise coiled tubing. The communication channel 103 may comprise at least one tubular member.

The acoustic receiver 100 comprises an acoustic waveguide 101. For example, the waveguide may be an acoustic conductor, such as a metal tube or wire, however the waveguide 101 may comprise any material and structure suitable for propagating acoustic signals, such as by way of vibration. In the example shown in FIG. 4, the waveguide 101 of the acoustic receiver 100 is acoustically coupled (e.g. mounted) to an (e.g. solid) acoustic conductor 104 that forms at least part of the acoustic communication channel 103 by way of an acoustic coupler 105. Alternatively, the waveguide 101 may be coupled (e.g. mounted) directly to the acoustic conductor 104. The acoustic conductor 104 may have a longitudinal axis, which may be substantially parallel to or colinear with a longitudinal axis of the communication channel. The acoustic conductor 104 may be substantially straight along its length or may follow a path which changes direction along its length (e.g. the acoustic conductor 104 may comprise coiled tubing). The acoustic conductor 104 may comprise a tubular member.

The waveguide 101 provides a propagation path for guiding acoustic signals from the communication channel 103 to a plurality of sensors $\mathbf{102}_{1,\ldots,n}$ acoustically coupled to the waveguide 101 to sense acoustic signals received by way of the communication channel 103. It will be understood that the waveguide 101 is to guide acoustic waves along the path to the respective sensors $\mathbf{102}_{1,\ldots,n}$, for example from a feedpoint, for example provided by coupler 105. The sensors $\mathbf{102}_{1,\ldots,n}$ may be acoustically coupled to the waveguide 101 at respective positions spaced along the length of the waveguide 101, e.g. to thereby detect (e.g. sample) acoustic waves at the respective positions spaced along the length of the waveguide. The sensors $\mathbf{102}_{1,\ldots,n}$ may comprise any sensors suitable for sensing acoustic signals from the communication channel, either directly or indirectly. The sensors $\mathbf{102}_{1,\ldots,n}$ of the receiver may be of the same acoustic sensor type. The sensors $\mathbf{102}_{1,\ldots,n}$ may comprise accelerometers (e.g. accelerometers having an axis of acceleration to be sensed by the accelerometer aligned with the longitudinal axis of the communication channel), strain gauges, piezo-electric transducers, or fibre-optic acoustic sensors. For example, the acoustic receiver 100 may comprise accelerometers $\mathbf{102}_{1,\ldots,n}$ to sense the acoustic signals from the acoustic communication channel, the accelerometers being coupled to the waveguide 101 and sensing acoustic signals from the communication channel 103 by way of a vibration of the waveguide 101 propagating to the accelerometers. In another example, the sensors $\mathbf{102}_{1,\ldots,n}$ may comprise strain-gauges, piezo-electric transducers $\mathbf{102}_{1,\ldots,n}$, or fibre optic acoustic sensors to sense the vibration of the waveguide 101 by way of mechanical stress induced in the sensors as a result of the vibration of the waveguide 101 caused by acoustic signals propagating along the waveguide 101 from the acoustic communication channel 103.

The communication signals received from the acoustic communication channel 103 may form a standing wave on the combination of the acoustic communication channel 103 and the waveguide 101. In order to receive a signal with optimum signal strength, an acoustic sensor should be acoustically coupled to a position corresponding to a positive or negative peak of the standing wave. However, it can be difficult to predetermine the location at which the peaks of signal strength will occur, particularly when the transfer function of the communication channel may be subject to significant change, such as in downhole applications. Accordingly, it can be difficult to determine where to position the acoustic sensor in order to detect acoustic communication signals with sufficient signal strength. This can result in sub-optimum received signal strengths, which can in turn limit the usable communication signal bandwidth.

By acoustically coupling a plurality of sensors $\mathbf{102}_{1,\ldots,n}$ to the waveguide at respective positions spaced along the length of the waveguide 101, for example such that the signals detected by at least two of the sensors (e.g. the signal detected by each of the sensors) are phase shifted with respect to each other (e.g., such that the spacing between at least two of the positions (e.g., the spacings between each of the positions) differs from (i.e., is not equal to) an integer multiple of the wavelength of the signals being received or from an integer multiple of half of the wavelength of the signals being received), the sensors $\mathbf{102}_{1,\ldots,n}$ will provide spatial signal diversity by detecting the communication signals at different positions along the standing wave, thereby increasing the probability of at least one sensor detecting the signal near or at a position of peak signal strength. The wavelength of the signals being received may be predetermined. As will be described in more detail below, the sensor data of highest quality (e.g. highest signal strength, signal to noise ratio or signal to noise and interference ratio) from the sensor data provided by the plurality of sensors, or data derived therefrom, may be selected, for example for further processing. Thus, even if the position of the peak signal strength changes over time, for example due to changes in the transfer function of the communication channel 103, a high quality signal may still be detected, for example from different ones of the plurality of sensors $\mathbf{102}_{1,\ldots,n}$ over time.

The spacing between adjacent sensors $\mathbf{102}_{1,\ldots,n}$ may be substantially the same along the length of the waveguide 101, or it may be that the spacings between adjacent sensors $\mathbf{102}_{1,\ldots,n}$ varies along the length of the waveguide 101, or it may be that the spacings between some adjacent sensors are substantially the same and the spacings between other adjacent sensors are different from each other.

In downhole applications, the portion of the communication channel 103 which extends above the surface may be limited in its extent (e.g. its vertical extent). In the arrangement of FIG. 4, the waveguide 101 of the receiver is a straight waveguide 101 which follows a straight path having a single longitudinal direction substantially parallel to a longitudinal axis of the acoustic conductor 104 and to a longitudinal axis of the acoustic communication channel 103. In this case, in order to sufficiently space the sensors $\mathbf{102}_{1,\ldots,n}$ to achieve a desired spatial signal diversity, the waveguide 101 may extend significantly beyond an extent of the acoustic communication channel, such as the vertical extent of the acoustic communication channel. This is makes it more difficult to protect the acoustic receiver 100 from environmental conditions and can result in increased acoustical noise being detected by the receiver 100, particularly in downhole applications (e.g. drilling or completion applications) where the receiver 100 may rotate during use (e.g. by being mounted to a rotatable part of a drilling rig, such as a drill string, saver sub or cement head).

In order to address this, the waveguide 101 may instead follow a path which changes direction to thereby limit an extent of the waveguide 101 in at least one spatial dimension (e.g. to limit at least a vertical extent of the waveguide), for example with respect to the acoustic conductor 104 or the acoustic communication channel 103. It may be that, by way of the waveguide 101 following a path which changes direction to thereby limit an extent of the waveguide 101 in at least one spatial dimension, the acoustic waveguide has a lesser extent in at least one spatial dimension (e.g. the vertical spatial dimension) than, for example an above-surface portion of the acoustic conductor 104 or the acoustic communication channel.

It may be that first and second sensors $\mathbf{102}_{1,\ldots,n}$ are acoustically coupled to the waveguide 101 at respective first and second positions spaced from each other along a length of the waveguide 101 (to thereby detect signals at the first and second positions of the waveguide respectively), wherein the length of the waveguide between the first and second positions follows a path that changes direction to thereby limit the extent of the waveguide, for example in a direction substantially parallel or perpendicular to a longitudinal axis of the acoustic communication channel 105 (e.g. in a direction substantially parallel or perpendicular to the vertical). For example, it may be that the waveguide 101 follows a path which is curved or comprises a bend or a loop between the first and second positions.

The change in direction of the path to thereby limit the extent of the waveguide 101 allows the waveguide 101 to be spatially compressed. The waveguide 101 may be spatially compressed to have a shorter extent in at least one spatial dimension, e.g. by compressing the extent of the waveguide 101 in a first direction (such as along a y-direction) and increasing an extent of the waveguide 101 in a second direction (such as an x-direction) of the waveguide 101. The extent of the waveguide 101 may be limited with respect to a vertical extent of an above-surface portion of the acoustic communication channel.

The limitation of the extent of the waveguide 101 allows for a waveguide of a given length to be provided, which may otherwise extend beyond a desired or practicable extent of the acoustic receiver, or for example a structure thereof (e.g., an acoustic conductor of an acoustic communication channel or the acoustic communication channel) to which the acoustic receiver is coupled, within desired physical constraints of the receiver. It may be that, by way of the waveguide 101 following a path between the first and second positions which changes direction to thereby limit an extent of the waveguide 101 in at least one spatial dimension, the acoustic waveguide has a lesser extent in at least one spatial dimension (e.g. the vertical spatial dimension) than the acoustic conductor 104 or the acoustic communication channel, for example above the surface.

By limiting the extent of the waveguide in at least one spatial dimension, more acoustic sensors $\mathbf{102}_{1,\ldots,n}$ can be provided in a limited space (e.g. to fit physical size constraints for the receiver 100) in that dimension than would otherwise be possible, thereby increasing the spatial signal diversity that can be achieved by the receiver. For example, by compressing the waveguide in a vertical spatial dimension, more sensors can be provided in a limited vertical space corresponding to a portion of the acoustic communication channel 103 provided above the surface in a downhole application. In such a downhole application, the limitation or spatial compression of an extent of the waveguide may help to prevent the extension of the waveguide beyond the acoustic conductor or acoustic communication channel to which the waveguide is coupled (e.g. in a vertical direction). This helps to prevent the waveguide from damage and helps to reduce the noise received by the waveguide. For example, in a completion or drilling environment, the communication channel, and thus the acoustic receiver 100, may rotate in use at speeds of over one hundred revolutions per minute (rpm). Accordingly, by reducing the extension of the waveguide beyond the acoustic conductor to which it is mounted, the waveguide can be better protected and will pick up less environmental acoustic noise.

It may be that the sensors $\mathbf{102}_{1,\ldots,n}$ comprise at least first, second and third sensors acoustically coupled to the waveguide at respective first, second and third positions spaced along the length of the waveguide such that signals detected by the first, second and third sensors (e.g. by each of the sensors) are phase shifted with respect to each other (e.g. the spacings between the first and second, second and third and first and third positions (e.g. between each of the positions at which sensors are acoustically coupled to the waveguide) differ from (i.e., is not equal to) an integer multiple of the (e.g. predetermined) wavelength of the signals being received or from an integer multiple of half of the (e.g. predetermined) wavelength of the signals being received). In this way, each of the first, second and third sensors helps to improve spatial signal diversity.

It may be that the plurality of sensors $\mathbf{102}_{1,\ldots,n}$ comprises a plurality of pairs of sensors (e.g. a first pair comprising the first and second sensors, and a second pair comprising the second and third sensors) for sensing acoustic signals, each of the pairs of sensors comprising respective first and second (e.g. adjacent) sensors coupled to the waveguide 101 at respective first and second positions spaced from each other along the length of the waveguide, the respective length of the waveguide between the respective first and second positions following a path that changes direction (e.g. in any of the ways discussed herein, e.g., comprises one or more loops or turns) to thereby limit an extent of the waveguide. This helps to further limit the extent of the waveguide 101 in at least one spatial dimension, and helps to increase the spatial signal diversity which can be achieved in a given physical space by increasing the length of the waveguide 101 and the number of sensors $\mathbf{102}_{1,2\ldots n}$ which can be acoustically coupled thereto. It may be that the sensors of one or more or each of the pairs of sensors are adjacent to each other in the sense that they are acoustically coupled to the waveguide at first and second positions spaced along the length of the waveguide, wherein none of the other acoustic sensors $\mathbf{102}_{1,2\ldots n}$ are acoustically coupled to the waveguide at positions between the first and second positions. It may be that the respective first and second positions are spaced from each other along the length of the waveguide such that signals detected by the sensors of each of the plurality of pairs are phase shifted with respect to each other, for example it may be that the spacing between the positions at which the sensors of the respective pair are acoustically coupled to the waveguide differs from (i.e., is not equal to) an integer multiple of the (e.g. predetermined) wavelength of the signals being received or from an integer multiple of half of the (e.g. predetermined) wavelength of the signals being received. It may be that the plurality of pairs of sensors provide additional spatial signal diversity as compared to a single one of the pairs of sensors.

Figure 5:
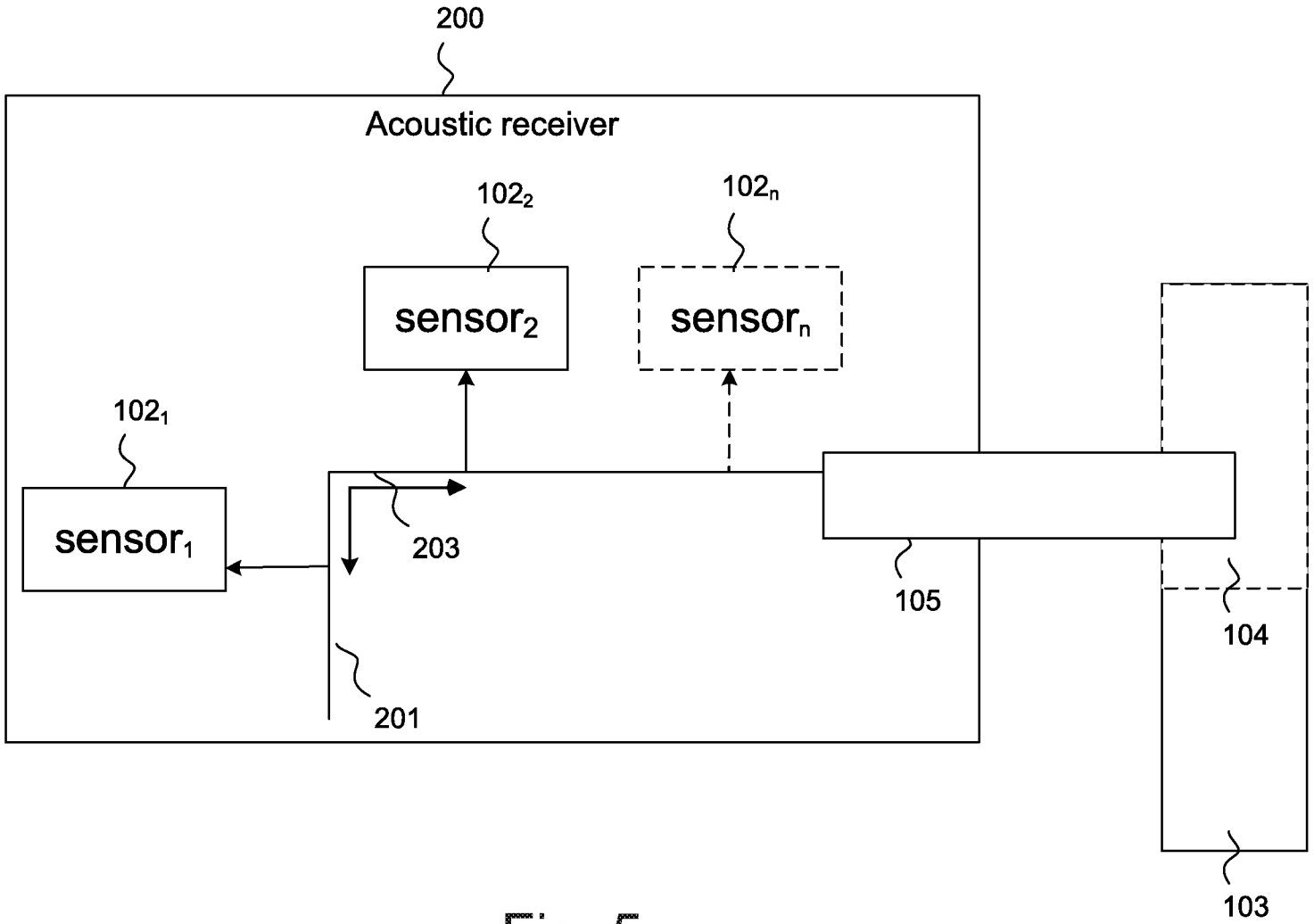
FIG. 5 is a schematic diagram of functional blocks of an example acoustic receiver comprising an example waveguide which follows a path that changes direction between at least two of a plurality of sensors.

FIG. 5 is a schematic diagram of an example acoustic receiver 200 comprising an acoustic waveguide 201 and at least first and second sensors $\mathbf{102}_{1,\ldots,n}$ acoustically coupled to the waveguide 201 at respective positions spaced along the length of the waveguide 201, where the length of waveguide between the respective positions follows a path 203 which changes direction to thereby limit an extent of the waveguide 201 in at least one spatial dimension. In particular, the length of the waveguide 201 between the positions at which sensors $\mathbf{102}_1$ and $\mathbf{102}_2$ are acoustically coupled thereto has a vertical portion and a horizontal portion which together follow a path which changes direction, in this example at a right angle, to thereby limit the extent of the waveguide in a vertical spatial dimension with respect to the longitudinal axis of the communication channel 103 (e.g. as compared to a straight waveguide extending parallel to the longitudinal axis of the communication channel 103), which in this example extends in a vertical direction. As before, the waveguide 201 guides acoustic signals received from the acoustic communication channel 103 to the sensors $\mathbf{102}_{1,\ldots,n}$ from a feedpoint, for example provided by the coupler 105.

The receiver 200 of FIG. 5 has several features in common with the receiver 100 of FIG. 4 and corresponding features are referred to using the same reference numerals. In the example shown in FIG. 5, the waveguide 201 of the acoustic receiver 200 is acoustically coupled (e.g. mounted) to the acoustic conductor 104 that forms at least part of the acoustic communication channel 103 by way of the acoustic coupler 105. Alternatively, the waveguide 201 may be coupled (e.g. mounted) directly to the acoustic conductor 104.

It may be that the positions at which the first and second sensors are acoustically coupled to the waveguide are spaced from each other along the waveguide such that signals detected by the first and second sensors are phase shifted with respect to each other, for example it may be that the spacing between the positions at which the sensors are acoustically coupled to the waveguide differs from (i.e., is not equal to) an integer multiple of the (e.g. predetermined) wavelength of the signals being received or from an integer multiple of half of the (e.g. predetermined) wavelength of the signals being received.

As above, the plurality of sensors $\mathbf{102}_{1,\ldots,n}$ may comprise a plurality of pairs of sensors for sensing acoustic signals, each of the pairs of sensors comprising respective first and second (e.g. adjacent) sensors coupled to the waveguide 201 at respective first and second positions spaced from each other along the length of the waveguide, the respective length of the waveguide between the respective first and second positions of one or more or each of the pairs of sensors following a path that changes direction to thereby limit the extent of the waveguide. This helps to further improve signal diversity and spatial compression of the waveguide. It may be that the sensors of one or more or each of the pairs of sensors are adjacent to each other in the sense that they are acoustically coupled to the waveguide at first and second positions spaced along the length of the waveguide, wherein none of the other acoustic sensors $\mathbf{102}_{1,2\ldots n}$ are acoustically coupled to the waveguide at positions between the first and second positions. It may be that the respective first and second positions are spaced from each other along the length of the waveguide such that signals detected by the sensors of each of the plurality of pairs are phase shifted with respect to each other, for example it may be that the spacing between the positions at which the sensors of the respective pair are acoustically coupled to the waveguide differs from (i.e., is not equal to) an integer multiple of the (e.g. predetermined) wavelength of the signals being received or from an integer multiple of half of the (e.g. predetermined) wavelength of the signals being received. It may be that the plurality of pairs of sensors provide additional spatial signal diversity as compared to a single one of the pairs of sensors.

It will be understood that the change in direction between the vertical and horizontal portions of the waveguide 201 may alternatively be curved (e.g. the waveguide 201 may comprise a bend between the vertical and horizontal portions). Additionally or alternatively, the change in direction of the path followed by the waveguide 201 may form an acute or obtuse angle between the portions of the waveguide 201 before and after the change in direction.

Figure 6:
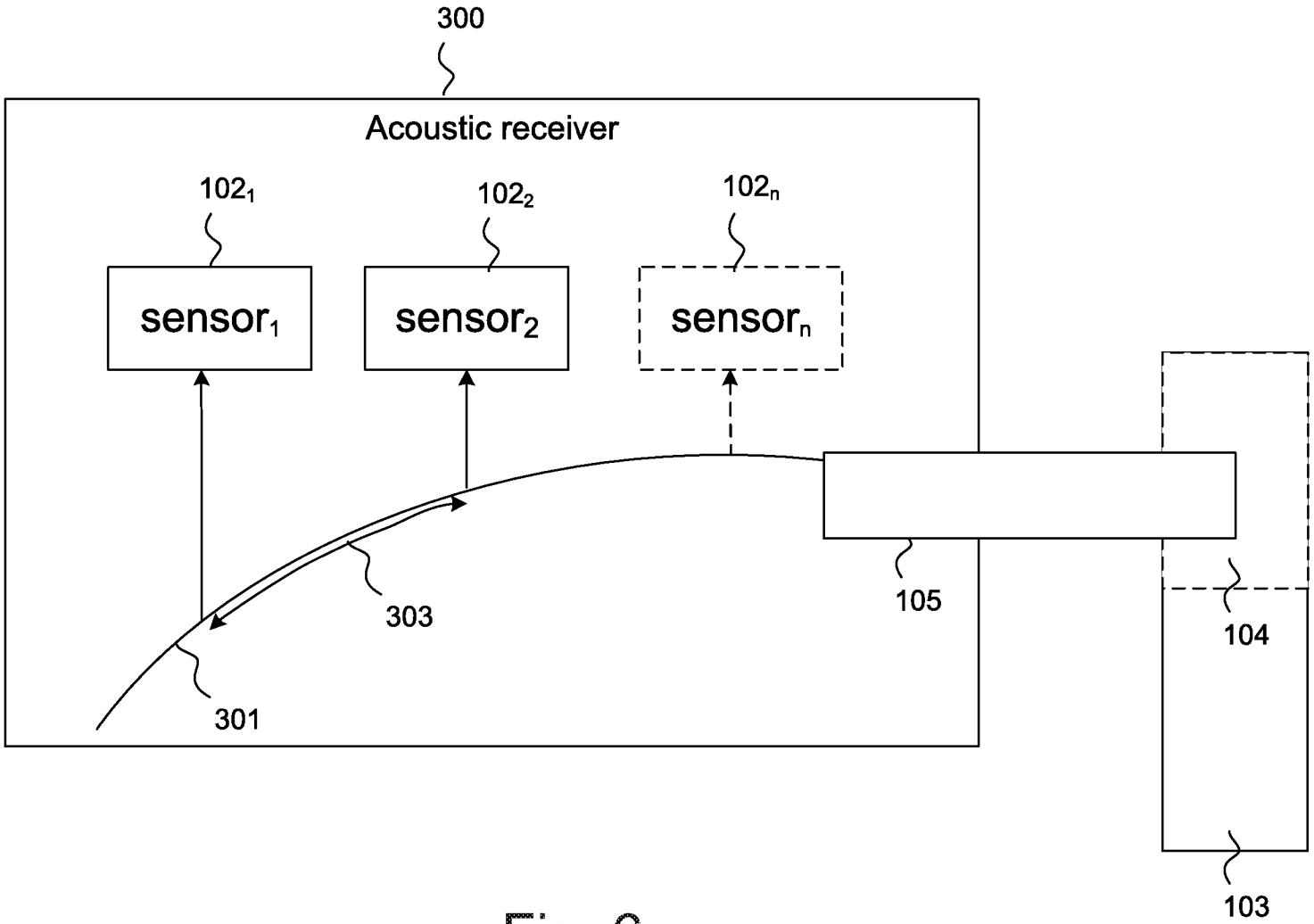
FIG. 6 is a schematic diagram of functional blocks of an example acoustic receiver comprising an example waveguide which follows a substantially curved path.

FIG. 6 is a schematic diagram of an example acoustic receiver 300 comprising an acoustic waveguide 301 and at least first and second sensors $\mathbf{102}_{1,\ldots,n}$ acoustically coupled to the waveguide 301 at respective positions spaced along the length of the waveguide 301, where the length of waveguide 301 between respective positions follows a path 303 which changes direction to thereby limit an extent of the waveguide 301. In particular, the length of the waveguide 301 between sensors $\mathbf{102}_1$ and $\mathbf{102}_2$ is curved to thereby limit the extent of the waveguide 301 in a vertical spatial dimension with respect to the longitudinal axis of the communication channel 103 (e.g. as compared to a straight waveguide extending parallel to the longitudinal axis of the communication channel 103), which in this example extends in a vertical direction. As before, the waveguide 301 guides acoustic signals received from the acoustic communication channel 103 to the sensors $\mathbf{102}_{1,\ldots,n}$ from a feedpoint, for example provided by the coupler 105.

It may be that the respective positions at which the first and second sensors are acoustically coupled to the waveguide are spaced from each other such that signals detected by the first and second sensors are phase shifted with respect to each other, for example it may be that the spacing between the positions at which the sensors are acoustically coupled to the waveguide differs from (i.e., is not equal to) an integer multiple of the (e.g. predetermined) wavelength of the signals being received or from an integer multiple of half of the (e.g. predetermined) wavelength of the signals being received.

The receiver 300 of FIG. 6 has several features in common with the receiver 100 of FIG. 4 and the receiver 200 of FIG. 5; corresponding features are referred to using the same reference numerals. In the example shown in FIG. 6, the waveguide 301 of the acoustic receiver 300 is acoustically coupled (e.g. mounted) to the acoustic conductor 104 that forms at least part of the acoustic communication channel 103 by way of the acoustic coupler 105. Alternatively, the waveguide 301 may be coupled (e.g. mounted) directly to the acoustic conductor 104.

As above, the plurality of sensors $\mathbf{102}_{1,\ldots,n}$ may comprise a plurality of pairs of (e.g. adjacent) sensors for sensing acoustic signals, each of the pairs of sensors comprising respective first and second sensors coupled to the waveguide 301 at respective first and second positions spaced from each other along the length of the waveguide, the respective length of the waveguide between the respective first and second positions following a curved path that changes direction to thereby limit an extent of the waveguide. This helps to further improve signal diversity and spatial compression of the waveguide. It may be that the sensors of one or more or each of the pairs of sensors are adjacent to each other in the sense that they are acoustically coupled to the waveguide at first and second positions spaced along the length of the waveguide, wherein none of the other acoustic sensors $\mathbf{102}_{1,2\ldots n}$ are acoustically coupled to the waveguide at positions between the first and second positions. It may be that the respective first and second positions are spaced from each other along the length of the waveguide such that signals detected by the sensors of each of the plurality of pairs are phase shifted with respect to each other, for example it may be that the spacing between the positions at which the sensors of the respective pair are acoustically coupled to the waveguide differs from (i.e., is not equal to) an integer multiple of the (e.g. predetermined) wavelength of the signals being received or from an integer multiple of half of the (e.g. predetermined) wavelength of the signals being received. It may be that the plurality of pairs of sensors provide additional spatial signal diversity as compared to a single one of the pairs of sensors.

Although the waveguide 301 is illustrated in FIG. 6 as being continuously curved, it may be that the waveguide 301 comprises at least one straight portion, for example extending from the curved portion or between respective curved portions. In an example, the path 303 followed by the length of the waveguide 301 between the at least first and second positions may comprise at least one straight portion and at least one curved portion.

In some examples, it may be that the path 303 followed by the length of the waveguide 301 between the respective first and second positions, changes direction more than once. For example, it may be that at least a portion of the path continuously or repeatedly changes direction. It may be that the change in direction in the path 303 followed by the waveguide 301 causes the path 303 to double-back, such that the portions before and after the change in direction are substantially parallel. For example, the path 303 may form a U-shape.

Figure 7:
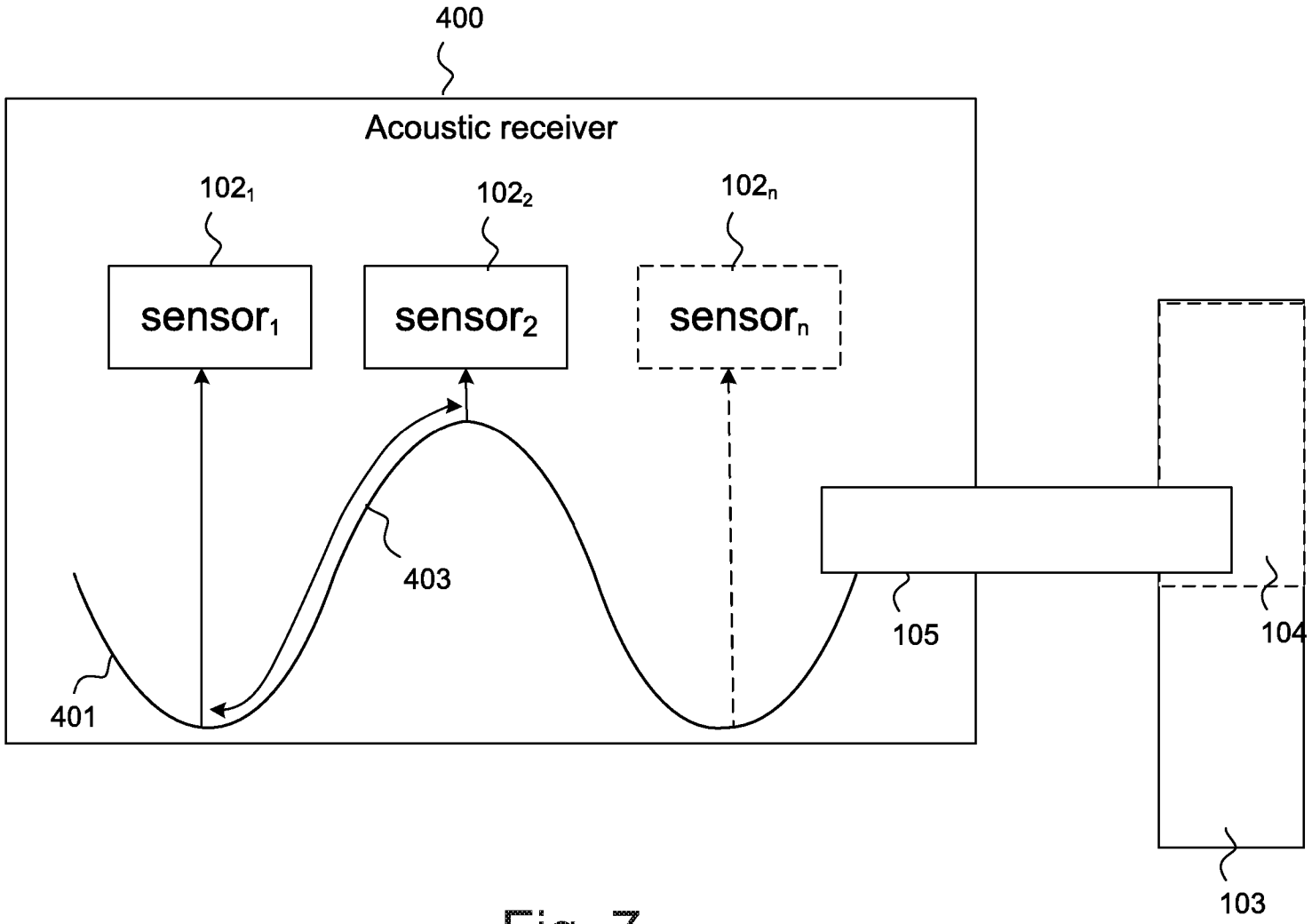
FIG. 7 is a schematic diagram of functional blocks of an example acoustic receiver comprising an example waveguide which follows a substantially sinusoidal path.

FIG. 7 is a schematic diagram of an example acoustic receiver 400 comprising an example waveguide 401 and at least first and second sensors $\mathbf{102}_{1,\ldots,n}$ acoustically coupled to the waveguide 401 at respective positions spaced along the length of the waveguide 401, where the length of the waveguide between the respective positions follows a path 403 which changes direction to thereby limit an extent of the waveguide 401. In particular, the length of the waveguide 401 between sensors $\mathbf{102}_1$ and $\mathbf{102}_2$ follows at least part of a substantially sinusoidal path 403 to thereby limit the extent of the waveguide 401 in a vertical spatial dimension with respect to the longitudinal axis of the communication channel 103 (e.g. compared to a straight waveguide extending parallel to the longitudinal axis of the communication channel 103), which in this example extends in a vertical direction. As before, the waveguide 401 guides acoustic signals from the acoustic communication channel 103 to the sensors $\mathbf{102}_{1,\ldots,n}$. It may be that the respective positions are spaced from each other along the length of the waveguide such that signals detected by the first and second sensors are phase shifted with respect to each other, for example it may be that the spacing between the positions at which the sensors are acoustically coupled to the waveguide differs from (i.e., is not equal to) an integer multiple of the (e.g. predetermined) wavelength of the signals being received or from an integer multiple of half of the (e.g. predetermined) wavelength of the signals being received.

The receiver 400 of FIG. 7 has several features in common with the receiver 100 of FIG. 4, the receiver 200 of FIG. 5 and the receiver 300 of FIG. 6; corresponding features are referred to using the same reference numerals. In the example shown in FIG. 7, the waveguide 401 of the acoustic receiver 400 is acoustically coupled (e.g. mounted) to the acoustic conductor 104 that forms at least part of the acoustic communication channel 103 by way of the acoustic coupler 105. Alternatively, the waveguide 401 may be coupled (e.g. mounted) directly to the acoustic conductor 104.

As above, the plurality of sensors $\mathbf{102}_{1,\ldots,n}$ may comprise a plurality of pairs of (e.g. adjacent) sensors for sensing acoustic signals, each of the pairs of sensors comprising respective first and second sensors coupled to the waveguide 401 at respective first and second positions spaced from each other along the length of the waveguide, the respective length of the waveguide between the respective first and second positions following at least part of a sinusoidal path that changes direction to thereby limit an extent of the waveguide. This helps to further improve signal diversity and spatial compression of the waveguide. It may be that the sensors of one or more or each of the pairs of sensors are adjacent to each other in the sense that they are acoustically coupled to the waveguide at first and second positions spaced along the length of the waveguide, wherein none of the other acoustic sensors $\mathbf{102}_{1,2\ldots n}$ are acoustically coupled to the waveguide at positions between the first and second positions. It may be that the respective first and second positions are spaced from each other along the length of the waveguide such that signals detected by the sensors of each of the plurality of pairs are phase shifted with respect to each other, for example it may be that the spacing between the positions at which the sensors of the respective pair are acoustically coupled to the waveguide differs from (i.e., is not equal to) an integer multiple of the (e.g. predetermined) wavelength of the signals being received or from an integer multiple of half of the (e.g. predetermined) wavelength of the signals being received. It may be that the plurality of pairs of sensors provide additional spatial signal diversity as compared to a single one of the pairs of sensors.

Although the waveguide 401 is illustrated in FIG. 7 as being continuously curved following at least part of a sinusoidal path, it may be that the waveguide 401 comprises at least one straight portion. In an example, the path 403 followed by the length of the waveguide 401 between the respective first and second positions may comprise at least one straight portion and at least one portion conforming to a sinusoid.

In another example, it may be that the length of the waveguide 401 between the respective first and second positions does not follow a sinusoidal path. Nevertheless, it may be that the length of the waveguide 401 between the respective first and second positions follows a path which changes direction of curvature. It may be that the length of the waveguide 401 between the respective first and second positions follows a serpentine path, such as a serpentine path comprising one or more loops or turns.

It may be that the serpentine (e.g. sinusoidal) path may be fitted, or otherwise shaped, to e.g. maximise the number of turns in the path, or to e.g. fill a given (e.g. an available) available space, to improve the compression of the waveguide 401. For example, the properties (e.g. amplitude and period) of the path may be selected to optimise the effectiveness of the compression (i.e. the limitation of an extent) of the waveguide 401 for a particular spatial constraint.

It may be that the waveguide 401 comprises a plurality of substantially parallel straight portions, wherein at least two adjacent substantially parallel straight portions are joined together by a portion of the waveguide which follows a path which changes direction (e.g. the said portion of the waveguide following the path which changes direction extending between first and second positions at which respective sensors are coupled to the waveguide). For example, it may be the length of waveguide 401 between the respective first and second positions follows a (e.g. serpentine) path comprising first and second substantially parallel (e.g. straight) neighbouring portions and a curved or squared-off U-shaped portion (e.g. providing a loop or turn) extending between the substantially parallel portions. Alternatively, the first and second portions may be provided at acute or obtuse angles to each other. It may be that the first and second portions are the same length or different lengths.

As set out above, the waveguide 401 may follow a serpentine path such a sinusoidal path which may have a repeating pattern, such as a repeating pattern comprising one or more loops or turns. It will be understood that in other examples the waveguide 401 may follow a path which is not sinusoidal or serpentine but nevertheless comprises a repeating pattern. It may be that the repeating pattern helps to limit the extent of the waveguide in the at least one spatial dimension.

Figure 8:
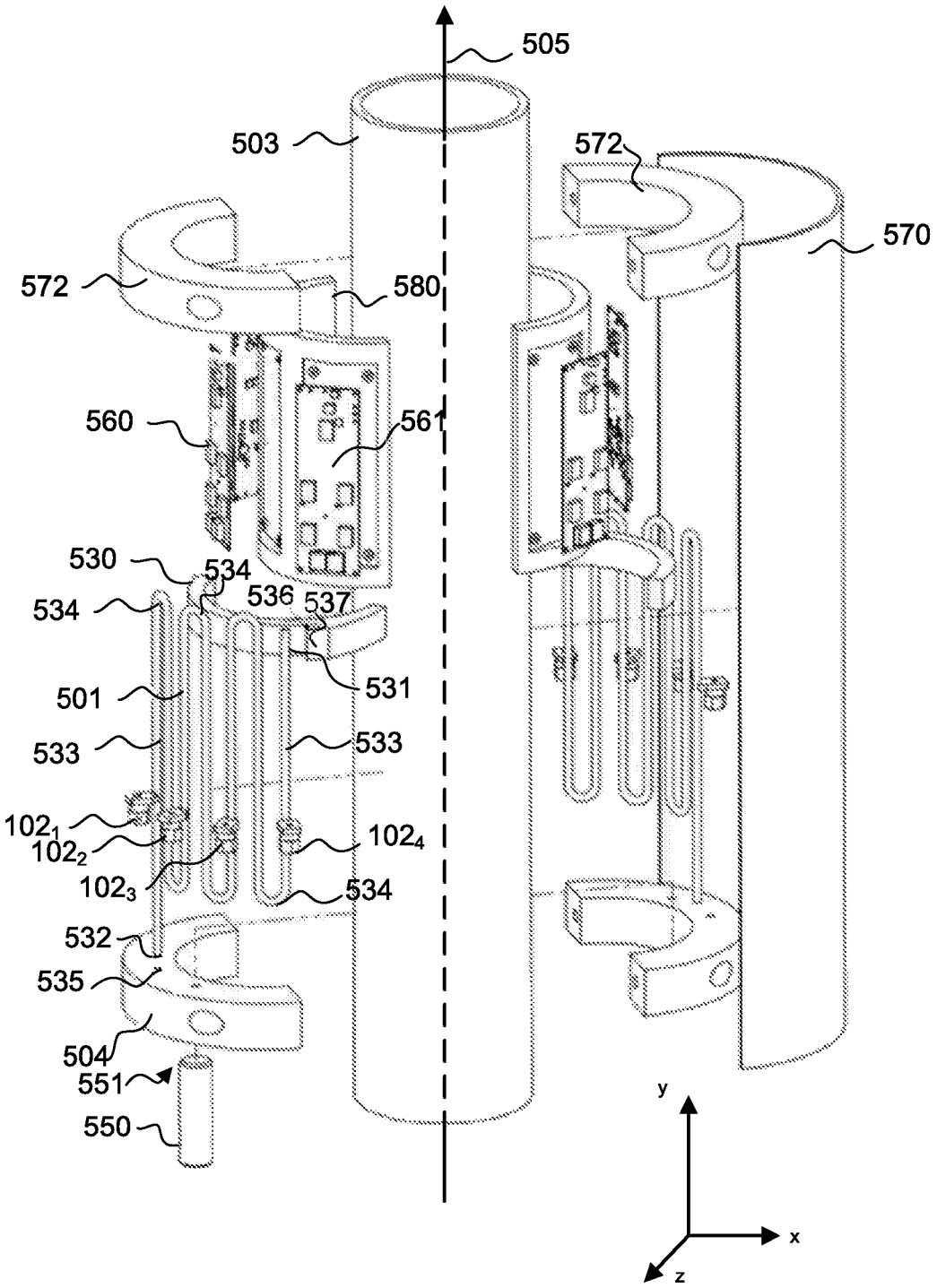
FIG. 8 is a schematic diagram of a de-constructed view of an example assembly comprising an acoustic receiver.
Figure 9:
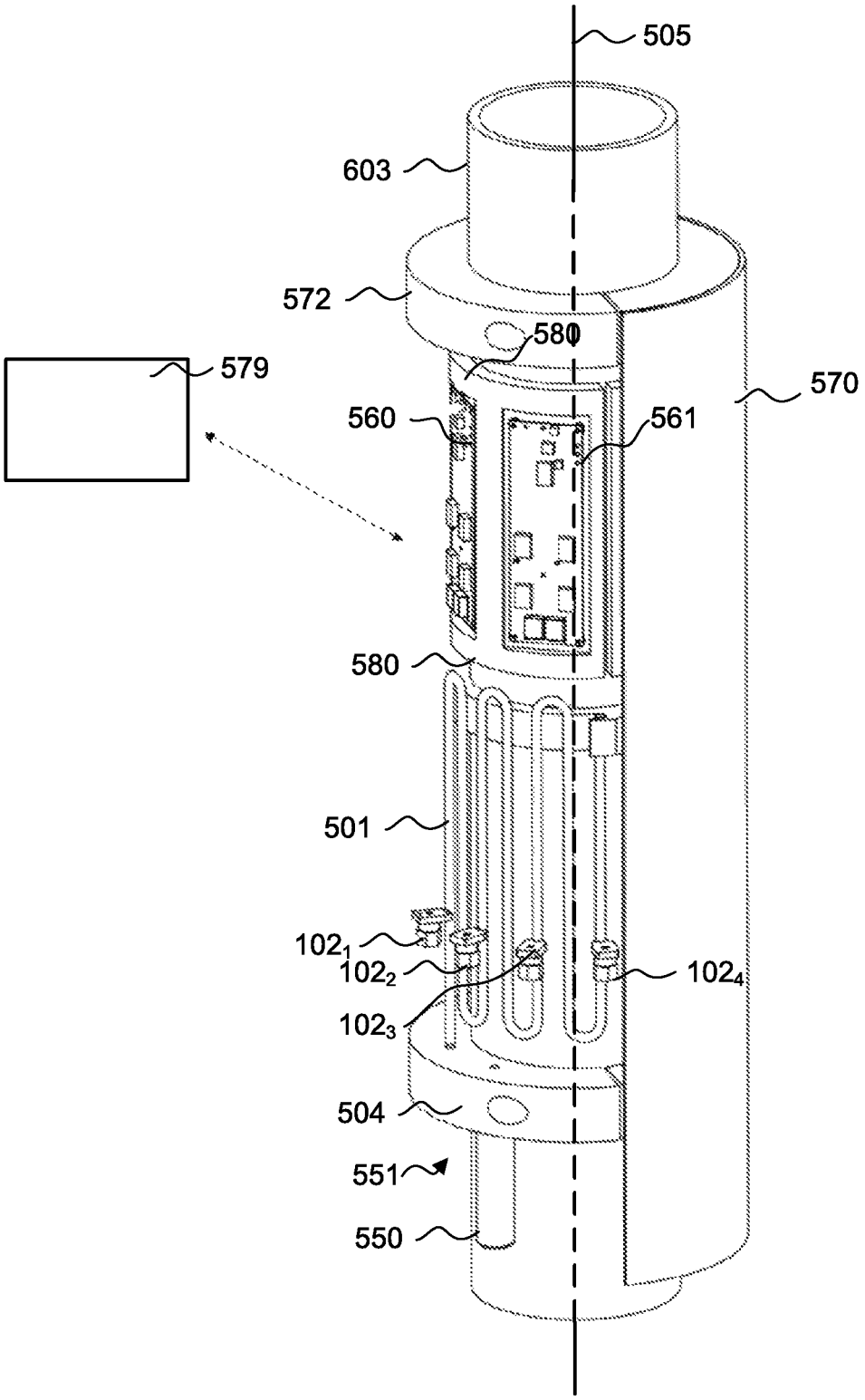
FIG. 9 is a schematic diagram of the example assembly of FIG. 8 mounted to an acoustic conductor of an acoustic communication channel.

FIGS. 8 and 9 are schematic de-constructed and assembled views respectively of an example assembly comprising an acoustic receiver and a coupler 504. The acoustic receiver comprises a waveguide 501. The waveguide 501 comprises an acoustic conductor, such as a metal tube or wire, however the waveguide 501 may comprise any material and structure suitable for propagating acoustic signals, such as by way of vibration.

The waveguide 501 is acoustically couplable or coupled (e.g. mounted) by the coupler 504 to an (e.g. solid) acoustic conductor 503 of an (e.g. solid) acoustic communication channel, the acoustic conductor 503 having a longitudinal axis 505. The longitudinal axis of the acoustic communication channel may be co-linear with the longitudinal axis 505 of the acoustic conductor 503. The coupler 504 may provide a feedpoint by way of which acoustic signals are coupled from the acoustic communication channel to the waveguide 501.

It may be that the acoustic conductor 503 is coupled to a plurality of additional acoustic conductors (not shown) which together with the acoustic conductor 503 form the acoustic communication channel. The acoustic receiver is configured to receive acoustic signals from the acoustic communication channel. The acoustic communication channel may comprise (but is not limited to) a downhole communication channel. In this case, it may be that the acoustic conductor 503 to which the acoustic receiver is coupled (e.g. mounted) is a component of a drilling rig, for example any one of: a drill string or portion thereof, top drive, saver sub, cement head, a casing of a borehole, production tubing, a riser, coiled tubing, production tubing, slips supporting a drill string below a top drive. Alternatively, the acoustic receiver may be coupled (or mounted) to any other suitable surface located mounting point. As discussed above, the acoustic signals may comprise telemetry data or command or control data, or command acknowledgement or monitoring payload data. The acoustic signals being received may be signals from a communication node, such as a downhole communication node.

FIG. 8 shows the assembly in its unassembled state (not mounted to the acoustic conductor 503), while FIG. 9 shows the assembly in its assembled state (mounted to the acoustic conductor 503). Unless otherwise mentioned, the following discussion refers to the assembly in its assembled state as shown in FIG. 9. However, it will be understood that the discussion is equally applicable to the assembly in its unassembled state, where terms such as "coupled" and "mounted" may be replaced with corresponding terms such as "couplable" and "mountable".

The waveguide 501 provides a propagation path for guiding acoustic signals from the communication channel to four acoustic sensors $\mathbf{102}_{1,2,3,4}$ acoustically coupled to the waveguide 501 at respective positions spaced along the length of the waveguide 501 to sense acoustic signals received by the waveguide 501 from the acoustic conductor 503 of the communication channel. The sensors $\mathbf{102}_{1,2,3,4}$ may be to detect (e.g. sample) acoustic waves at the respective positions spaced along the length of the waveguide. Although four acoustic sensors are shown in FIGS. 8, 9, it will be understood that any suitable number of acoustic sensors may be provided at respective positions spaced along the length of the waveguide 501 to sense acoustic signals received from the acoustic conductor 503 of the communication channel. For example, more or fewer than four acoustic sensors may be provided. For example, at least two acoustic sensors may be provided.

It may be that the positions at which at least two of the sensors $\mathbf{102}_{1,2,3,4}$ are acoustically coupled to the waveguide 501 are spaced along the length of the waveguide 501 such that the first and second sensors are to sense signals which are phase shifted with respect to each other. By providing a plurality of sensors coupled to the waveguide at positions which are spaced along the length of the waveguide 501, for example such that the signals detected by at least two of the sensors (e.g. by each of the sensors) are phase shifted with respect to each other, for example by the spacing between at least two of the positions (e.g. the spacing between positions at which the sensors of each of one or more pairs or each pair of sensors (e.g. one or more or each pair of adjacent sensors) are acoustically coupled to the waveguide 501) differs from (i.e., is not equal to) an integer multiple of the wavelength of the signals being received or from an integer multiple of half of the wavelength of the signals being received, the sensors provide spatial signal diversity by detecting the signals at different positions along a standing wave formed on the communication channel. This increases the probability of at least one sensor detecting the signal near or at a position of peak signal strength. The wavelength of the signals being received may be predetermined.

As before, it may be that the sensors $\mathbf{102}_{1,2,3,4}$ comprise at least first, second and third sensors $\mathbf{102}_{1,2,3}$ acoustically coupled to the waveguide 501 at respective first, second and third positions spaced along the length of the waveguide 501 such that the signals detected by the first, second and third sensors $\mathbf{102}_{1,2,3}$ are phase shifted with respect to each other (e.g. the spacings between the first and second, second and third and first and third positions differs from (i.e., is not equal to) an integer multiple of the (e.g. predetermined) wavelength of the signals being received or from an integer multiple of half of the (e.g. predetermined) wavelength of the signals being received). In this way, each of the first, second and third sensors helps to improve spatial signal diversity.

The sensors $\mathbf{102}_{1,\ldots,n}$ may comprise acoustic sensors of any suitable sensor type. The sensors $\mathbf{102}_{1,\ldots,n}$ may be of the same acoustic sensor type. For example, the sensors $\mathbf{102}_{1,\ldots,n}$ may comprise accelerometers (e.g. accelerometers having an axis of acceleration to be sensed by the accelerometer aligned with the longitudinal axis of the communication channel), strain gauges, piezo-electric transducers, or fibre-optic acoustic sensors. For example, the acoustic receiver 100 may comprise accelerometers $\mathbf{102}_{1,\ldots,n}$ to sense the acoustic signals from the acoustic communication channel, the accelerometers being coupled to the waveguide 501 and sensing acoustic signals from the communication channel by way of a vibration of the waveguide 501 propagating to the accelerometers. In other examples, the plurality of sensors $\mathbf{102}_{1,\ldots,n}$ may comprise strain-gauges, piezo-electric transducers $\mathbf{102}_{1,\ldots,n}$, or fibre optic acoustic sensors to sense the vibration of the waveguide 501 by way of mechanical stress induced in the sensors as a result of the vibration of the waveguide 501 caused by acoustic signals propagating along the waveguide 501 from the acoustic communication channel.

The length(s) of waveguide 501 between the respective positions thereof at which at least first and second (e.g. the first, second and third) sensors $\mathbf{101}_{1,2,3,4}$ are acoustically coupled thereto (e.g. between the respective positions at which sensors of one or more pairs of sensors $\mathbf{101}_{1,2,3,4}$, such as one or more pairs of adjacent sensors $\mathbf{101}_{1,2,3,4}$, are acoustically coupled thereto) follow path(s) which change direction to thereby limit an extent of the waveguide 501 in a spatial dimension parallel to the longitudinal axis 505 of the acoustic conductor 503 or parallel to a longitudinal axis of the acoustic communication channel (e.g. a vertical spatial dimension), for example to reduce the extent of the waveguide 501 in that dimension compared to a straight waveguide extending parallel to the longitudinal axis of the acoustic conductor 503 or communication channel. Additionally or alternatively, the length(s) of waveguide 501 between the respective positions thereof at which at least first and second (e.g. first, second and third) sensors $\mathbf{101}_{1,2,3,4}$ are acoustically coupled thereto (e.g. between the respective positions at which sensors of one or more pairs of sensors $\mathbf{101}_{1,2,3,4}$, such as one or more pairs of adjacent sensors $\mathbf{101}_{1,2,3,4}$, are acoustically coupled thereto) follow path(s) which change direction to thereby limit an extent of the waveguide 501 in a spatial dimension substantially perpendicular to the longitudinal axis 505 of the acoustic conductor 503 or substantially perpendicular to the longitudinal axis of the acoustic communication channel (e.g. a horizontal spatial dimension), for example to reduce the extent of the waveguide 501 in that dimension compared to a straight waveguide extending perpendicular to the longitudinal axis of the acoustic conductor 503 or communication channel. Additionally or alternatively, the length(s) of waveguide 501 between the respective positions thereof at which at least first and second (e.g. first, second and third) sensors $\mathbf{101}_{1,2,3,4}$ are acoustically coupled thereto (e.g. between the respective positions at which sensors of one or more pairs of sensors $\mathbf{101}_{1,2,3,4}$, such as one or more pairs of adjacent sensors $\mathbf{101}_{1,2,3,4}$, are acoustically coupled thereto) follow path(s) which change direction to thereby limit an extent of the waveguide 501 in a horizontal or vertical spatial dimension, for example to reduce the extent of the waveguide 501 in that dimension compared to straight horizontal or vertical waveguides.

The acoustic conductor 503 may have a substantially curved (e.g. circular, or elliptical) cross-section taken perpendicular to the longitudinal axis of the conductor 503 or perpendicular to the longitudinal axis of the acoustic communication channel. For example, the acoustic conductor 503 may comprise a tubular member such as, for example, a drill string or a portion thereof.

The path followed by the waveguide 501 between respective positions of the waveguide 501 to which at least first and second sensors $\mathbf{101}_{1,2,3,4}$ are acoustically coupled changes direction to limit an extent of the waveguide 501 with respect to (e.g. in a dimension substantially parallel to) the longitudinal axis 505 of the acoustic conductor 503 (e.g. compared to a straight waveguide extending parallel to the longitudinal axis of the acoustic conductor or communication channel), or with respect to the cross-section of the acoustic conductor 503 taken perpendicular to the longitudinal axis 505 (e.g. a circumference, diameter or arc of the cross-section of the acoustic conductor 503) (e.g. compared to a straight waveguide extending perpendicular to the longitudinal axis of the acoustic conductor or communication channel).

In the illustrated example of FIG. 8, the waveguide 501 comprises a plurality (seven in the example shown in FIG. 8, although more than seven or fewer than seven may be provided) of substantially parallel straight portions 533 and respective U-shaped portions 534 extending between adjacent substantially parallel straight portions 533 to form loops or turns between them. The substantially parallel portions 533 may be substantially parallel to the longitudinal axis 505 of the acoustic conductor 503 or a longitudinal axis of the communication channel. It may be that the length of waveguide 501 between respective positions at which adjacent sensors are acoustically coupled thereto (e.g. between positions at which the first and second sensors are acoustically coupled thereto) comprises at least one loop or turn. It may be that the length of waveguide 501 between respective positions at which adjacent sensors (e.g. between positions at which the first and second sensors are acoustically coupled thereto) are acoustically coupled thereto comprises at least respective parts of two substantially parallel portions 533.

In the example of FIG. 8, the sensors $\mathbf{102}_{1,2,3,4}$ are acoustically coupled to respective straight portions 533 of the waveguide 501. The positions at which adjacent sensors $\mathbf{102}_{1,2,3,4}$ are acoustically coupled to the waveguide 501 (e.g. the positions at which the first and second sensors are acoustically coupled to the waveguide) are spaced by respective lengths of the waveguide 501 which follow a serpentine path comprising at least respective parts of adjacent first, second and third substantially parallel straight portions 533 and first and second U-shaped portions extending between the first and second and second and third straight portions 533. The U-shaped portions provide changes in direction in the path followed by the waveguide 501 between the positions at which adjacent sensors $\mathbf{102}_{1,2,3,4}$ are acoustically coupled thereto. In alternative examples, adjacent straight portions 533 may be provided at acute or obtuse angles to each other.

In the example of FIG. 8, the U-shaped portions 534 are oriented substantially parallel to the longitudinal axis 505 of the acoustic conductor 503 and to the longitudinal axis of acoustic communication channel. By providing the waveguide 501 with substantially parallel straight portions 533 between respective turns or loops, the waveguide 501 can be provided with improved spatial compression compared to a waveguide having respective portions 533 extending at acute or obtuse angles to each other between turns, such as in the example illustrated in FIG. 7.

Although the change in direction in the path followed by the waveguide may in some examples be confined to a (e.g. two-dimensional) plane (such as in, but not limited to, the examples of FIGS. 4-7), in the example of FIG. 8, the waveguide 501 is further curved to conform to an outer curvature of the acoustic conductor 503 to which it is coupled or couplable. The waveguide 501 is curved to conform to an outer curvature of the acoustic conductor 503

(i.e. an outer curvature of a cross section of the acoustic conductor 503 taken perpendicular to its longitudinal axis) such that it fits around the acoustic conductor 503 when acoustically coupled (e.g. mounted) thereto. The change in direction of the path followed by the waveguide 501 thus comprises a component in a direction which conforms to a curvature of a cross-section of the acoustic conductor 503 taken perpendicular to its longitudinal axis. In the example of FIG. 8, the waveguide 501 is curved to conform to an outer curvature of at least a curved portion of a cross-section of the acoustic conductor 503 taken perpendicular to longitudinal axis 505 of the acoustic conductor 503 or the communication channel. The change in direction of the path followed by the waveguide 501 also comprises a component in a direction substantially perpendicular to the longitudinal axis of the acoustic conductor 503. The change in direction of the path followed by the waveguide 501 comprises at least one component in each of three spatial dimensions (e.g. x, y, z dimensions).

The waveguide 501 may be couplable or coupled to the acoustic conductor 503 of the acoustic communication channel by the coupler 504. The coupler 504 may be configured to fixedly acoustically couple (e.g. fixedly hold, restrain or clamp) a first end 532 of the waveguide 501 to the acoustic conductor 503 to thereby acoustically couple the waveguide 501 to the acoustic conductor 503. The waveguide 501 is curved to conform to an outer curvature of the acoustic conductor 503 (i.e. an outer curvature of a cross section of the acoustic conductor 503 taken perpendicular to its longitudinal axis) such that it fits around the acoustic conductor 503 when mounted thereto by the coupler 504. In the illustrated example of FIGS. 8, 9, the coupler 504 comprises a semi-annular coupler 504 comprising a recess 535 on an upper surface thereof (e.g. an upper surface perpendicular to a direction substantially parallel to the longitudinal axis of the conductor 503 or communication channel) for receiving and fixedly holding (e.g., restraining or clamping) the first end 532 of the waveguide therein. In the example of FIGS. 8, 9, the first end 532 of the waveguide is substantially straight and extends in a direction parallel to the longitudinal axis of the acoustic conductor 503 or communication channel. The recess 535 may alternatively be provided in a lower surface of the coupler 504 opposite the upper surface (e.g. a lower surface perpendicular to a direction substantially parallel to the longitudinal axis of the acoustic conductor 503 or communication channel). The coupler 504 has a semi-annular inner surface which conforms to the outer curvature of the acoustic conductor 503 (i.e., the outer curvature of the cross section of the conductor 503 taken perpendicular to its longitudinal axis 505) so that it fits around the acoustic conductor 503 when attached thereto, allowing close physical contact (and therefore strong acoustic coupling) to be achieved between the coupler 504 and the acoustic conductor 503.

In the example of FIGS. 8, 9, the coupler 504 is removably connectable to the acoustic conductor 503 by attachment (e.g. by way of fasteners) to a further semi-annular member (to thereby form an annular coupler) which has a semi-annular inner surface which conforms to the outer curvature of the acoustic conductor 503 to thereby fit around the acoustic conductor 503 when coupled thereto and is mounted to the opposite side of the acoustic conductor 503. The further semi-annular member may comprise a semi-annular coupler similar or identical to the semi-annular coupler 504 and may be configured to acoustically couple a waveguide of a second receiver to the acoustic conductor 503 (such as a second receiver having any of the features of the receiver coupled to the acoustic conductor 503 by coupler 504).

Although the coupler 504 is described as semi-annular above, and that it is removably connectable to the acoustic conductor 503 by attachment (e.g. by way of fasteners) to a further semi-annular member, it will be understood that the coupler 504 may instead be an annular coupler 504 whereby the further semi-annular member to which it is attached to mount the coupler 504 to the acoustic conductor 503 forms part of the coupler 504. In this case, the further semi-annular member may or may not couple a second receiver to the conductor 503.

The coupler 504 is acoustically conductive such that the coupler 504 acoustically couples the first end 532 of the waveguide 501 to the acoustic conductor 503 when the first end 532 of the waveguide 501 is received in and fixedly held with respect to the recess 535 thereof and the coupler 504 is mounted to the conductor 503. Vibrations from the acoustic conductor 503 are transferred to the waveguide 501 by way of the (e.g. mechanical) contact between the coupler 504 and the acoustic conductor 503. The first end 532 of the waveguide 501 may be fixedly secured to the recess 535 of the coupler 504 (e.g. by way of an interference fit, a fastener or any other suitable securing means) to thereby fixedly acoustically couple the waveguide 501 to the coupler 504 and the acoustic conductor 503.

In the example illustrated in FIG. 8, 9 the U-shaped portions of the waveguide 501 are oriented substantially parallel to a straight portion 533 of the waveguide 501 comprising the first end 532 of the waveguide 501.

Although FIGS. 8, 9 illustrate the waveguide as having a substantially straight first end 532 extending in a direction parallel to the longitudinal axis of the acoustic conductor 503 or communication channel such that the first end 532 can be received in the recess 535 of the coupler 504, it will be understood that any other suitable coupling between the waveguide 501 and the coupler 504 (or indeed between the waveguide and the acoustic conductor 503) may be provided. Accordingly, in some examples, the waveguide 501 may omit a straight first end 532 which extends substantially parallel to the longitudinal axis of the conductor 504 or communication channel.

The assembly of FIGS. 8, 9 may also comprise a holder 530 configured to hold (e.g. retain) a second end 531 of the waveguide 501 to thereby inhibit displacement of the second end 531 of the waveguide with respect to the acoustic conductor 503 while allowing the second end 531 of the waveguide to vibrate (e.g. substantially freely) in response to acoustic signals propagating on the waveguide 501. The holder 530 may be offset from the coupler 504 along the longitudinal axis of the acoustic conductor 503 or along the longitudinal axis of the acoustic communication channel. For example, the holder 530 is shown in the example of FIGS. 8, 9 as being provided vertically above the coupler 504.

In the example illustrated in FIG. 8, the holder 530 is provided in the form of a semi-annular member mounted around and having a semi-annular inner surface conforming to the outer curvature of the acoustic conductor 503 to thereby fit around the acoustic conductor 503 when coupled thereto, the holder comprising a recess 536 which receives and partially houses the second end 531 of the waveguide 501 therein, the recess 536 being formed between first and second portions of the holder 530. In the example of FIGS. 8, 9, the first portion comprises a surface of the holder 530 provided on an opposite side of the holder 530 from the semi-annular surface thereof; the second portion comprises a retaining arm 537 which overhangs the first portion to form the recess 536.

In the example of FIGS. 8, 9, the holder 530 is removably connectable to the acoustic conductor 503 by attachment (e.g. by way of fasteners) to a further semi-annular member (to thereby form an annular holder 530) which has a semi-annular inner surface which conforms to the outer curvature of the acoustic conductor 503 to thereby fit around the acoustic conductor 503 when coupled thereto and is mounted to the opposite side of the acoustic conductor 503. The further semi-annular member may comprise a semi-annular holder similar or identical to the semi-annular holder 530 and may be configured to hold (e.g. retain) a second end of a waveguide of a second receiver to thereby inhibit displacement of the second end of the waveguide of the second receiver with respect to the acoustic conductor 503 while allowing the second end of the waveguide of the second receiver to vibrate (e.g. substantially freely) in response to acoustic signals propagating on the waveguide of the second receiver (such as a second receiver having any of the features of the receiver coupled to the conductor by coupler 504).

Although the holder 530 is described as semi-annular above, and that it is removably connectable to the acoustic conductor 503 by attachment (e.g. by way of fasteners) to a further semi-annular member, it will be understood that the holder 530 may instead be an annular holder 530 whereby the further semi-annular member to which it is attached to mount the holder 530 to the acoustic conductor 503 forms part of the holder 530. In this case, the further semi-annular member may or may not hold a second end of a second receiver with respect to the conductor 503.

When the second end 531 of the waveguide 501 is provided in the recess 536, the first and second portions of the holder 530 inhibit displacement of the waveguide 501 with respect to the acoustic conductor 503, for example radially and circumferentially with respect to the conductor 503. However, it may be that the holder 530 does not fixedly restrain the second end 531 of the waveguide 501 (e.g. it may be that the holder 530 does not restrain the second end 531 of the waveguide 501 so that it cannot move or vibrate), to thereby allow it to vibrate (e.g. within the recess 536) in response to acoustic signals propagating on the waveguide 501. It may be that there is little or no contact between the holder 530 and the second end 531 of the waveguide 501 in normal use. It may be that the holder 530 is acoustically insulating to inhibit transmission of acoustic signals through the holder 530 between the second end 531 of the waveguide 501 and the acoustic conductor 503. The holder 530 may at least one of: formed of an acoustically insulating material, structured to be acoustically insulating, or be acoustically isolated (such as by the addition of a dampener) from the acoustic conductor 503 (for example).

By allowing the second end 531 of the waveguide to vibrate (e.g. substantially freely) in response to acoustic signals propagating on the waveguide 501, and by the holder being acoustically insulating, direct coupling of acoustic signals from the acoustic conductor 503 into the waveguide 501 through the second end 531 of the waveguide 501 is inhibited, thereby reducing interference and noise in the sensor data generated by the sensors $\mathbf{101}_{1,2,3,4}$ which may otherwise be caused by signals detected from the acoustic conductor 503 through the holder 530. However, the holder 530 helps to retain the receiver (i.e. inhibit displacement of the receiver) with respect to the acoustic conductor 503. This is particularly important in downhole applications where the acoustic conductor and receiver may rotate with a drill string such as in completion or drilling applications.

In some examples, the holder 530 may be omitted.

Although the waveguide 501 is illustrated in FIG. 8 by one of several possible configurations, it may be that the waveguide 501 may take any of the forms discussed herein.

In alternative examples, it may be that the waveguide 501 is directly coupled (e.g. mounted) to the acoustic conductor 503 without a separate coupler 504. For example, it may be that a first end, the second end or the first and second ends of the waveguide 501 may be fixed directly to the acoustic conductor 503. For example, it may be that the first or second end of the waveguide 501 is directly coupled (e.g. in mechanical contact) to the acoustic conductor 503. For example, it may be that a first or second end of the waveguide 501 is welded, or otherwise permanently or temporarily affixed, to the acoustic conductor 503. As before, the waveguide 501 may be curved to conform to an outer curvature of the acoustic conductor 503 (taken perpendicular to its longitudinal axis) such that it fits around the acoustic conductor 503. However, the coupling of the waveguide 501 to the acoustic conductor 503 may be provided by any means of coupling or mounting.

As illustrated on the right hand side of FIGS. 8, 9, an outer jacket 570 may be provided to house the receiver (including the waveguide 501 and the sensors $\mathbf{101}_{1,2,3,4}$) between the conductor 503 and the jacket 570. This helps to better protect the receiver, particularly in a downhole application where the acoustic conductor 503 to which the receiver is mounted may be part of a drilling rig which is rotatable (to actuate the drill), such as completion or drilling applications. The outer jacket 570 may be acoustically insulating (or acoustically non-conductive) in order to inhibit transmission of acoustic signals between the acoustic conductor 503 and the waveguide 501 through the outer jacket 570. It may be that the outer jacket 570 is made from acoustically insulating or acoustically non-conductive material. This helps to reduce noise and interference levels in the signals detected by the sensors $\mathbf{101}_{1,2,3,4}$. It may be that the outer jacket 570 is further lined with acoustically attenuating material to further help to attenuate environmental noise propagating to the waveguide 501 from outside the jacket 570. For example, it may be that the outer jacket (e.g. 570) comprises an acoustically attenuating layer (such as an inner layer, closest to the acoustically sensitive components of the receiver e.g. the waveguide 501) to attenuate noise, such as environmental noise. For example, the acoustically attenuating layer may comprise a visco-elastic membrane for attenuating acoustic noise propagating through the air towards the waveguide or processing or transmission circuitry provided between the outer jacket 570 and the acoustic conductor 503.

The outer jacket 570 may be coupled to the acoustic conductor 503 by way of a coupler 572 to which the outer jacket 570 may be fastened. In the example of FIGS. 8-12, the coupler 572 is a semi-annular coupler 572 which conforms to the outer curvature of the acoustic conductor 503 (i.e., the outer curvature of the cross section of the conductor 503 taken perpendicular to its longitudinal axis 505) to thereby fit around the acoustic conductor 503 when coupled thereto. The coupler 572 has an inner semi-annular surface which is mounted to the acoustic conductor 503 and an outer surface opposite the inner surface, the outer jacket 570 being mounted to the outer surface (e.g. by fasteners). The outer surface of the outer jacket 570 also follows the outer curvature of the cross-section of the acoustic conductor 503. The coupler 572 may be acoustically insulating in order to further inhibit transmission of acoustic signals between the acoustic conductor 503 and the waveguide through the outer jacket 570.

By providing the waveguide 501 with a curvature which conforms to the curvature of at least a curved portion of a cross-section of the acoustic conductor 503 taken perpendicular to longitudinal axis 505 of the acoustic conductor 503 or the communication channel, the outer jacket 570 (which fits to the acoustic conductor 503 over the waveguide 501) can also be provided with a curvature which conforms to the curvature of at least a curved portion of a cross-section of the acoustic conductor 503 taken perpendicular to longitudinal axis 505 of the acoustic conductor 503 or the communication channel so as to fit around the acoustic conductor 503 and the waveguide 501 when coupled to the acoustic conductor 503. This helps to protect the outer jacket 570, and thus the receiver housed therein, particularly in a downhole application where the assembly may rotate with the acoustic conductor 503 during use of a drilling rig comprising the acoustic conductor 503 (e.g. in completion or drilling applications).

It will be understood that an outer jacket 570 may still be provided even in examples in which the waveguide 501 does not conform to the outer curvature of the acoustic conductor 503, to thereby protect the receiver. In this case, it may be that the outer jacket 570 does not conform to the outer curvature of the acoustic conductor 503.

In some examples, the outer jacket 570 (and coupler 732) may be omitted.

Figure 10:
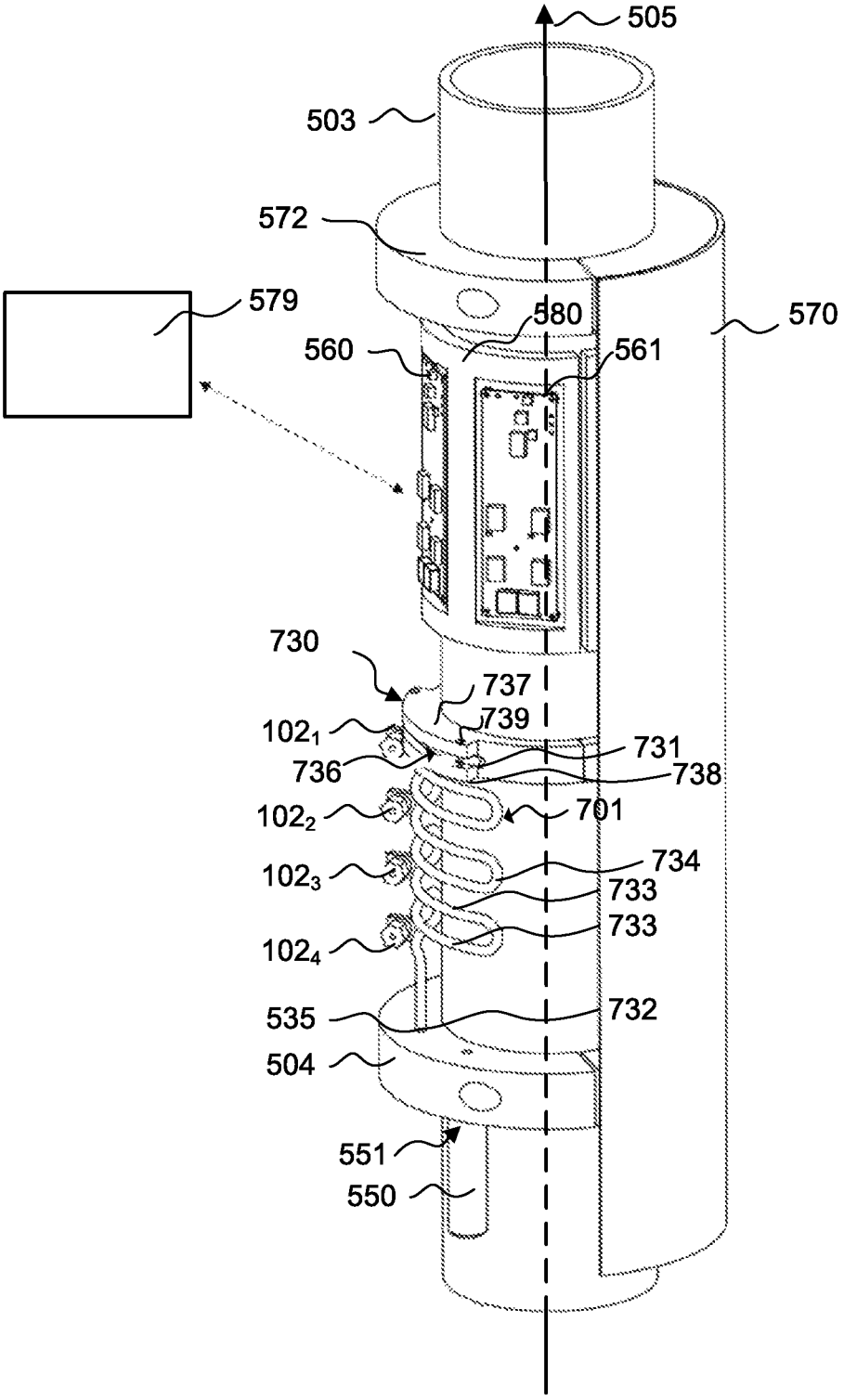
FIG. 10 is a schematic diagram of a further example assembly.

FIGS. 10-12 illustrate similar assemblies to the assembly of FIGS. 8, 9. Corresponding features will be referred to using the same reference numerals. In the examples of FIGS. 10-12, the acoustic receiver comprises alternative waveguides 701, 801, 901 to the waveguide 501 of FIGS. 8, 9. In each case, the waveguide 701, 801, 901 comprises an acoustic conductor, such as a metal tube or wire, and provides a propagation path for guiding acoustic signals from the communication channel to four acoustic sensors $\mathbf{102}_{1,2,3,4}$ acoustically coupled to the waveguide at respective positions spaced along the length of the waveguide to sense acoustic signals received by the acoustic conductor 503 from the communication channel. In each case, the waveguide 701, 801, 901 guides acoustic signals from the acoustic communication channel to the sensors $\mathbf{102}_{1,2,3,4}$. In each case, at least first and second sensors $\mathbf{102}_{1,2,3,4}$ (e.g. first, second and third sensors $\mathbf{102}_{1,2,3,4}$ or each of the sensors $\mathbf{102}_{1,2,3,4}$) are coupled to different positions of the waveguide so as to detect different portions of a standing wave (with respect to a periodic repeating pattern of the standing wave) at the different positions. In each case, the communication channel may be (but is not limited to) a downhole communication channel at least a portion of which is provided downhole beneath a surface. The acoustic receiver may be provided above the surface. The acoustic signals being received may be signals from a communication node, such as a downhole communication node.

Although four acoustic sensors $\mathbf{102}_{1,2,3,4}$ are shown in each of FIGS. 10-12, it will be understood that any suitable number of acoustic sensors may be provided at respective positions spaced along the length of the waveguide to sense acoustic signals received from the acoustic conductor 503 of the communication channel. For example, more or fewer than four acoustic sensors may be provided. For example, at least two acoustic sensors may be provided.

In each of FIGS. 10-12, it may be that the spacing between the positions at which at least first and second sensors $\mathbf{102}_{1,2,3,4}$ are acoustically coupled to the waveguide (e.g. the spacing between positions at which the sensors of each of one or more pairs or each pair of sensors, such as the sensors of each of one or more pairs or each pair of adjacent sensors, are acoustically coupled to the waveguide) is such that the signals detected by said sensors (e.g. by each of the sensors) are phase shifted with respect to each other (e.g. the spacing differs from (i.e., is not equal to) an integer multiple of the wavelength of the signals being received or from an integer multiple of half of the wavelength of the signals being received). By providing a plurality of sensors coupled to the waveguide at positions so that they detect signals which are phase shifted with respect to each other (e.g. are spaced along the length of the waveguide, such that the spacing between the positions at which at least two of the sensors are acoustically coupled to the waveguide differ from an integer multiple of wavelengths of the signals being received or from an integer multiple of half of the wavelength of the signals being received), the sensors provide spatial signal diversity by detecting the signals at different positions along a standing wave formed on the communication channel. This increases the probability of at least one sensor detecting the signal near or at a position of peak signal strength. The wavelength of the signals being received may be predetermined.

In each case, the length(s) of waveguide 701, 801, 901 between the respective positions thereof at which the at least first and second (e.g. first, second and third) sensors $\mathbf{101}_{1,2,3,4}$ are acoustically coupled thereto (e.g. between the respective positions at which sensors of one or more pairs of sensors $\mathbf{101}_{1,2,3,4}$, such as one or more pairs of adjacent sensors $\mathbf{101}_{1,2,3,4}$, are acoustically coupled thereto) follow path(s) which change direction to thereby limit an extent of the waveguide in at least one spatial dimension, such as a spatial dimension substantially parallel to the longitudinal axis 505 of the acoustic conductor 503 or substantially parallel to a longitudinal axis of the acoustic communication channel (e.g. a vertical spatial dimension), for example to limit an extent of the waveguide in that dimension compared to a straight waveguide extending in a direction parallel to the longitudinal axis of the acoustic conductor 503 or communication channel. Additionally or alternatively, the length(s) of waveguide between the respective positions thereof at which at least first and second (e.g. first, second and third) sensors $\mathbf{101}_{1,2,3,4}$ are acoustically coupled thereto (e.g. between the respective positions at which sensors of one or more pairs of sensors $\mathbf{101}_{1,2,3,4}$, such as one or more pairs of adjacent sensors $\mathbf{101}_{1,2,3,4}$, are acoustically coupled thereto) follow path(s) which change direction to thereby limit an extent of the waveguide in a spatial dimension substantially perpendicular to the longitudinal axis 505 of the acoustic conductor 503 or substantially perpendicular to the longitudinal axis of the acoustic communication channel (e.g. a horizontal spatial dimension), for example to limit an extent of the waveguide in that dimension compared to a straight waveguide extending in a direction perpendicular to the longitudinal axis of the acoustic conductor 503 or communication channel. Additionally or alternatively, the length(s) of waveguide between the respective positions thereof at which at least first and second (e.g. first, second and third) sensors $\mathbf{101}_{1,2,3,4}$ are acoustically coupled thereto (e.g. between the respective positions at which sensors of one or more pairs of sensors $\mathbf{101}_{1,2,3,4}$, such as one or more pairs of adjacent sensors $\mathbf{101}_{1,2,3,4}$, are acoustically coupled thereto) follow path(s) which change direction to thereby limit an extent of the waveguide in a horizontal or vertical spatial dimension for example to limit the extent of the waveguide in that dimension compared to straight horizontal or vertical waveguides.

In the examples of each of FIGS. 10-12, the change in direction of the path followed by the waveguide comprises a component which conforms to a curvature of a cross-section of the acoustic conductor 503 (so that the waveguide fits around the acoustic conductor 503 when coupled or mounted thereto), the cross-section of the acoustic conductor taken perpendicular to a longitudinal axis of the acoustic conductor 503 or the longitudinal axis of the acoustic communication channel. The change in direction of the path followed by the waveguide comprises at least one component in each of three spatial dimensions (e.g. x, y, z dimensions).

In the examples of each of FIGS. 10-12, the receiver may be mounted to the acoustic conductor 503 between the acoustic conductor 503 and an outer jacket 570, for example as discussed with respect to FIGS. 8, 9.

In the examples of each of FIGS. 10-11, a second (surface) receiver (including a second waveguide and a second set of sensors) may be mounted to the acoustic conductor 503, for example, on the opposite side of the acoustic conductor 503 to the receiver (e.g. between the respective outer jacket 570 shown on the right hand side of the conductor 503 and the acoustic conductor 503).

It will also be understood that the receivers of FIGS. 10-12 may be housed between the acoustic conductor 503 and respective outer jackets 570, which may each conform to the outer curvature of the acoustic conductor 503 to thereby fit around the acoustic conductor 503 when coupled thereto.

In the example illustrated in FIG. 10, the assembly comprises an acoustic receiver comprising a waveguide 701 having a plurality of substantially parallel straight portions, wherein adjacent substantially parallel portions are joined together by a portion of the waveguide 701 which follows a path which changes direction. Respective acoustic sensors $\mathbf{102}_{1,2,3,4}$ are acoustically coupled to the waveguide 701 at respective positions spaced along the length of the waveguide 701. Portions of the waveguide 701 extending between respective positions at which respective pairs of adjacent sensors $\mathbf{102}_{1,2,3,4}$ are acoustically coupled to the waveguide 701 (e.g. the positions at which the first and second sensors are acoustically coupled to the waveguide) follow paths which change direction to limit the extent of the waveguide in at least one spatial dimension.

The waveguide 701 is acoustically coupled (e.g. mounted) to the acoustic conductor 503 by way of coupler 504. In alternative examples, the waveguide 701 may be directly acoustically coupled (e.g. mounted) to the acoustic conductor 503.

The change in direction of the path followed by the waveguide 701 comprises a component which conforms to an outer curvature of a cross-section of the acoustic conductor 503 to thereby fit around the acoustic conductor 503 when coupled thereto, the cross-section of the acoustic conductor taken perpendicular to a longitudinal axis of the acoustic conductor 503 or the longitudinal axis of the acoustic communication channel, and a component in a direction substantially parallel to the longitudinal axis of the acoustic conductor 503 or the communication channel. The change in direction of the path followed by the waveguide 701 comprises at least one component in each of three spatial dimensions (e.g. x, y, z dimensions).

In the illustrated example, the waveguide 701 comprises a plurality (seven in the example shown in FIG. 10, although more than seven or fewer than seven may be provided) of substantially parallel straight portions 733 and respective U-shaped portions 734 extending between adjacent substantially parallel straight portions 733. The substantially parallel portions 733 extend in a direction substantially perpendicular to the longitudinal axis 505 of the acoustic conductor 503 or a longitudinal axis of the communication channel. The U-shaped portions 734 form a plurality of loops or turns in the waveguide 701. It may be that the length of waveguide 701 between respective positions at which adjacent sensors are acoustically coupled thereto (e.g. the positions at which the first and second sensors are acoustically coupled to the waveguide) comprises at least one loop or turn. It may be that the length of waveguide 701 between respective positions at which adjacent sensors are acoustically coupled thereto (e.g. the positions at which the first and second sensors are acoustically coupled to the waveguide) comprises at least respective parts of two substantially parallel portions 733. The U-shaped portions 734 are oriented substantially perpendicular to the longitudinal axis 505 of the acoustic conductor 503 or the longitudinal axis of acoustic communication channel. The U-shaped portions 734 and substantially parallel straight portions 733 of the example of FIG. 10 are also oriented substantially perpendicular to a straight portion of the waveguide 701 comprising a first end 732 of the waveguide 701 which is fixedly coupled to the acoustic conductor 503 by way of the coupler 504 by way of being fixedly held in (e.g., fixedly restrained or clamped with respect to) the recess 535 thereof. Similarly to the waveguide 701 shown in FIGS. 8, 9, the first end 732 of the waveguide 701 is provided on a straight portion of the waveguide 701 extending substantially parallel to the longitudinal axis of the conductor 503 or the communication channel, the first end 732 being fixedly held in (e.g., fixedly restrained or clamped with respect to) the recess 535 of the coupler 504 to thereby fixedly couple the acoustic waveguide 701 to the acoustic conductor 503. However any other suitable coupling between the waveguide 701 and the coupler 504 (or indeed between the waveguide and the acoustic conductor 503) may be provided. Accordingly, in some examples, the waveguide 701 may omit a straight first end 732 which extends substantially parallel to the longitudinal axis of the conductor 504 or communication channel.

It may be that the path followed by the waveguide 701 extending between respective positions at which adjacent sensors are acoustically coupled thereto (e.g. the positions at which the first and second sensors are acoustically coupled to the waveguide) comprises one or more loops or turns. It may be that the length of waveguide 701 between respective positions at which adjacent sensors are acoustically coupled thereto (e.g. the positions at which the first and second sensors are acoustically coupled to the waveguide) comprises at least respective parts of two or more adjacent substantially parallel portions 733 (e.g. adjacent substantially parallel portions joined by a respective loop or turn). In the example shown in FIG. 10, the path followed by the waveguide 701 extending between respective positions at which adjacent sensors are acoustically coupled thereto comprises two loops or turns in each case.

Similarly to the example of FIGS. 8, 9, the arrangement of FIG. 10 may have a holder 730 configured to hold (e.g. retain) the second end 731 of the waveguide 701 to thereby inhibit displacement of the second end 731 of the waveguide with respect to the acoustic conductor 503 while allowing the second end 731 of the waveguide to vibrate (e.g. substantially freely) in response to acoustic signals propagating on the waveguide 701. The holder 730 may be offset from the coupler 504 along the longitudinal axis of the acoustic conductor 503 or along the longitudinal axis of the acoustic communication channel (e.g. in the example shown in FIG. 10, the holder 730 is provided vertically above the coupler 504). In the example illustrated in FIG. 10, the holder 730 is provided in the form of a semi-annular member mounted around and having a semi-annular inner surface conforming to the outer curvature of the acoustic conductor 503 to thereby fit around the acoustic conductor 503 when coupled thereto, the holder comprising a recess 736 which receives and partially houses the second end 731 of the waveguide 701 therein. In this example, the recess 736 is formed on an outer surface of the holder opposite the semi-annular inner surface mounted to the acoustic conductor 503.

The semi-annular holder 730 may be removably connectable to the acoustic conductor 503 by attachment (e.g. by way of fasteners) to a further semi-annular member (to thereby form an annular holder 730) which has a semi-annular inner surface which conforms to the outer curvature of the acoustic conductor 503 to thereby fit around the acoustic conductor 503 when coupled thereto and is mounted to the opposite side of the acoustic conductor 503. The further semi-annular member may comprise a semi-annular holder similar or identical to the semi-annular holder 730 and may be configured to hold a second end of a waveguide of a second receiver with respect to the acoustic conductor 503 (such as a second receiver having any of the features of the receiver coupled to the acoustic conductor 503 by coupler 730).

Although the holder 730 is described as semi-annular above, and that it is removably connectable to the acoustic conductor 503 by attachment (e.g. by way of fasteners) to a further semi-annular member, it will be understood that the holder 730 may instead be an annular holder 730 whereby the further semi-annular member to which it is attached to hold the second end 732 of the waveguide with respect to the acoustic conductor 503 forms part of the holder 730. In this case, the further semi-annular member may or may not hold a second end of a second receiver with respect to the conductor 503.

In the example of FIG. 10, the recess 736 is formed between upper and lower surfaces 737, 738 of the holder 730, and the upper and lower surfaces of the recess 736 help to hold the second end 731 of the waveguide 701 relative to the acoustic conductor 503 in a vertical dimension. A retaining fastener 739 (which may extend between the upper and lower surfaces 737, 738) may additionally be provided to help retain the second end 731 of the waveguide 701 relative to the acoustic conductor 503 in a radial direction thereof. The upper and lower surfaces 737, 738 of the holder 730 may be perpendicular to a direction substantially parallel to the longitudinal axis of the acoustic conductor 503 or the communication channel.

When the second end 731 of the waveguide 701 is provided in the recess 736, the upper and lower surfaces of the recess 736 and the fastener 739 of the holder 730 inhibit displacement of the waveguide 701 with respect to the acoustic conductor 703. However, it may be that the holder 730 does not fixedly restrain the second end 731 of the waveguide 701 (e.g. it may be that the holder 730 does not restrain the second end 731 of the waveguide 701 so that it cannot move or vibrate), to thereby allow it to vibrate (e.g. within the recess 736) in response to acoustic signals propagating on the waveguide 701. It may be that there is little or no contact between the holder 730 and the second end 731 of the waveguide 701 in normal use. It may be that the holder 730 is acoustically insulating to inhibit transmission of acoustic signals through the holder 530 between the second end 731 of the waveguide 701 and the acoustic conductor 503. The holder 730 may at least one of: formed of an acoustically insulating material, structured to be acoustically insulating, or be acoustically isolated (such as by the addition of a dampener) from the acoustic conductor 503 (for example).

By allowing the second end 731 of the waveguide to vibrate (e.g. substantially freely) in response to acoustic signals propagating on the waveguide 701, and by the holder being acoustically insulating, the coupling of acoustic signals from the acoustic conductor 503 into the waveguide 701 through the holder 730 and the second end 731 of the waveguide 701 is inhibited, thereby reducing interference and noise in the sensor data generated by the sensors $\mathbf{101}_{1,2,3,4}$ in response to signals detected from the acoustic conductor 503. However, the holder 730 helps to retain the receiver (i.e. inhibit displacement of the receiver) with respect to the acoustic conductor 503.

In some examples, the holder 730 may be omitted.

In the alternative example of FIG. 11*a*, the acoustic receiver comprises a waveguide 801 which is provided with a spiral shape. In this case, the sensors $\mathbf{102}_{1,2,3,4}$ are acoustically coupled to the waveguide 801 on respective turns of the spiral shape thereof. Similarly to the example of FIGS. 8, 9, 10 the waveguide 801 is further curved to conform to the curvature of the cross-section of the acoustic conductor 503 taken perpendicular to its longitudinal axis and perpendicular to the longitudinal axis of the communication channel to thereby fit around the acoustic conductor 503 when coupled thereto. The waveguide 801 is acoustically coupled (e.g. mounted) to the acoustic conductor 503 by way of coupler 504 (e.g. as discussed above, first end 831 may be fixedly held in recess 535 of coupler 504). In alternative examples, the waveguide 801 may be directly acoustically coupled (e.g. mounted) to the acoustic conductor 503.

No holder 530, 730 is provided in the example of FIG. 11*a*. In alternative examples, such as in the example of FIG. 11*b*, a holder 830 may be provided. In the example shown in FIG. 11*b*, the holder 830 is configured to hold (e.g. retain) the second end 831 of the waveguide 701 to thereby inhibit displacement of the second end 831 of the waveguide with respect to the acoustic conductor 503 while allowing the second end 831 of the waveguide to vibrate (e.g. substantially freely) in response to acoustic signals propagating on the waveguide 801. The holder 830 may be offset from the coupler 504 along the longitudinal axis of the acoustic conductor 503 or along the longitudinal axis of the acoustic communication channel (e.g. in the example shown in FIG. 11*b*, the holder 830 is provided vertically above the coupler 504). In the example illustrated in FIG. 11*b*, the holder 830 is provided in the form of a semi-annular member mounted around and having a semi-annular inner surface conforming to the outer curvature of the acoustic conductor 503 to thereby fit around the acoustic conductor 503 when coupled thereto, the holder 830 comprising a flange 808 protruding outwards from an outer surface thereof opposite the semi-annular inner surface mounted to the acoustic conductor 503 and having a hole therein which receives and partially houses the second end 831 of the waveguide 801 therein. This is also shown in the close-up view of FIG. 11*c*.

The semi-annular holder 830 may be removably connectable to the acoustic conductor 503 by attachment (e.g. by way of fasteners) to a further semi-annular member (to thereby form an annular holder 830) which has a semi-annular inner surface which conforms to the outer curvature of the acoustic conductor 503 to thereby fit around the acoustic conductor 503 when coupled thereto and is mounted to the opposite side of the acoustic conductor 503. The further semi-annular member may comprise a semi-annular holder similar or identical to the semi-annular holder 830 and may be configured to hold a second end of a waveguide of a second receiver with respect to the acoustic conductor 503 (such as a second receiver having any of the features of the receiver coupled to the acoustic conductor 503 by coupler 830).

Although the holder 830 is described as semi-annular above, and that it is removably connectable to the acoustic conductor 503 by attachment (e.g. by way of fasteners) to a further semi-annular member, it will be understood that the holder 830 may instead be an annular holder 830 whereby the further semi-annular member to which it is attached to hold the second end 832 of the waveguide 801 with respect to the acoustic conductor 503 forms part of the holder 830. In this case, the further semi-annular member may or may not hold a second end of a second receiver with respect to the conductor 503.

When the second end 831 of the waveguide 801 is retained in the hole in the flange 808, the inner surfaces of the hole inhibit displacement of the waveguide 801 with respect to the acoustic conductor 503, for example radially, circumferentially and vertically with respect to the conductor 503. However, it may be that the holder 830 does not fixedly restrain the second end 831 of the waveguide 801 (e.g. it may be that the holder 830 does not restrain the second end 831 of the waveguide 801 so that it cannot move or vibrate), to thereby allow it to vibrate (e.g. within the hole) in response to acoustic signals propagating on the waveguide 801. It may be that there is little or no contact between the holder 830 and the second end 831 of the waveguide 801 in normal use. It may be that the holder 830 is acoustically insulating to inhibit transmission of acoustic signals through the holder 830 between the second end 831 of the waveguide 801 and the acoustic conductor 503. The holder 830 may at least one of: formed of an acoustically insulating material, structured to be acoustically insulating, or be acoustically isolated (such as by the addition of a dampener) from the acoustic conductor 503 (for example).

The waveguide 801 has a straight first end 832 extending substantially parallel to the longitudinal axis of the conductor 504 or communication channel which is acoustically coupled to the acoustic conductor 503 by way of the coupler 504 by way of being fixedly held in the recess 535 thereof. However any other suitable coupling between the waveguide 801 and the coupler 504 (or indeed between the waveguide and the acoustic conductor 503) may be provided. Accordingly, in some examples, the waveguide 801 may omit a straight first end which extends substantially parallel to the longitudinal axis of the conductor 504 or communication channel.

Although a particular spiral shape is illustrated in FIGS. 11*a*, 11*b*, 11*c* it will be understood that the spiral shape may be a right-handed or left-handed spiral (e.g. a clockwise or anti-clockwise spiral). It may be, for example, that the path spirals inwardly or outwardly.

Thus, it may be that the path followed by at least the length of the waveguide (e.g. 801) separating at least two of the plurality of sensors (e.g. $\mathbf{102}_1$ and $\mathbf{102}_2$ or $\mathbf{102}_{n-1}$ and $\mathbf{102}_n$) is spiralled.

In an alternative example shown in FIG. 12, a waveguide 901 of an acoustic receiver is provided with a helical shape. In the example of FIG. 12, the waveguide 901 is helically wound around the acoustic conductor 503. The waveguide 901 thus has a shape which conforms to the curvature of the cross-section of the acoustic conductor 503 taken perpendicular to its longitudinal axis and perpendicular to the longitudinal axis of the communication channel to thereby fit around the acoustic conductor 503 when coupled thereto. However, in the example of FIG. 12, the waveguide 901 is not in direct contact with the acoustic conductor 503. The waveguide 901 is acoustically coupled (e.g. mounted) to the acoustic conductor 503 by way of coupler 504. In alternative examples, the waveguide 901 may be directly acoustically coupled (e.g. mounted) to the acoustic conductor 503.

The waveguide 901 has a straight first end 932 which is acoustically coupled to the acoustic conductor 503 by way of the coupler 504 by way of being fixedly held in the recess 535 thereof. In the example of FIG. 12, the straight first end 932 is substantially parallel to the longitudinal axis of the acoustic conductor 503 or communication channel. The sensors $\mathbf{102}_{1,2,3,4}$ are acoustically coupled to the waveguide 901 on respective turns of the helix.

It will be understood that any suitable coupling may be provided between the waveguide 901 and the coupler 504 (or indeed between the waveguide and the acoustic conductor 503). Accordingly, in some examples, the waveguide 901 may omit a straight first end 932 which extends substantially parallel to the longitudinal axis of the conductor 504 or communication channel.

Although a particular helical shape is illustrated in FIG. 12, it will be understood that the spiral shape may be a right-handed or left-handed helix (e.g. a clockwise or anti-clockwise helix).

It may be that the path followed by at least the length of the waveguide (e.g. 801) separating at least two of the plurality of sensors (e.g. $\mathbf{102}_1$ and $\mathbf{102}_2$ or $\mathbf{102}_{n-1}$ and $\mathbf{102}_n$) is helical.

The assembly of FIG. 12 may also comprise a holder 930 configured to hold (e.g. retain) a second end 931 of the waveguide 901 to thereby inhibit displacement of the second end 931 of the waveguide with respect to the acoustic conductor 503 while allowing the second end 931 of the waveguide to vibrate (e.g. substantially freely) in response to acoustic signals propagating on the waveguide 501. The holder 930 may be offset from the coupler 504 along the longitudinal axis of the acoustic conductor 503 or along the longitudinal axis of the acoustic communication channel. For example, the holder 930 is shown in the example of FIG. 12 as being provided vertically above the coupler 504.

In the example illustrated in FIG. 12, the holder 930 is provided in the form of a semi-annular member mounted around and having a semi-annular inner surface conforming to the outer curvature of the acoustic conductor 503 to thereby fit around the acoustic conductor 503 when coupled thereto, the holder comprising a shoulder 908 comprising a recess 936 which receives and partially houses the second end 931 of the waveguide 901 therein. In the example of FIG. 12, the shoulder 908 comprising the recess 936 is formed on an outer surface of the holder 930 opposite the semi-annular inner surface mounted to the acoustic conductor 503.

In the example of FIG. 12, the holder 930 is removably connectable to the acoustic conductor 503 by attachment (e.g. by way of fasteners) to a further semi-annular member (to thereby form an annular holder 930) which has a semi-annular inner surface which conforms to the outer curvature of the acoustic conductor 503 to thereby fit around the acoustic conductor 503 when coupled thereto and is mounted to the opposite side of the acoustic conductor 503.

The further semi-annular member may comprise a semi-annular holder similar or identical to the semi-annular holder 930.

Although the holder 930 is described as semi-annular above, and that it is removably connectable to the acoustic conductor 503 by attachment (e.g. by way of fasteners) to a further semi-annular member, it will be understood that the holder 930 may instead be an annular holder 930 whereby the further semi-annular member to which it is attached to mount the holder 930 to the acoustic conductor 503 forms part of the holder 930.

When the second end 931 of the waveguide 901 is provided in the recess 936, the inner surfaces of the recess 936 inhibit displacement of the waveguide 901 with respect to the acoustic conductor 503, for example radially and circumferentially with respect to the conductor 503. However, it may be that the holder 930 does not fixedly restrain the second end 931 of the waveguide 901 (e.g. it may be that the holder 930 does not restrain the second end 931 of the waveguide 901 so that it cannot move or vibrate), to thereby allow it to vibrate (e.g. within the recess 936) in response to acoustic signals propagating on the waveguide 901. It may be that there is little or no contact between the holder 930 and the second end 931 of the waveguide 901 in normal use. It may be that the holder 930 is acoustically insulating to inhibit transmission of acoustic signals through the holder 930 between the second end 931 of the waveguide 901 and the acoustic conductor 503. The holder 930 may at least one of: formed of an acoustically insulating material, structured to be acoustically insulating, or be acoustically isolated (such as by the addition of a dampener) from the acoustic conductor 503 (for example).

In some examples, holder 930 may be omitted.

With reference to FIGS. 8-12, it may be that the assembly comprises an acoustic transmitter 550. Thus, it may be that the assembly is to receive and transmit acoustic signals by way of the communication channel. In alternative examples, the transmitter 550 may be omitted from the assembly. Where provided, the acoustic transmitter 550 may be to transmit acoustic signals downhole by way of the communication channel. The acoustic transmitter 550 may comprise a transducer, such as a piezo-electric transducer, for converting electrical signals to acoustic signals. It may be that the acoustic transmitter 550 is discrete from the acoustic receiver in the sense that the sensors $\mathbf{102}_{1,2,3,4}$ of the acoustic receiver are discrete from the transducer of the acoustic transmitter 550 (e.g. as opposed to the transmitter and receiver sharing transducers). The acoustic transmitter 550 may be acoustically coupled to the acoustic conductor 503 by way of the coupler 504, such as by being fixedly held (e.g. by way of an interference fit or one or more fasteners) in a recess of the coupler 504. For example, it may be that the waveguide 501, 701, 801, 901 is coupled to the acoustic conductor 503 having a first end 532, 732, 832, 932 being fixedly held in a first recess 535 provided on a first (e.g. upper) surface of the coupler while the transmitter 550 is coupled to the acoustic conductor 503 by being fixedly held in a second recess 551 provided on a second (e.g. lower) surface of the coupler 504. It may be that the first and second surfaces are opposing surfaces of the coupler 504 perpendicular to a direction substantially parallel to the longitudinal axis of the conductor 503 or the communication channel. Acoustic signals generated by the transmitter 550 propagate from the transmitter 550 to the acoustic communication channel by way of the coupler 504, the coupler 504 being in close physical contact with the acoustic conductor 503 and being acoustically conductive to thereby allow acoustic signals to propagate from the transmitter 550 to the acoustic communication channel therethrough.

By acoustically coupling both the acoustic transmitter 550 and the waveguide 501, 701, 801, 901 to the acoustic conductor 503 by way of the coupler 504, a space efficient arrangement can be provided. This may be particularly advantageous for an assembly deployed for downhole communications where space is limited. To inhibit interference between transmitted and received signals by use of the same coupler to couple the transmitter and receiver to the acoustic conductor, it may be that in this case the transmitter 550 and corresponding receiver are used to communicate at different times (e.g. half duplex communication).

As discussed above, it may be that the acoustic receiver is a first acoustic receiver and that a second acoustic receiver may be acoustically coupled to the acoustic conductor 503, such as circumferentially offset around the acoustic conductor 503 (e.g. at substantially the same axial position thereof), such as the opposite side of the acoustic conductor 503 from the first receiver, by way of a second coupler (which may have any of the features of the coupler 504 described herein). The first and second couplers may be semi-annular couplers (e.g. similar or identical to coupler 504 described herein) and configured to be mounted together around the outer curvature of the acoustic conductor 503 to form an annulus through which the acoustic conductor 503 extends. It may be that the first and second couplers are positionable (e.g. couplable to the acoustic conductor 503 or acoustic communication channel) at substantially the same longitudinal position of the acoustic communication channel. A second acoustic transmitter 550 may be provided which may be acoustically coupled to the acoustic conductor 503 by way of the second coupler (e.g. by being fixedly held in a recess of the second coupler as discussed herein with respect to the transmitter 550 and the coupler 504).

Processing circuitry may be provided for processing signals from the acoustic receiver based on acoustic signals received by the acoustic receiver from the acoustic communication channel. The processing circuitry may be provided in wired or wireless communication with the sensors $\mathbf{102}_{1,2\ldots n}$. For example, the processing circuitry may be to process sensor data generated by the sensors $\mathbf{102}_{1,2\ldots n}$ coupled to the waveguide 101, 501, 701, 801, 901 in response to acoustic signals propagating on the acoustic communication channel. The processing circuitry may be to obtain (e.g. receive) sensor data from the sensors $\mathbf{102}_{1,2\ldots n}$ of the acoustic receiver, or data derived therefrom, and to select sensor data from one of the sensors, or data derived therefrom, based on at least one signal selection criterion. The processing circuitry may be to select sensor data from one of the sensors, or data derived therefrom, based on a comparison of the sensor data, or data derived therefrom, and at least one signal selection criterion. The at least one signal selection criterion may relate to a signal quality of the sensor data from the respective sensors $\mathbf{102}_{1,2\ldots n}$, or a quality of data derived from the sensor data from the respective sensors $\mathbf{102}_{1,2\ldots n}$. For example, the processing circuitry may be to select sensor data from one of the sensors $\mathbf{102}_{1,2\ldots n}$ of the acoustic receiver, or data derived therefrom, based on which of the sensors $\mathbf{102}_{1,2\ldots n}$ of the acoustic receiver received signals from the acoustic communication channel having the highest received signal strength or signal to noise ratio or signal to interference and noise ratio.

As explained above, the sensors $\mathbf{102}_{1,\ldots,n}$ provide spatial signal diversity by detecting the signals at different positions along the standing wave, thereby increasing the probability of at least one sensor detecting the signal near or at a position of peak signal strength. By selecting the sensor data from the one of the sensors providing sensor data of the highest quality (e.g. highest signal strength, signal to noise ratio or signal to noise and interference ratio) of the sensor data provided by the plurality of sensors, or data derived therefrom, the probability of generating received signal data of sufficiently high quality by way of the sensors based on the signals propagating on the communication channel are significantly improved. In addition, even if the position of the peak signal strength changes over time, for example due to changes in the transfer function of the communication channel (e.g. due to changing operating conditions of the drilling rig in a downhole application), a high quality signal may still be detected, for example by selecting sensor data from different ones of the plurality of sensors $\mathbf{102}_{1,\ldots,n}$, or data derived from sensor data from different ones of the plurality of sensors $\mathbf{102}_{1,\ldots,n}$, at different times (based on their respective qualities). This helps to improve the quality of signals which may be detected by the receiver, which helps to increase the usable bandwidth of the communication channel.

It will be understood that the processing circuitry may be to perform further processing on the selected data (e.g. calibration, decoding, processing of payload data of the signal data etc.).

In examples in which the assembly comprises an acoustic transmitter 550, it may be that the processing circuitry is to cause the acoustic transmitter 550 to transmit signals by way of the communication channel. For example, it may be that the acoustic transmitter 550 is to convert electrical signals provided by the processing circuitry to acoustic signals for transmission on the acoustic communication channel.

It may be that the processing circuitry is mounted to the acoustic conductor(s) of the communication channel together with the acoustic receiver (and transmitter 550 where provided); mounted to one or more different acoustic conductors of the communication channel from which the acoustic receiver (and transmitter, where provided) is mounted; provided remotely from the acoustic conductor(s) of the communication channel, such as at one or more remote computing devices 579, such as at one or more remote surface computing devices 579; or distributed between processing circuitry mounted to one or more acoustic conductors of the communication channel, such as the acoustic conductor(s) to which the acoustic receiver (and transmitter, where provided) are mounted, and processing circuitry provided remotely from the acoustic conductor(s) of the communication channel, such as at one or more remote computing devices 579 such as one or more surface computing devices.

In examples in which at least some of the processing circuitry is provided remotely from the acoustic conductor(s) of the communication channel, such as at one or more remote computing devices 579, it may be that the assembly comprises transmission circuitry 560 for transmitting signals (e.g. wirelessly) based on signals received by the acoustic receiver to one or more remote computing device 579. It may be that the transmission circuitry 560 is in (e.g. wired or wireless) communication with the sensors $\mathbf{102}_{1,2\ldots n}$ to thereby receive signals based on signals received by the acoustic receiver (e.g. sensor data generated by the sensors) from the communication channel. It may be that the circuitry 560 is mounted to the acoustic conductor 503 by way of a coupler 580. In the illustrated examples of FIGS. 8-12, the coupler 580 comprises a semi-annular coupler 580 which conforms to the outer curvature of the acoustic conductor 503 (i.e., the curvature of the cross section of the conductor 503 taken perpendicular to its longitudinal axis 505) to thereby fit around the acoustic conductor 503 when coupled thereto. The coupler 580 has a semi-annular inner surface which is mounted to the acoustic conductor 503 and an outer surface opposite the inner surface, the circuitry 560 being mounted to the outer surface. The coupler 580 may be acoustically insulating in order to insulate the circuitry 560 from the acoustic waves propagating on the acoustic conductor 503. When the assembly is assembled (e.g. see FIGS. 9-11) the circuitry 560 may be housed between the outer jacket 570 and the acoustic conductor 503.

It may be that the coupler 580 is removably connectable to the acoustic conductor 503 by attachment (e.g. by way of fasteners) to a further semi-annular member (to thereby form an annular coupler 580) which has a semi-annular inner surface which conforms to the outer curvature of the acoustic conductor 503 to thereby fit around the acoustic conductor 503 when coupled thereto and is mounted to the opposite side of the acoustic conductor 503. The further semi-annular member may comprise a semi-annular coupler similar or identical to the semi-annular coupler 580 and may be configured to mount transmission or processing circuitry of a second receiver to the acoustic conductor 503 (such as a second receiver having any of the features of any of the receivers described herein).

Although the coupler 580 is described as semi-annular above, and that it is removably connectable to the acoustic conductor 503 by attachment (e.g. by way of fasteners) to a further semi-annular member, it will be understood that the coupler 580 may instead be an annular coupler 580 whereby the further semi-annular member to which it is attached to mount the coupler 580 to the acoustic conductor 503 forms part of the coupler 580. In this case, the further semi-annular member may or may not couple transmission circuitry of a second receiver to the conductor 503.

In examples in which at least some of the processing circuitry is mounted to an acoustic conductor of the communication channel such as the acoustic conductor 503, it may be that the processing circuitry mounted to the acoustic conductor comprises processing circuitry 561 for processing communication signals (e.g. demodulating modulated communication signals) received by the acoustic receiver (e.g. before they are transmitted to the one or more remote computing devices). It may be that the processing circuitry 561 is to cause transmission of the processed (e.g. demodulated) sensor data to the one or more remote computing device (e.g., by way of transmission circuitry 560). For example, it may be that the processing circuitry mounted to the acoustic conductor comprises processing circuitry for demodulating modulated communication signals received by the acoustic receiver and for providing the demodulated communication signals to the circuitry 560 for transmission to one or more remote computing devices. By demodulating modulated communication signals received by the acoustic receiver before they are provided to the transmission circuitry 560, the transmission circuitry 560 can more easily transmit the information to the remote computing device(s). Similarly, it may be that the processing circuitry 561 mounted to the acoustic conductor comprises processing circuitry 561 for modulating signals for transmission on the acoustic communication channel by the acoustic transmitter 550.

It may be that the processing circuitry 561 is mounted to the acoustic conductor 503 by way of coupler 580 (e.g. in addition to or as an alternative to the circuitry 560). As discussed above, in the illustrated examples of FIGS. 8-12, the coupler 580 comprises a semi-annular coupler 580 which conforms to the outer curvature of the acoustic conductor 503 (i.e., the curvature of the cross section of the conductor 503 taken perpendicular to its longitudinal axis 505) to thereby fit around the acoustic conductor 503 when coupled thereto. The coupler 580 has a semi-annular inner surface which is mounted to the acoustic conductor 503 and an outer surface opposite the inner surface, the processing circuitry being mounted to the outer surface. The coupler 580 may be acoustically insulating in order to insulate the processing circuitry from the acoustic waves propagating on the acoustic conductor 503. When the assembly is assembled (e.g. see FIGS. 9-11) the processing circuitry may be housed between the outer jacket 570 and the acoustic conductor 503.

As discussed above, it may be that a plurality of acoustic receivers are provided. For example, the receiver of the assembly of any of FIGS. 8-12 may be a first receiver and the assembly may comprise a second receiver. In the example of FIGS. 8-12, first and second receivers are provided at substantially the same axial position along the length of the acoustic communication channel (e.g. circumferentially offset from each other with respect to the acoustic conductor). By providing a plurality of receivers, improved spatial signal diversity may be obtained from the sensors of the plurality of receivers combined than from the sensors of a single receiver. The sensors of the first and second receivers may be arranged to provide improved spatial signal diversity from the sensors of the plurality of receivers combined than from the sensors of a single one of the receivers. By selecting sensor data from one of the sensors from the plurality of receivers, or data derived therefrom, for example based on signal quality, improved received signal quality can be provided more consistently than from the sensors of a single receiver.

The second receiver may comprise any of the features of the acoustic receivers discussed herein. For example, similarly to the first receiver, the second receiver may comprise a waveguide and a plurality of sensors $\mathbf{102}_{1,\ldots,n}$ acoustically coupled to the waveguide to sense acoustic signals received from the communication channel. The sensors $\mathbf{102}_{1,\ldots,n}$ of the second receiver may be acoustically coupled to the waveguide at respective positions spaced along the length of the waveguide (e.g., to provide spatial signal diversity as discussed above). As above, the sensors $\mathbf{102}_{1,\ldots,n}$ may comprise any sensors suitable for sensing acoustic signals from the communication channel, either directly or indirectly. For example, the sensors $\mathbf{102}_{1,\ldots,n}$ of the second receiver may comprise accelerometers (e.g. accelerometers having an axis of acceleration to be sensed by the accelerometer aligned with the longitudinal axis of the communication channel), strain gauges, piezo-electric transducers, or fibre-optic acoustic sensors. The sensors $\mathbf{102}_{1,\ldots,n}$ of the second receiver may be of the same acoustic sensor type.

It may be that length(s) of waveguide of the second receiver between respective positions thereof at which at least first and second (e.g. the respective pairs of adjacent) sensors $\mathbf{101}_{1,2\ldots n}$ are acoustically coupled thereto follow path(s) which change direction to thereby limit an extent of the waveguide, for example in at least one spatial dimension, such as in a spatial dimension parallel to the longitudinal axis 505 of the acoustic conductor 503 or parallel to a longitudinal axis of the acoustic communication channel (e.g. a vertical spatial dimension), for example to reduce the extent of the waveguide in that dimension compared to a straight waveguide extending parallel to the longitudinal axis of the acoustic conductor 503 or communication channel.

It may be that the spacing between the positions at which at least first and second sensors are acoustically coupled to the waveguide of the second receiver (e.g. the spacing between positions at which the sensors of each of one or more pairs or each pair of sensors, such as the sensors of each of one or more pairs or each pair of adjacent sensors, are acoustically coupled to the waveguide) is such that the signals detected by the sensors are phase shifted with respect to each other (e.g. the spacing between the sensors differs from (i.e., is not equal to) an integer multiple of the wavelength of the signals being received or from an integer multiple of half of the wavelength of the signals being received). By providing a plurality of sensors coupled to the waveguide at positions such that at least two of the sensors are to detect signals which are phase shifted with respect to each other (e.g. the sensors are coupled to the waveguide at positions which are spaced along the length of the waveguide, such that the spacing between the positions at which at least two of the sensors are acoustically coupled to the waveguide differs from an integer multiple of wavelengths of the signals being received or from an integer multiple of half of the wavelength of the signals being received), the sensors provide spatial signal diversity by detecting the signals at different positions along a standing wave formed on the communication channel. As discussed, the wavelength of the signals being received may be predetermined.

The acoustic sensors $\mathbf{102}_{1,\ldots,n}$ of the first and second receivers may be acoustically coupled to the acoustic conductor 503 by way of the same or similar couplers, such as the coupler 504 described herein, and by way of identical or similar waveguides, such as waveguides 501, 701, 801, 901. The sensors $\mathbf{102}_{1,\ldots,n}$ may be acoustically coupled to the waveguides of the first and second receivers at different positions along the lengths of the waveguides thereof (e.g., positions having different longitudinal distances along the respective waveguides from the end of the waveguide acoustically coupled to the communication channel). For example, the sensors $\mathbf{102}_{1,\ldots,n}$ of the first receiver may be acoustically coupled to the waveguide thereof at first positions along its length and the sensors $\mathbf{102}_{1,\ldots,n}$ of the second receiver may be acoustically coupled to the waveguide thereof at second positions along its length. It may be that corresponding first and second positions are offset from each other along the lengths of the respective waveguides. That is, it may be that the first positions are offset from positions along the length of the waveguide of the first receiver corresponding to the second positions, and it may be that the second positions are offset from positions along the length of the waveguide of the second receiver corresponding to the first positions. For example, the corresponding first and second positions may be interdigitated (i.e., the second positions may be provided between positions along the waveguide of the second receiver corresponding to the first positions and vice versa). By the corresponding first and second positions being offset from each other, it may be that better spatial signal diversity can be achieved.

It may be that the same processing circuitry is provided to process signals received by the sensors of the plurality of acoustic receivers of the assembly. Alternatively, processing circuitry may be provided to process signals from each of the acoustic receivers which is discrete from the processing circuitry provided to process signals from the other receivers. In other examples, a combination of processing circuitry common to the acoustic receivers and discrete processing circuitry for each of the receivers may be provided.

It may be that a corresponding plurality of acoustic transmitters is provided. It may be that the same processing circuitry provides signals to the plurality of acoustic transmitters for transmission on the communication signal. Alternatively, processing circuitry may provide signals to each of the acoustic transmitters for transmission on the acoustic communication channel which is discrete from the processing circuitry providing signals to the other transmitters. In other examples, a combination of processing circuitry common to the acoustic transmitters and discrete processing circuitry for each of the transmitters may be provided.

Similarly, the same circuitry may be provided for transmitting signals based on signals received by each of the receivers to one or more remote computing devices or circuitry may be provided for transmitting signals based on signals received by each of the receivers which is discrete from the circuitry provided for transmitting signals based on signals received by the other receivers (or any combination thereof).

As discussed above, it may be that a plurality of acoustic receivers is provided (e.g. acoustically coupled to the communication channel, e.g. above the surface in a downhole communication application), each comprising a plurality of acoustic sensors $\mathbf{102}_{1,2\ldots n}$ for detecting signals propagating on the acoustic communication channel (e.g. for detecting signals propagating on the acoustic conductor 503). In examples where a plurality of acoustic receivers is provided, the processing circuitry may be to process sensor data generated by the sensors $\mathbf{102}_{1,2\ldots n}$ of the plurality of receivers in response to acoustic signals propagating on the acoustic communication channel. The processing circuitry may be to obtain (e.g. receive) sensor data from the sensors $\mathbf{102}_{1,2\ldots n}$ of the plurality of receivers, or data derived therefrom, and to select sensor data from one or more of the sensors of the plurality of receivers, or data derived therefrom, based on at least one signal selection criterion. The processing circuitry may be to obtain (e.g. receive) sensor data from the sensors $\mathbf{102}_{1,2\ldots n}$ of the plurality of receivers, or data derived therefrom, and to select sensor data from one or more of the sensors of the plurality of receivers, or data derived therefrom, based on a comparison of the sensor data from the sensors of the receivers, or data derived therefrom, and at least one signal selection criterion. The at least one signal selection criterion may relate to a signal quality of the sensor data from the respective sensors $\mathbf{102}_{1,2\ldots n}$, or a quality of data derived from the sensor data from the respective sensors $\mathbf{102}_{1,2\ldots n}$. For example, the processing circuitry may be to select sensor data from one of the sensors $\mathbf{102}_{1,2\ldots n}$ of the acoustic receivers, or data derived therefrom, based on which of the sensors $\mathbf{102}_{1,2\ldots n}$ received signals from the acoustic communication channel having the highest received signal strength or signal to noise ratio or signal to interference and noise ratio.

It may be that providing a plurality of receivers improves spatial signal diversity.

As discussed above, the sensors $\mathbf{102}_{1,\ldots,n}$ of the plurality of receivers provide additional spatial signal diversity by detecting the signals at different positions along the standing wave compared to an assembly comprising a single receiver having the same number of sensors as one of the plurality of receivers, thereby increasing the probability of at least one sensor detecting the signal near or at a position of peak signal strength. By selecting the sensor data from the one of the sensors providing sensor data of the highest quality (e.g. highest signal strength, signal to noise ratio or signal to noise and interference ratio) of the sensor data provided by the plurality of sensors of the plurality of receivers, or data derived therefrom, the probability of generating acoustic signals of sufficiently high quality by way of the sensors based on the signals propagating on the communication channel are further improved. In addition, as before, even if the position of the peak signal strength changes over time, for example due to changes in the transfer function of the communication channel, a high quality signal may still be detected, for example by selecting sensor data from different ones of the plurality of sensors $\mathbf{102}_{1,\ldots,n}$ of the plurality of receivers, or data derived from sensor data from different ones of the plurality of sensors $\mathbf{102}_{1,\ldots,n}$, at different times (based on their respective qualities). This helps to improve the quality of signals which may be detected, which helps to increase the usable bandwidth of the communication channel.

As before, the processing circuitry may be to perform further processing on the selected data (e.g. calibration, decoding, processing of payload data of the signal data etc.).

When the assembly is deployed in a downhole application, the first and second acoustic receivers may be provided above the surface.

Although in FIGS. 8-12, the receivers are provided at substantially the same axial position along the length of the acoustic communication channel, in this case opposite each other on the acoustic conductor 503, in alternative examples the receivers may be axially offset from each other along the length of the acoustic communication channel. For example, the receivers may comprise first and second acoustic receivers acoustically coupled (e.g. by first and second couplers) to the same acoustic conductor 503 at positions axially spaced from each other along a longitudinal axis of the acoustic conductor or communication channel. Alternatively the first and second acoustic receivers may be acoustically coupled (e.g. by first and second couplers) to different first and second acoustic conductors of the acoustic communication channel axially spaced from each other along a longitudinal axis of the acoustic communication channel. In this case, it may be that the different acoustic conductors may have the same or different acoustic conduction properties as or from each other. For example, the different acoustic conductors may have different acoustic impedances from each other. Additionally or alternatively, the acoustic impedances of the acoustic communication channel seen by the first and second acoustic receivers may be substantially different from each other. As before, when the assembly is deployed in a downhole application, the first and second acoustic receivers may be provided above the surface.

As above, the sensors $\mathbf{102}_{1,\ldots,n}$ of the first and second receivers may together provide improved signal diversity compared to the sensors $\mathbf{102}_{1,\ldots,n}$ of a single one of the receivers. For example, when the first and second receivers are acoustically coupled (e.g. by first and second couplers) to the communication channel at positions which are offset from each other along the longitudinal axis of the acoustic communication channel (e.g., such that the spacing between the positions (e.g., the spacings between the positions) differs from (i.e., is not equal to) an integer multiple of the wavelength of the signals being received or from an integer multiple of half of the wavelength of the signals being received), the sensors $\mathbf{102}_{1,\ldots,n}$ may be acoustically coupled to the waveguides of the first and second receivers at the same corresponding positions along the lengths of the waveguides thereof (e.g., positions having the same longitudinal distances along the respective waveguides from an end of the waveguide acoustically coupled to the communication channel). Alternatively, as discussed above, the sensors $\mathbf{102}_{1,\ldots,n}$ may be acoustically coupled to the waveguides of the first and second receivers at different positions along the lengths of the waveguides thereof (e.g., positions having different longitudinal distances along the respective waveguides from the end of the waveguide acoustically coupled to the communication channel). For example, the sensors $\mathbf{102}_{1,\ldots,n}$ of the first receiver may be acoustically coupled to the waveguide thereof at first positions along its length and the sensors $\mathbf{102}_{1,\ldots,n}$ of the second receiver may be acoustically coupled to the waveguide thereof at second positions along its length. It may be that corresponding first and second positions are offset from each other along the lengths of the respective waveguides. That is, it may be that the first positions are offset from positions along the length of the waveguide of the first receiver corresponding to the second positions, and it may be that the second positions are offset from positions along the length of the waveguide of the second receiver corresponding to the first positions. For example, the corresponding first and second positions may be interdigitated (i.e., the second positions may be provided between positions along the waveguide of the second receiver corresponding to the first positions and vice versa).

By acoustically coupling the first and second acoustic receivers to different acoustic conductors of the acoustic communication channel at positions axially spaced from each other along a longitudinal axis of the acoustic communication channel, improved spatial signal diversity may be obtained among the signals generated by the sensors of the receivers. Additionally, by acoustically coupling the receivers to different acoustic conductors of the acoustic communication channel having different acoustic conduction properties, or such that the acoustic impedances of the acoustic communication channel seen by the first and second acoustic receivers are substantially different from each other, yet further improved reception diversity may be obtained among the signals generated by the sensors of the receivers. This is because the different acoustic conduction properties, such as different acoustic impedances, cause differences in the signals detected by the sensors of the different receivers. For example, different acoustic impedances cause different reflections at interfaces between different acoustic conductors of the acoustic communication channel, which can cause different changes in the signal qualities of the signals detected by the sensors of the different receivers. By providing more than one, spatially separated acoustic receiver, it may be that acoustic signals having travelled over a more direct path (i.e. having been subjected to fewer attenuations or distortions etc.) may be received by one of the receivers with better signal quality than the other(s). In this way, an increase in reception diversity provided by more than one receiver may improve the quality of the selected data.

For example, FIG. 13 illustrates an example drilling rig similar to the drilling rig illustrated in FIGS. 1-3. Corresponding features are referred to using the same reference numerals. In the example of FIG. 13, the drilling rig comprises first and second receivers 600, 601 (which may have any of the features of the acoustic receivers disclosed herein) acoustically coupled to the saver-sub 15 and the cement head 16 respectively. The saver-sub 15 and the cement head 16 have different acoustic impedances from each other and are axially offset from each other along the longitudinal axis of the acoustic communication channel. For example, the cement head 16 is denser than the saver-sub 15 such that the acoustic impedance of the cement head 16 is greater than that of the saver-sub 15. As discussed, by the processing circuitry selecting the sensor data from the one of the sensors providing sensor data of highest quality (e.g. highest signal strength, signal to noise ratio or signal to noise and interference ratio) of the sensor data provided by the sensors of the plurality of receivers, or data derived therefrom, the probability of generating acoustic signals of sufficiently high quality based on the signals propagating on the communication channel are significantly improved.

It will be understood that the axially offset acoustic receivers, such as receivers 600, 601, may be acoustically coupled (e.g. mounted) to the acoustic communication channel by way of respective couplers (such as coupler 504 discussed above). It may be that respective acoustic transmitters are also acoustically coupled to the acoustic communication channel by way of the respective couplers (again, for example as discussed above).

In examples, the first and second receivers 600, 601 (which may have any of the features of the acoustic receivers disclosed herein) may be acoustically coupled to different ones of any of: the drill string 1 or a portion thereof; top drive 14; saver sub 15; cement head 16; a casing of a borehole; production tubing; a riser; coiled tubing; production tubing; slips supporting the drill string below the top drive.

With reference to FIGS. 1-12, it may be that the plurality of sensors $\mathbf{102}_{1,\ldots,n}$ are acoustically coupled to (e.g. mounted on) the respective waveguide 101, 501, 701, 801, 901 such that some or all of the plurality of sensors $\mathbf{102}_{1,\ldots,n}$ are at fixed positions with respect to the waveguide, or such that some or all of the plurality of sensors $\mathbf{102}_{1,\ldots,n}$ are moveable with respect to the waveguide. For example, some or all of the plurality of sensors $\mathbf{102}_{1,\ldots,n}$ may be moveable along the length of the waveguide.

One or more of the plurality of sensors $\mathbf{102}_{1,\ldots,n}$ may be coupled to (e.g. mounted on) the waveguide by way of acoustically conductive couplers, such as flanges. For example, it may be that one or more of the plurality of sensors $\mathbf{102}_{1,\ldots,n}$ are coupled to (e.g. mounted on) the waveguide by moveable couplers, such as moveable flanges, where the couplers (e.g. flanges) provide acoustic communication between the waveguide and the plurality of sensors $\mathbf{102}_{1,\ldots,n}$. For example the sensors $\mathbf{102}_{1,\ldots,n}$ may be releasably coupled to the waveguide (e.g., by the couplers) so that they can be released and slid (e.g. together with the couplers) along the waveguide from respective first positions to respective second positions before being fixed again (e.g. together with the couplers) to the waveguide at the respective second positions. Additionally or alternatively, the sensors $\mathbf{102}_{1,\ldots,n}$ may be removably coupled to the waveguide (e.g., by the couplers) so that they can be removed from respective first positions on the waveguide (e.g. together with the couplers) and re-attached to the waveguide at respective second positions thereof (e.g. by way of the couplers or by way of further couplers). For example, the couplers (e.g. flanges) may be acoustic conductors, such as metal couplers (e.g. metal flanges) or couplers (e.g. flanges) of any other material and/or structure capable of transmitting or propagating acoustic signals, such as by way of transmitting vibrations from the waveguide to the plurality of sensors $\mathbf{102}_{1,\ldots,n}$. It may be that some of the plurality of sensors $\mathbf{102}_{1,\ldots,n}$, for example, at least two of the plurality of sensors $\mathbf{102}_{1,\ldots,n}$, are moveable along the length of the waveguide by way of the moveable flanges to allow the acoustic receiver to be tuned to preferentially receive acoustic signals of a particular wavelength or frequency (e.g. to enable the waveguide to better resonate in response to acoustic signals of that wavelength or frequency by modifying the weight distribution of the sensors and couplers), or to provide modified spatial diversity for the reception of the acoustic signals by adjusting the length of waveguide between sensors $\mathbf{102}_{1, \ldots, n}$. It may be that additional sensors can be added, or at least one of the plurality of sensors may be removable to allow the receiving frequency of the waveguide to be tuned.

Additionally or alternatively, it may be that the preferred reception frequency of the waveguide is tunable, for example by modifying one or more properties of the waveguide affecting its ability to vibrate at particular frequencies or wavelengths. For example, it may be that the reception frequency of the waveguide is tunable by the addition or removal of weights to or from the waveguide or by adjusting a weight distribution of the waveguide, for example by moving the sensors $\mathbf{102}_{1, 2 \ldots n}$ relative to each other along the waveguide.

Additionally or alternatively, it may be that the waveguide is removably acoustically coupled to the acoustic conductor 503 so that the waveguide can be detached from the acoustic conductor 503 and replaced with a waveguide better tuned to a particular frequency or wavelength, such as a frequency or wavelength band on which signals are to be received.

Thus, changes in the frequency of acoustic communication by way of the communication channel may be accommodated by 'tuning' or replacing the waveguide.

The limitation or compression of an extent of the waveguide provided by the change in direction of the path followed by the waveguide without reducing the length of the waveguide may enable the waveguide to provide improved tunability while fitting within physical size constraints for the acoustic receiver. This is because a waveguide of increased length for a given physical size constraint provides more flexibility in the frequency to which the waveguide is tunable. For example, a waveguide of increased length provides more flexibility in the positional distribution of sensors along the length of the waveguide to thereby adjust the frequency response of the waveguide. Additionally or alternatively, a waveguide of increased length allows more combinations of weights to be connected thereto to thereby adjust the frequency response of the waveguide.

Although specific example shapes for the waveguide have been described above, it will be understood that other shapes of waveguide may be provided. For example, it may be that the direction of the path followed by the entire length of the waveguide comprises a constant curvature. For example, it may be (not shown in the Figures) that the length of the waveguide forms a semi-annular or annular waveguide, which may be mounted to (and conform with the curvature of) the acoustic conductor 503. In this case, it may be that a separate coupler 504 is omitted. For example, it may be that a first end of the semi-annular or annular waveguide is welded, or otherwise permanently or temporarily affixed, to the acoustic conductor 503 (e.g., as a feedpoint by way of which acoustic signals are coupled from the acoustic communication channel to the waveguide). It may be that a second portion, such as a second end, of the semi-annular or annular waveguide is held (e.g. retained), for example by an acoustically insulating holder which may be coupled to the acoustic conductor 503, to thereby inhibit displacement of the waveguide with respect to the acoustic conductor 503 while allowing the waveguide to vibrate (e.g. substantially freely) in response to acoustic signals propagating on the waveguide. It may be that the semi-annular or annular waveguide fits around the acoustic conductor 503 when coupled thereto.

FIG. 14 is a flowchart of an example method for receiving acoustic signals by way of an acoustic communication channel, for example using any of the acoustic receivers or assemblies described herein, for example from a communications node, such as a downhole communications node. At block 1100, acoustic signals from the acoustic communication channel are sensed by a plurality (e.g. at least first and second sensors) of acoustic sensors of an acoustic receiver or assembly, such as an acoustic receiver comprising an acoustic waveguide configured to guide acoustic signals from the acoustic communication channel to the plurality of sensors. The plurality of sensors may be acoustically coupled to the waveguide at respective positions spaced along its length, the length of waveguide extending between at least first and second sensors changing direction to thereby limit the extent of the waveguide in at least one spatial dimension. The sensors $\mathbf{102}_{1,2,3,4}$ may be to detect (e.g. sample) acoustic waves at the respective positions spaced along the length of the waveguide. As described above, the acoustic sensors may be of any suitable sensor type. For example, the acoustic sensors may comprise accelerometers (e.g. accelerometers having an axis of acceleration to be sensed by the accelerometer aligned with the longitudinal axis of the communication channel), strain gauges, piezo-electric transducers, or fibre-optic acoustic sensors. As a result of the spacing of the sensors along the waveguide, the sensor data captures or samples the acoustic signals from the acoustic communication channel differently, which provides spatial signal diversity in the received acoustic signals. For example, it may be that the spacing between at least two of the positions at which sensors are acoustically coupled to the waveguide (e.g. the spacing between positions at which the sensors of each of one or more pairs or each pair of sensors, such as the sensors of each of one or more pairs or each pair of adjacent sensors, are acoustically coupled to the waveguide) is such that the signals detected by the respective sensors are phase shifted with respect to each other (e.g. the spacing differs from (i.e., is not equal to) an integer multiple of the wavelength of the signals being received or from an integer multiple of half of the wavelength of the signals being received). As discussed, the wavelength of signals being received may be predetermined.

The sensor data from the plurality of sensors may be obtained (e.g. received), for example, by processing circuitry, such as the processing circuitry described herein with respect to FIGS. 4-12. For example the sensor data may be obtained by (e.g. received at) processing circuitry of one or more remote computing devices, such as one or more surface computing devices.

At block 1120, the sensor data from the plurality of sensors is processed. For example, sensor data from one of the plurality of sensors, or data derived therefrom, may be selected (e.g. by the processing circuitry) based on at least one selection criterion. Sensor data from one of the plurality of sensors, or data derived therefrom, may be selected (e.g. by the processing circuitry) based on a comparison of the sensor data from the different sensors, or data derived therefrom, and at least one selection criterion. It may be that the selection criterion relates to a signal quality of the sensor data, or a quality of data derived from the sensor data from the respective sensors. For example, it may be that the selection criterion relates to at least one of: signal strength; signal-to-noise ratio; signal-to-noise-and-interference ratio.

For example, it may be that the method is to select sensor data from one of the sensors, or data derived therefrom, based on which of the sensors received signals having the highest signal strength, signal-to-noise-ratio or signal-to-noise-and-interference-ratio.

As described above, the spacing of the plurality of sensors along the length of a waveguide of an acoustic receiver or assembly, may provide improved spatial diversity for acoustic signal reception. It may be that by selecting sensor data from the spaced acoustic sensors, or data derived therefrom, (e.g. based on at least one selection criterion, for example by comparing sensor data from the spaced acoustic sensors or data derived therefrom) allows sensor data from the most optimally located sensor, or data derived therefrom, to be selected, and for example, further processed for recovering data communicated via the acoustic communication channel. For example, the selected data may be based on sensor data generated by the sensor whose acoustical coupling position along the length of the waveguide corresponds to a position at or nearest a peak maximum or minimum (amplitude) of a standing wave formed by the acoustic signal on the waveguide.

It may be that the method comprises further processing the selected data (e.g. by the processing circuitry), which may include at least one of: calibration, decoding, processing of payload data of the signal data.

In some examples, in block 1100, the acoustic signals from the acoustic communication channel are sensed by a plurality (e.g. at least first and second sensors) of acoustic sensors of each of a plurality of acoustic receivers, such as acoustic receivers each comprising an acoustic waveguide configured to guide acoustic signals from the acoustic communication channel to the plurality of sensors of that receiver. The acoustic receivers may be acoustically coupled to the communication channel, for example by way of respective couplers. In this case, block 1100 may comprise sensing acoustic signals by way of the acoustic communication channel by the sensors of the plurality of acoustic receivers. The sensor data from the plurality of sensors of the receivers may be obtained, for example, by processing circuitry, such as the processing circuitry described herein with respect to FIGS. 4-12. For example the sensor data may be received at processing circuitry of one or more remote computing devices, such as one or more surface computing devices. The acoustic receivers may have any of the features of acoustic receivers disclosed herein. The acoustic receivers may be arranged in relation to each other in any of the ways disclosed herein.

In this case, block 1120 may comprise selecting sensor data from one of the sensors of the receivers (e.g. by the processing circuitry), or data derived therefrom, based on at least one selection criterion. For example, block 1120 may comprise comparing sensor data from the sensors of the receivers (e.g. by the processing circuitry), or data derived therefrom, and selecting sensor data from one of the sensors of the receivers (e.g. by the processing circuitry), or data derived therefrom, based on the comparison and at least one selection criterion. It may be that the selection criterion relates to a signal quality of the sensor data, or a quality of data derived from the sensor data from the respective sensors. For example, it may be that the selection criterion relates to at least one of: signal strength; signal-to-noise ratio; signal-to-noise-and-interference ratio. For example, it may be that the method is to select sensor data from one of the sensors, or data derived therefrom, based on which of the sensors received signals having the highest signal strength, signal-to-noise-ratio or signal-to-noise-and-interference-ratio. By selecting sensor data from one sensor of the sensors of a plurality of acoustic receivers, or data derived therefrom, further spatial signal diversity is obtained, thereby further increasing the probability of receiving high quality sensor data. The sensors of the receivers may have any of the features discussed herein. The receivers may be arranged, for example in relation to the acoustic communication channel and in relation to each other, in any of the ways discussed herein.

As above, it may be that the method comprises further processing the selected data (e.g. by the processing circuitry), which may include at least one of: calibration, decoding, processing of payload data of the signal data.

Although not shown, it may be that the method of FIG. 14 may comprise transmitting communication signals on the communication signal by way of an acoustic transmitter, such as an acoustic transmitter acoustically coupled to the acoustic communication channel by the same coupler as the acoustic receiver.

It may be that an acoustic receiver or assembly as described herein with respect to any of the Figures may be used for receiving acoustic signals of an acoustic communication channel, or performing acoustic communication. For example, it may be that a method of receiving acoustic signals from an acoustic communication channel, or performing acoustic communication using the acoustic receiver or the assembly described herein, may improve acoustic communication. For example, a method of using at least the acoustic receiver or assembly disclosed herein may improve the spatial signal diversity achievable for communication within a given physical size constraint.

Some of the components described herein are referred to as being acoustically insulating or acoustically non-conductive, for example to inhibit acoustic signals from passing therethrough, for example to reduce noise or interference at the waveguide or the processing or transmission circuitry. In this case, the respective components may comprise or consist of materials such as a carbon fibre composite structure (e.g. having a honeycomb structure) configured to attenuate or block acoustic signals at predetermined signal frequencies which are to be attenuated or blocked, such as frequencies of data signals to be received from (or transmitted on) the communication channel.

Although the respective acoustic receivers of FIGS. 5-13 have been described above in some examples as being provided at or above the surface 4 and for receiving acoustic signals from a downhole communication node, it will be understood that an acoustic receiver, or a plurality of acoustic receivers, as discussed herein, such as acoustic receiver(s) according to any of FIGS. 5-13, may additionally or alternatively be provided (e.g., as part of a communications node or as part of respective communications nodes) downhole (e.g., below the surface). For example, the acoustic receivers(s) may be provided (e.g., as part of a communication node or as part of respective communication nodes) beneath the surface 4, at a lower longitudinal extent of the borehole 8 than the surface 4. For example, the acoustic receiver(s) may be provided down the borehole 8 (e.g., at or near the bottom of the borehole 8 or at an intermediate position along the length of the borehole between the surface 4 and the bottom of the borehole 8) in a downhole communication apparatus such as in any of the examples described with respect to any of FIGS. 1, 3, 13, 15. For example the downhole apparatus may comprise apparatus for use in any stage of a drilling or completion process (e.g. for forming a well or a liner hanger).

The (downhole) acoustic receiver(s) may receive acoustic signals from a surface communication node or from another communication node provided below the surface 4, for example in the borehole 8, by way of an (e.g., solid) acoustic communication channel as discussed herein. As discussed herein, the acoustic signals received by the acoustic receiver(s) may comprise calibration data, telemetry data (e.g., monitoring payload data, such as sensor data, for example including temperature data, pressure data or temperature and pressure data) or command or control data.

The acoustic receiver may be acoustically coupled to any section of a drilling rig or downhole tool that can form at least part of the communication channel and which is provided beneath the surface. For example, the acoustic receiver may be coupled to any part of a drilling rig (e.g., for performing the drilling or completion process or a portion thereof) or a downhole tool thereof or a downhole tool acoustically coupled thereto which is provided beneath the surface 4. For example, the acoustic receiver may be coupled to any one of: a below-surface acoustic conductor of a drill string, or a Drill Stem Testing (DST) string; an acoustic conductor of a Bottom Hole Assembly (BHA); an acoustic conductor of an Acoustic Telemetry System (ATS) tool or any other suitable downhole tool. In some examples, the acoustic receiver may be coupled to an acoustic conductor of a top-sub or a bottom-sub of a downhole tool or to a mandrel of a downhole tool extending between a top-sub and a bottom-sub thereof.

It may be that the second (downhole) communication node 12 of FIG. 1, FIG. 3 or FIG. 13 comprises an acoustic receiver as discussed herein, for example with respect to any of FIGS. 5-13, 16-17. The second (downhole) communication node 12 comprising the acoustic receiver may be in data communication with any one, or more, of downhole components: sensors, such as temperature sensors or pressure gauges; valves; chokes; firing heads; packers; perforators; samplers; flow meters; and fluid analysers.

In a similar way to at or above the surface 4, physical space may be limited for a downhole receiver. By providing an acoustic receiver comprising a waveguide, as described herein, having a length which follows a path which changes direction to thereby limit an extent of the waveguide in at least one spatial dimension (e.g. to limit at least a vertical extent of the waveguide or at least a horizontal extent of the waveguide), the acoustic receiver may have a plurality of acoustic sensors for receiving acoustic signals which are sufficiently spaced from each other along the length of the waveguide to achieve a desired spatial signal diversity while enabling the acoustic receiver(s) to be accommodated in the limited (e.g., vertical, e.g., horizontal) extent available.

Additionally or alternatively, the reduced extent of such an acoustic receiver may enable the receiver to be better protected from environmental conditions; additionally or alternatively, acoustical noise detected by the receiver may be decreased. This may be beneficial for example in downhole applications (e.g. drilling or completion applications) where the receiver is provided at any location beneath the surface, and particularly when the acoustic receiver may rotate during use (e.g. when coupled to a rotatable downhole part of a drilling rig, such as a drill string, or tool thereof or coupled thereto, such as a Bottom Hole Assembly (BHA)).

Additionally or alternatively, in any of the examples described herein (whether the acoustic receiver is provided at the surface or downhole), limiting the extent of the waveguide may help to reduce material costs and weight, for example, by enabling a housing (e.g., outer jacket 570 or 1570—see below with respect to FIGS. 17*a*, 17*b*) of correspondingly reduced extent to be fitted around the waveguide (e.g., for protecting the waveguide, and in some cases circuitry which may be provided in the vicinity of the waveguide), by enabling the acoustic conductor to which the waveguide is coupled to have a correspondingly reduced extent, or both.

In FIG. 15 features common with the schematic diagram of FIGS. 1, 3, 13 share the same reference numerals. FIG. 15 shows an example downhole apparatus (which may comprise, for example, a stage of a completion process, such as a drilling process or a drill stem testing process) in which a drill string 1207 extends down a borehole 8 from the surface 4 to a barrier 1205, such as a hex plug or other barrier or region isolator (e.g. a packer). The barrier 1205 may fluidly seal the borehole so as to inhibit or prevent fluid flow (e.g., through the barrier) between first and second portions of the borehole 8 above and below the barrier 1205. A tool 1203, such as a downhole Acoustic Telemetry Systems (ATS) tool, may be coupled to a lower side of the barrier 1205 (e.g., opposite the drill string side). The tool 1203 may be provided in a portion of the borehole 8 extending downwards from the barrier 1205 (e.g., between the barrier 1205 and another barrier, such as the bottom 1206 of the borehole 8 or another hex plug for example). For example, the tool 1203 may extend (e.g., hang) down from the barrier 1205 in a direction having a vertical component.

An acoustic receiver, such as any of the acoustic receivers described herein (e.g., with reference to any of FIGS. 5-13, 16-17) may be acoustically coupled to the tool 1203 (e.g., as part of a downhole communication node), for example in order to receive signals from one or more communication nodes, such as one or more communication nodes provided closer to the surface 4 than the tool 1203, such as one or more surface communication nodes, one or more sub-surface communication nodes or both surface and sub-surface communication nodes.

As in the examples of FIGS. 1, 3, 13 discussed herein, in the example illustrated in FIG. 15 an (e.g., solid) acoustic communication channel may be provided between communication nodes, such as between a surface or a sub-surface communication node (or both surface and sub-surface communication nodes) and the acoustic receiver provided in the portion of the borehole 8 provided below the barrier 1205. The communication channel may comprise the drill string 1207, or at least a portion thereof. The communication channel may comprise an acoustic conductor of the tool 1203 which may be acoustically coupled to the acoustic receiver (e.g., by way of a coupler as discussed herein). The communication channel may further comprise the barrier 1205. Additionally or alternatively, the communication channel may comprise a portion of a borehole casing of the borehole 8 within which the barrier 1205 and the drill string are provided. The tool 1203 and the acoustic receiver may be provided directly below the barrier 1205 or below e.g. gauges, for example comprising Acoustic Telemetry Systems, ATSs, provided beneath the barrier 1205.

The space available in the portion of the borehole 8 extending downwards from the barrier 1205 (e.g., between the barrier 1205 and the another barrier, such as the bottom 1206 of the borehole 8 or the other hex plug) for the tool 1203 and the acoustic receiver coupled thereto may have a limited (e.g., vertical or horizontal) extent. By providing an acoustic receiver comprising a waveguide, as described herein, having a length which follows a path which changes direction to thereby limit an extent of the waveguide in at least one spatial dimension (e.g. to limit at least a vertical extent of the waveguide or at least a horizontal extent of the waveguide), the acoustic receiver may be provided with a plurality of acoustic sensors for receiving acoustic signals which are sufficiently spaced from each other to achieve a desired spatial signal diversity while enabling the acoustic receiver(s) to be accommodated in the limited (e.g., vertical, e.g., horizontal) extent available. The other benefits of limiting the extent of the waveguide discussed herein (e.g., reduced cost, reduced weight, reduced noise, reduced likelihood of damage and so on) may also apply.

FIGS. 16*a* and 16*b* show a helical waveguide 901 of an acoustic receiver for use in a downhole apparatus (e.g., an acoustic receiver of a downhole communication node), such as in a downhole apparatus illustrated in any of FIGS. 1, 3, 13, 15. Features in common with other examples discussed herein are provided with the same reference numerals. The helical waveguide 901 is helically wound around an acoustic conductor 1303 and acoustically coupled thereto by an acoustically conductive coupler 504 (e.g., in any of the ways discussed herein). The acoustic conductor 1303 may have a longitudinal axis 1305. The longitudinal axis of the acoustic communication channel may be co-linear with the longitudinal axis 1305 of the acoustic conductor 1303. Although FIGS. 16*a*, 16*b* show the waveguide 901 and conductor 1303 arranged in different orientations, it will be understood that in practice the acoustic conductor 1303 may extend vertically or substantially vertically (e.g., in the orientation shown in FIG. 16*a*). The conductor 1303 may be acoustically coupled to, and may form part of, an (e.g., solid) acoustic communication channel extending between a first (e.g., surface or sub-surface) communication node and the waveguide 901.

The acoustic conductor 1303 may be an acoustic conductor of a downhole tool, such as the tool 1203 of FIG. 15. For example, the tool 1203 may comprise an acoustically conductive tube (e.g. a mandrel) 1303 around which the waveguide 901 is wound. The acoustically conductive tube (e.g., mandrel) 1303 may extend between top and bottom subs (not shown in FIGS. 16*a*, 16*b*) of the downhole tool 1203.

As discussed in respect of other examples herein, the waveguide 901 may be acoustically coupled (e.g. mounted) to the (e.g. solid) acoustic conductor 1303 of the (e.g. solid) acoustic communication channel by way of its first end 932 and the coupler 504. As discussed in respect of other examples herein, the coupler 504 may provide a feedpoint by way of which acoustic signals are coupled from the acoustic communication channel to the waveguide 901.

Although in this example, the waveguide 901 is shown to have a helical shape, it is to be understood that any waveguide having a length which follows a path which changes direction to thereby limit an extent, such as a vertical or horizontal extent, of the waveguide in at least one spatial dimension (e.g., the vertical or horizontal dimension), may be provided (such as a waveguide of any shape described herein). In addition, although the waveguide 901 is also shown in FIGS. 16*a*, 16*b* to be helically wound round the acoustic conductor 1303, the arrangement of the waveguide with respect to the downhole acoustic conductor 1303 is not so limited and may take any alternative suitable form, such as the form of any of the waveguide arrangements described herein.

As discussed in relation to other examples herein, a holder 930 may be provided which is configured to hold (e.g. retain) a second end 931 of the waveguide 901 to thereby inhibit displacement of the second end 931 of the waveguide with respect to the acoustic conductor 1303 while allowing the second end 931 of the waveguide to vibrate (e.g. substantially freely) in response to acoustic signals propagating on the waveguide 1303. As in other examples, the holder 930 may comprise a shoulder 908 comprising a recess 936 which receives and partially houses the second end 931 of the waveguide 901 therein. In the example of FIG. 16*a*, 16*b*, the shoulder 908 comprising the recess 936 is formed on an outer surface of the holder 930. It may be that the holder 930 is acoustically insulating to inhibit transmission of acoustic signals through the holder 930 between the second end 931 of the waveguide 901 and the acoustic conductor 1303. The holder 930 may be at least one of: formed of an acoustically insulating material, structured to be acoustically insulating, or be acoustically isolated (such as by the addition of a dampener) from the acoustic conductor 1303 (for example).

In some examples holder 930 may be omitted.

As in other examples discussed herein, the waveguide 901 provides an acoustic propagation path for guiding acoustic signals from the conductor 1303 to a plurality of sensors $\mathbf{102}_{1,\ldots,n}$ acoustically coupled to the waveguide 901 to sense acoustic signals received by way of the communication channel. It will be understood that the waveguide 901 is to guide acoustic waves along the path to the respective sensors $\mathbf{102}_{1,\ldots,n}$, for example from the feedpoint provided by coupler 504. The sensors $\mathbf{102}_{1,\ldots,n}$ may be acoustically coupled to the waveguide 901 at respective positions spaced along the length of the waveguide 901, e.g. to thereby detect (e.g. sample) acoustic waves at the respective positions spaced along the length of the waveguide. The sensors $\mathbf{102}_{1,\ldots,n}$ may comprise any sensors suitable for sensing acoustic signals from the communication channel, either directly or indirectly. The sensors $\mathbf{102}_{1,\ldots,n}$ of the receiver may be of the same acoustic sensor type. The sensors $\mathbf{102}_{1,\ldots,n}$ may comprise accelerometers (e.g. accelerometers having an axis of acceleration to be sensed by the accelerometer aligned with the longitudinal axis of the communication channel), strain gauges, piezo-electric transducers, or fibre-optic acoustic sensors. For example, the acoustic receiver may comprise accelerometers $\mathbf{102}_{1,\ldots,n}$ to sense the acoustic signals from the acoustic communication channel, the accelerometers being coupled to the waveguide 901 and sensing acoustic signals from the communication channel 1303 by way of a vibration of the waveguide 901 propagating to the accelerometers. In another example, the sensors $\mathbf{102}_{1,\ldots,n}$ may comprise strain-gauges, piezoelectric transducers $\mathbf{102}_{1,\ldots,n}$, or fibre optic acoustic sensors to sense the vibration of the waveguide 901 by way of mechanical stress induced in the sensors as a result of the vibration of the waveguide 901 caused by acoustic signals propagating along the waveguide 901 from the acoustic conductor 1303.

As discussed herein, by acoustically coupling a plurality of sensors $\mathbf{102}_{1,\ldots,n}$ to the waveguide 901 at respective positions spaced along the length of the waveguide 901, for example such that the signals detected by at least two of the sensors (e.g. the signal detected by each of the sensors) are phase shifted with respect to each other (e.g., such that the spacing between at least two of the positions (e.g., the spacings between each of the positions) differs from (i.e., is not equal to) an integer multiple of the wavelength of the signals being received or from an integer multiple of half of the wavelength of the signals being received), the sensors $\mathbf{102}_{1,\ldots,n}$ will provide spatial signal diversity by detecting the communication signals at different positions along the standing wave, thereby increasing the probability of at least one sensor detecting the signal near or at a position of peak signal strength. The wavelength of the signals being received may be predetermined.

As in other examples discussed herein, the spacing between adjacent sensors $102_{1 \ldots, n}$ may be substantially the same along the length of the waveguide 901, or it may be that the spacings between adjacent sensors $102_{1, \ldots, n}$ varies along the length of the waveguide 901, or it may be that the spacings between some adjacent sensors are substantially the same and the spacings between other adjacent sensors are different from each other.

As above, processing circuitry (not shown in FIG. 16*a*, 16*b*) may be provided for processing signals from the acoustic receiver based on acoustic signals received by the acoustic receiver from the acoustic communication channel. The processing circuitry may be provided in wired or wireless data communication with the sensors $102_{1, 2 \ldots n}$. The processing circuitry may, for example, be mounted to the acoustic conductor 1303, for example at a position axially offset from the waveguide 901, for example by way of a coupler, such as coupler 580 (as discussed herein in relation to other examples) which may conform to the outer curvature of the acoustic conductor 1303. Alternatively, the processing circuitry may be provided by a downhole tool coupled (e.g., attached) to the acoustic conductor 1303. The processing circuitry may be in (e.g., wired or wireless) data communication with further processing circuitry (e.g., control circuitry) of a downhole tool (e.g., downhole tool 1203 or a further downhole tool which may be coupled, e.g., attached, to the acoustic conductor 1303). The processing circuitry may be to process sensor data generated by the sensors $102_{1, 2 \ldots n}$ coupled to the waveguide 901 in response to acoustic signals propagating on the acoustic communication channel. As described in relation to other examples described herein, the sensor data of highest quality (e.g. highest signal strength, signal to noise ratio or signal to noise and interference ratio) from the sensor data provided by the plurality of sensors, or data derived therefrom, may be selected, for example for further processing, for communication to the further processing circuitry of the downhole tool, or for further processing and subsequent communication to the further processing circuitry of the downhole tool. Thus, even if the position of the peak signal strength changes over time, for example due to changes in the transfer function of the conductor 1303, a high quality signal may still be detected, for example from different ones of the plurality of sensors $102_{1, \ldots, n}$ over time. The processing circuitry may perform the selection, further processing, cause the communication of the selected or further processed signals to the further processing circuitry of the downhole tool, or any combination thereof.

Although not shown in FIGS. 16*a*, 16*b*, it will be understood that a housing (e.g., an outer jacket 570, such as an acoustically insulating or non-conductive jacket 570, as discussed in relation to other examples herein) may be provided over the waveguide 901 as discussed in relation to any other example herein. For example, the housing (e.g., outer jacket 570) may be mounted to the conductor 1303 by way of a coupler 572 as discussed in relation to other examples herein. In some examples, processing circuitry (which may be in wired or wireless data communication with the sensors $102_1$-$102_n$) may be mounted on an outer surface of the conductor 1303 in the vicinity of the waveguide 901. As mentioned above, the housing (e.g., outer jacket 570) may be provided over the waveguide 901 and associated processing circuitry.

As well as enabling spatial signal diversity in a limited physical space, the limitation of the vertical extent of the waveguide 901, and thus the corresponding limitation of the vertical extent of the housing (e.g., outer jacket) and the conductor 1303, may help to reduce the quantity of material required to form the housing and the conductor 1303 (e.g., tool 1203), resulting in reduced material costs and weight. This may be beneficial in downhole communication applications where the tool is provided beneath the surface as the weight of the downhole components may be constrained, e.g. by operational considerations.

As discussed with respect to other examples herein, the waveguide 901 may be provided with a curvature which conforms to the curvature of at least a curved portion of a cross-section of the acoustic conductor 1303 (taken perpendicular to the longitudinal axis of the acoustic conductor or the communication channel) in order to help protect the receiver, for example, from deformation when the conductor 1303 rotates, or from debris. In this case, the outer jacket 570 (where provided) may also be provided with a curvature which conforms to the curvature of at least a curved portion of the cross-section of the acoustic conductor 1303.

In another example illustrated in FIGS. 17*a* and 17*b*, it may be that a waveguide 901 of the acoustic receiver is acoustically coupled to a top-sub 1403 of a downhole tool. The top-sub 1403 may be provided at a first (e.g., vertically upper) end of a downhole tool (e.g., a downhole tool coupled to the drilling rig). Additionally or alternatively, it may be that the waveguide of the acoustic receiver is acoustically coupled to a bottom-sub of a downhole tool. The bottom-sub may be provided at a second (vertically lower) end of a downhole tool opposite the first side. A mandrel of the downhole tool may extend between the top and bottom subs. In the present example, it will be assumed that the waveguide 901 is coupled to the top-sub 1403. The top-sub 1403 may be provided below the surface 4, such as at or near the bottom of the borehole 8, or at an intermediate position along the length of the borehole 8 between the surface 4 and the bottom of the borehole 8. The top-sub 1403 (or at least a portion thereof) may be acoustically conductive and may form part of the acoustic communication channel between one or more communication nodes and the waveguide 901 of FIGS. 17*a*, 17*b*.

As shown in FIGS. 17*a*, 17*b*, the waveguide 901 may be helical. The acoustic communication channel may have a longitudinal axis 1705 around which the waveguide winds. The waveguide 901 may be coupled to an acoustically conductive lower portion 1404 of the top-sub 1403 (the lower portion 1404 of the top-sub 1403 acting as an acoustic coupler between the waveguide 901 and the acoustic communication channel) such that the waveguide 901 extends (e.g., hangs) vertically downwards from the top-sub 1403. A first end 932 of the waveguide 901 may be acoustically and mechanically coupled to the acoustically conductive lower portion 1404 of the top-sub 1403. The acoustic receiver further comprises a plurality of acoustic sensors $102_1$ to 102*n* acoustically coupled to the waveguide 901 at positions spaced along the length of the waveguide 901.

In the illustrated example, four acoustic sensors $102_1$ to $102_4$ are shown, but it will be understood that any suitable number of acoustic sensors may be provided. As also shown, three of the acoustic sensors $102_1$ to $102_3$ are mounted to the waveguide 901 at positions spaced from each other along the length of the waveguide 901, and one of the acoustic sensors $102_4$ is mounted to a lower surface of the top-sub 1403 which is acoustically coupled to the first end 932 of the waveguide 901.

As illustrated in FIG. 17*b*, it may be that the assembly further includes an outer jacket 1570 which may be provided over the waveguide 901 to house the receiver (including the waveguide 901 and the sensors $101_{1, 2, 3, 4}$) below the top-sub 1403. The outer jacket 1570 may comprise a sleeve which fits over the waveguide 901. The outer jacket may be mechanically coupled (e.g., screw fitted) to the top-sub 1403. The outer jacket 1570 may be the same as, or similar to, outer jacket 570 discussed in any of the other examples herein. The outer jacket 1570 may be formed of a single casing, as illustrated in FIG. 17*b*, or may be formed of multiple casings, e.g. panels, sealed together to form the jacket 1570. The outer jacket 1570 may be provided to protect the acoustic receiver, for example from a potentially high temperature and high pressure environment, and in some cases debris, particularly when the top-sub 1403 may rotate at relatively high rotational speed, for example during drilling.

A holder 930 may be provided which is configured to hold (e.g. retain) a second end 931 of the waveguide 901 to thereby inhibit displacement of a second end 931 of the waveguide 901 with respect to the top-sub 1403 while allowing the second end 931 of the waveguide to vibrate (e.g. substantially freely) in response to acoustic signals propagating on the waveguide 1303. Although in the examples of FIGS. 16*a*, 16*b*, the waveguide 901 is acoustically coupled to the communication channel at a relatively lower vertical position and held by a holder 930 at a relatively higher vertical position, in the example if FIGS. 17*a*, 17*b* the waveguide 901 is acoustically coupled to the communication channel at a relatively higher vertical position and held by the holder 930 at a relatively lower vertical position. This arrangement enables the waveguide 901 to be directly acoustically coupled to the top-sub 1403.

As in other examples, the holder 930 may comprise a shoulder 908 comprising a recess (not shown) which receives and partially houses the second end 931 of the waveguide 901 therein. It may be that, when the outer jacket 1570 is fitted over the waveguide 901, an outer surface of the holder 930 engages an inner surface of the jacket 1570. The holder 930 may be held in position at least partly by its engagement with the outer jacket. This may help to direct stresses and strains which may otherwise act on the waveguide 901, for example during rotation thereof, to the outer jacket 1570 rather than to the waveguide 901.

It may be that the holder 930 is acoustically insulating to inhibit transmission of acoustic signals through the holder 930 between the second end 931 of the waveguide 901 and the outer jacket 1570. The holder 930 may be at least one of: formed of an acoustically insulating material, structured to be acoustically insulating, or be acoustically isolated (such as by the addition of a dampener) from the outer jacket 1570 (for example).

In some examples holder 930 may be omitted.

It may be that the outer jacket 1570 is acoustically insulating or acoustically non-conductive to help to attenuate environmental noise propagating to the waveguide 901 of the acoustic receiver from outside the jacket 1570, such as noise from within the borehole, for example such as reverberations etc. arising from a completion process, such as drilling. For example, it may be that the outer jacket 1570 is lined with acoustically attenuating material.

As before, by providing the acoustic receiver of FIGS. 17*a*, 17*b* with a waveguide, as described herein, having a length which follows a path which changes direction to thereby limit an extent of the waveguide in at least one spatial dimension (e.g. to limit at least a vertical extent of the waveguide or at least a horizontal extent of the waveguide), the acoustic receiver may be provided with a plurality of acoustic sensors for receiving acoustic signals which are sufficiently spaced from each other to achieve a desired spatial signal diversity while enabling the acoustic receiver(s) to be accommodated in a limited (e.g., vertical, e.g., horizontal) extent available. The other benefits of having limiting the extent of the waveguide discussed herein (e.g., reduced cost, reduced weight, reduced noise, reduced likelihood of damage and so on) also apply. In particular, the outer jacket 1570 may have a correspondingly reduced extent, saving material cost and weight.

Although a cut-out is illustrated in FIG. 17*b* through which the waveguide 901 and sensors $\mathbf{102}_1$-$\mathbf{102}_4$ can be seen, it will be understood that this is for clarity of illustration and that in practice the outer jacket 1570 may not have such a cut-out. In addition, although in this example the waveguide 901 is shown to have a helical shape, it is to be understood that any waveguide having a length which follows a path which changes direction to thereby limit an extent, such as a vertical or horizontal extent, of the waveguide in at least one spatial dimension (e.g., the vertical dimension), may be provided (such as a waveguide of any shape described herein).

As above, processing circuitry (not shown in FIG. 17*a*, 17*b*) may be provided for processing signals from the acoustic receiver based on acoustic signals received by the acoustic receiver from the acoustic communication channel. The processing circuitry may be provided in (e.g., wired or wireless) data communication with the sensors $\mathbf{102}_{1,2\ldots n}$. The processing circuitry may, for example, be mounted in a cavity provided between the lower portion 1404 of the top sub 1403 and an upper portion of the top sub. Alternatively, the processing circuitry may be provided by a further downhole tool coupled (e.g., attached) to the downhole tool (e.g., by way of the top sub 1403), in which case the processing circuitry may be communicatively coupled to the sensors $\mathbf{102}_{1,2\ldots n}$ for example by a wired or wireless (e.g., inductive) connection. As above, the processing circuitry may be in (e.g., wired or wireless) data communication with further processing circuitry (e.g., control circuitry) of the downhole tool or of a or the further downhole tool which may be coupled, e.g., attached, to the downhole tool. The processing circuitry may, for example, be to process sensor data generated by the sensors $\mathbf{102}_{1,2\ldots n}$ coupled to the waveguide 901 in response to acoustic signals propagating on the acoustic communication channel. As described in relation to other examples described herein, the sensor data of highest quality (e.g. highest signal strength, signal to noise ratio or signal to noise and interference ratio) from the sensor data provided by the plurality of sensors, or data derived therefrom, may be selected, for example for further processing, for communication to the further processing circuitry of the downhole tool, or for further processing and subsequent communication to the further processing circuitry of the downhole tool. Thus, even if the position of the peak signal strength changes over time, a high quality signal may still be detected, for example from different ones of the plurality of sensors $\mathbf{102}_{1,\ldots,n}$ over time. The processing circuitry may perform the selection, further processing, cause the communication of the selected or further processed signals to the further processing circuitry of the downhole tool, or any combination thereof.

It may be that by the waveguide 901 of the acoustic receiver is provided with a curvature which conforms to the curvature of at least a curved portion of a cross-section of the outer jacket 1570 (taken perpendicular to the longitudinal axis of the acoustic conductor or the communication channel) to help further protect the receiver assembly, for example from deformation when rotating or from debris (e.g. drilling debris).

It will be understood that the assemblies of FIGS. 16*a*, 16*b*, 17*a*, 17*b* may further comprise a second receiver, for example a second receiver comprising a waveguide and one or more acoustic sensors, for example to provide further improved signal diversity. The second receiver may comprise any of the features of the any of the acoustic receivers discussed herein. The processing circuitry (where provided) may be to process sensor data generated by the sensors $\mathbf{102}_{1,2\ldots n}$ coupled to the waveguides of each of the receivers in response to acoustic signals propagating on the acoustic communication channel. As described in relation to other examples described herein, the sensor data of highest quality (e.g. highest signal strength, signal to noise ratio or signal to noise and interference ratio) from the sensor data provided by the plurality of sensors of the receivers, or data derived therefrom, may be selected, for example for further processing. Thus, even if the position of the peak signal strength changes over time, for example due to changes in the transfer function of the communication channel, a high quality signal may still be detected, for example from different ones of the plurality of sensors $\mathbf{102}_{1,\ldots,n}$ over time.

It may be that any of the methods discussed herein with reference to the flowchart of FIG. 14 may be performed by way of an acoustic receiver downhole. The method illustrated by the flowchart of FIG. 14 may thus be performed by way of an acoustic receiver provided at the surface or beneath the surface (i.e. downhole).

It will be understood that, in the examples of any of FIGS. 16-17, an acoustic transmitter 1750 (e.g., comprising a transducer such as a piezo-electric transducer), may be provided as described in relation to other examples herein, for example as part of a communication node below the surface (e.g., in combination with the acoustic receiver). For example, as described above, it may be that an acoustic transmitter and the waveguide of the acoustic receiver are acoustically coupled to the acoustic communication channel by way of the same coupler. In this way a space efficient arrangement can be provided, which may be advantageous for an assembly deployed for downhole communications below the surface where space is limited. below the surface. As described above, to inhibit interference between transmitted and received signals by use of the same coupler to couple the transmitter and receiver to the acoustic conductor, it may be that the transmitter and corresponding receiver are used to communicate at different times (e.g. half duplex communication).

Within the scope of this application it is expressly intended that the various examples and alternatives set out in the preceding paragraphs, in the claims and/or in the following description and drawings, and in particular the individual features thereof, may be taken independently or in any combination. That is, all examples and/or features of any example can be combined in any way and/or combination, for example it may be that apparatus features correspond to method features or vice versa, unless such features are incompatible.

In this specification, the phrase "at least one of A or B" and the phrase "at least one of A and B" should be interpreted to mean any one or more of the plurality of listed items A, B, etc., taken jointly and severally in any and all permutations.

Where functional units are described as separate hardware, any of the functionality may be integrated or combined into fewer hardware components.

The disclosure also extends to the following examples.

Example 1: An acoustic receiver for receiving acoustic signals from an acoustic communication channel, the acoustic receiver comprising: a (e.g. acoustic) waveguide; and at least first and second sensors for sensing the acoustic signals, the sensors being in acoustic communication with the waveguide; wherein the first and second sensors are acoustically coupled to the waveguide at respective first and second positions spaced from each other along a length of the waveguide (e.g. such that the first and second sensors are to sense signals which are phase shifted with respect to each other, e.g. to provide spatial signal diversity), and wherein the length of the waveguide between the first and second positions follows a path that changes direction to thereby limit an extent of the waveguide.

Example 2: The acoustic receiver of Example 1, wherein the length of the waveguide between the first and second positions follows the path that changes direction to thereby limit the extent of the waveguide in at least one spatial dimension.

Example 3: The acoustic receiver of Example 1 or Example 2, wherein the waveguide is couplable or coupled to an acoustic conductor, the acoustic conductor to provide at least part of the acoustic communication channel.

Example 4: The acoustic receiver of Example 3, wherein the length of the waveguide between the first and second positions follows a path that changes direction to thereby limit the extent of the waveguide with respect to the acoustic conductor.

Example 5: The acoustic receiver of Example 3 or Example 4, wherein the acoustic communication channel has a longitudinal axis and wherein the length of the waveguide between the first and second positions follows a path that changes direction to thereby limit an extent of the waveguide in a direction substantially parallel to the longitudinal axis of the acoustic communication channel.

Example 6: The acoustic receiver of Example 5, wherein the longitudinal axis of the acoustic communication channel is substantially parallel to vertical.

Example 7: The acoustic receiver of any preceding Example, wherein the length of the waveguide between the first and second positions follows a path that changes direction to thereby limit a vertical extent of the waveguide.

Example 8: The acoustic receiver of Example 7, wherein the acoustic communication channel is a downhole acoustic communication channel and the length of the waveguide between the first and second positions follows a path that changes direction to thereby limit an extent of the waveguide with respect to a vertical extent of an above-surface portion of the acoustic communication channel or with respect to a vertical extent of a sub-surface portion of the acoustic communication channel.

Example 9: The acoustic receiver of any of Examples 3 to 9, wherein the acoustic communication channel is substantially straight along its length.

Example 10: The acoustic receiver of Example 8, wherein the acoustic communication channel comprises at least one tubular member.

Example 11: The acoustic receiver of any of Examples 3 to 10, wherein the acoustic conductor has a longitudinal axis and is substantially straight along its length.

Example 12: The acoustic receiver of Example 10, wherein the acoustic conductor is a tubular member.

Example 13: The acoustic receiver of any of Examples 1 to 12, wherein the waveguide conforms to at least a portion of a cross-section of the acoustic conductor taken perpendicular to a longitudinal axis of the acoustic communication channel (e.g. the waveguide is curved to conform to a curvature of at least a curved potion of a cross-section of the acoustic conductor taken perpendicular to a longitudinal axis of the acoustic conductor), for example to fit around the acoustic conductor when coupled thereto.

Example 14: The acoustic receiver of any of Examples 1 to 13, wherein the change in direction of the path comprises a component in a direction conforming to a curvature of a cross-section of the acoustic conductor (for example to fit around the acoustic conductor when coupled thereto), the cross-section of the acoustic conductor taken perpendicular to a longitudinal axis of the acoustic conductor or perpendicular to a longitudinal axis of the acoustic communication channel, and a component in a direction substantially parallel or perpendicular to the longitudinal axis of the acoustic conductor.

Example 15: The acoustic receiver of any of Examples 1 to 14, wherein the change in direction of the path comprises at least one component in each of three spatial dimensions.

Example 16: The acoustic receiver of any of Examples 1 to 13, wherein the change in direction of the path followed by the waveguide between the first and second positions is confined within a plane.

Example 17: The acoustic receiver of any of the preceding Examples, wherein the path followed by the waveguide between the first and second positions comprises a plurality of substantially parallel portions, and wherein at least two of the substantially parallel portions (e.g. at least two adjacent parallel portions of the waveguide) are joined by a portion of the waveguide which follows the path that changes direction (e.g. are joined by a curved portion of the waveguide), e.g., to form a loop or turn between the two substantially parallel portions, e.g., a plurality of pairs of adjacent parallel portions of the waveguide may be joined by respective portions of the waveguide which follow the path that changes direction (e.g. are joined by respective curved portions of the waveguide, e.g. to form loops or turns between adjacent parallel portions).

Example 18: The acoustic receiver of Example 17, wherein the substantially parallel portions are orientated substantially parallel or substantially perpendicular to the longitudinal axis of the acoustic conductor or acoustic communication channel.

Example 19: The acoustic receiver of any of the preceding Examples wherein the path is a serpentine path.

Example 20: The acoustic receiver of any of the preceding Examples, wherein the path comprises a repeating pattern (e.g. the path is substantially sinusoidal or the path comprises at least a partial sinusoid).

Example 21: The acoustic receiver of any of the preceding Examples comprising a plurality of pairs of sensors for sensing acoustic signals, each of the pairs of sensors comprising respective first and second sensors coupled to the waveguide at respective first and second positions spaced from each other along the length of the waveguide, the respective length of the waveguide between the respective first and second positions following a path that changes direction to thereby limit an extent of the waveguide.

Example 22: The acoustic receiver of any of the preceding Examples, further comprising acoustically conductive couplers acoustically coupling the sensors to the waveguide.

Example 23: The acoustic conductor of any of the preceding Examples, wherein the sensors or couplers are moveable along a length of the waveguide.

Example 24: The acoustic receiver of any of the preceding Examples, wherein the waveguide is a tuneable waveguide (e.g. tuneable with respect to the frequency of the acoustic signals to be received by way of the acoustic communication channel).

Example 25: The acoustic receiver of any of the preceding Examples, wherein the at least first and second sensors comprise: accelerometers, such as accelerometers having an axis of acceleration to be sensed by the accelerometer aligned with the longitudinal axis of the communication channel; strain gauges; piezo-electric transducers; or fibre-optic acoustic sensors.

Example 26: The acoustic receiver of any of the preceding Examples, wherein the acoustic communication channel is a downhole acoustic communication channel.

Example 27: The acoustic receiver of Example 26, wherein the acoustic conductor comprises one of: a drill string or a portion thereof, a top-drive, a saver-sub mounted between a top-drive and a drill string, a cement head; a casing of a borehole; production tubing; a riser; coiled tubing; production tubing; slips supporting the drill string below the top drive; a downhole acoustic conductor; at least a portion of a top-sub of a downhole tool or at least a portion of a bottom-sub of a downhole tool; an acoustic conductor of a downhole tool, such as a tool mounted below a hex plug; a portion of a downhole Acoustic Telemetry System, ATS, tool; a portion of a Bottom Hole Assembly, BHA, tool; a portion of a Drill Stem Testing, DST, string tool.

Example 28: An assembly comprising: the acoustic receiver of any of the preceding Examples; and a coupler for coupling the acoustic receiver to an acoustic conductor, the acoustic conductor to provide at least part of an acoustic communication channel.

Example 29: The assembly of Example 28, wherein the coupler is configured to fixedly couple (e.g., fixedly restrain or clamp) a first end of the waveguide to the acoustic conductor to thereby acoustically couple the first end of the waveguide to acoustic conductor.

Example 30: The assembly of Example 29, wherein the coupler is to provide a feed point by way of which acoustic signals are coupled from the acoustic communication channel to the waveguide.

Example 31: The assembly of any one of Examples 28 to 30 further comprising a holder configured to hold a second end of the waveguide to thereby inhibit displacement of the second end of the waveguide with respect to the acoustic conductor while allowing the second end of the waveguide to vibrate (e.g. substantially freely) in response to acoustic signals propagating on the waveguide.

Example 32: The assembly of Example 31, wherein the holder is acoustically insulating to inhibit transmission of acoustic signals through the holder between the second end of the waveguide and the acoustic conductor.

Example 33: The assembly of any one of Examples 28 to 32, further comprising an acoustic transmitter.

Example 34: The assembly of Example 33, wherein the acoustic transmitter is couplable or coupled to the acoustic conductor by the coupler.

Example 35: The assembly of any one of Examples 28 to 34, wherein the acoustic receiver is a first acoustic receiver of the assembly, and wherein the assembly further comprises a second acoustic receiver, wherein the second acoustic receiver is an acoustic receiver according to any of Examples 1 to 27.

Example 36: The assembly Example 35, wherein the coupler is a first coupler and the acoustic conductor is a first acoustic conductor, and wherein the second acoustic receiver is couplable or coupled to the first acoustic conductor or a second acoustic conductor of the acoustic communication channel by a second coupler.

Example 37: The assembly of Example 36, wherein the first coupler and the second couplers are positionable or positioned at substantially the same longitudinal position of the acoustic communication channel.

Example 38: The assembly of Example 36 or Example 37, wherein the first acoustic conductor and the second acoustic conductor are offset from each other along a longitudinal axis of the acoustic communication channel.

Example 39: The assembly of Example 36 or Example 38, wherein the first and second acoustic conductors have different acoustic characteristics (e.g., wherein the first and second acoustic conductors have different acoustic impedances).

Example 40: The assembly of Example 39, wherein the acoustic communication channel comprises a downhole communication channel and wherein the first acoustic conductor comprises a cement head.

Example 41: The assembly according to any of Examples 36 to 40 wherein the first receiver is coupled to the first conductor and the second receiver is coupled to the second conductor.

Example 42: The assembly of any of Examples 35 to 41 wherein the sensors of the first and second receivers in combination are arranged to provide improved spatial signal diversity than the sensors of a single one of the first and second receivers.

Example 43: The assembly of any of Examples 35 to 42 wherein the sensors of the first receiver are acoustically coupled to the waveguide thereof at first positions along its length, wherein the sensors of the second receiver are acoustically coupled to the waveguide thereof at second positions along its length, wherein the corresponding first and second positions are distributed differently (e.g. are offset) from each other along the lengths of the respective waveguides.

Example 44: The assembly of Example 43 wherein the corresponding first and second positions are interdigitated.

Example 45: The assembly of Examples 36 to 44 as dependent on example 33, wherein the acoustic transmitter is a first acoustic transmitter and wherein the assembly further comprises a second acoustic transmitter couplable or coupled to the first acoustic conductor or the second acoustic conductor by the second coupler.

Example 46: The assembly of any one of Examples 28 to 45, further comprising circuitry to cause signals based on the acoustic signals received by the receiver(s) to be transmitted to one or more remote computing devices.

Example 47: The assembly of Example 46, further comprising processing circuitry to demodulate signals received by the receiver(s) before they are transmitted to the one or more remote computing device.

Example 48: The assembly of any of Examples 28 to 47 further comprising processing circuitry to obtain (e.g. receive) sensor data from the sensors (e.g. including the first and second sensors) of the acoustic receiver(s), and to select sensor data from one of the sensors, or data derived therefrom, based on at least one signal selection criterion or based on a comparison of the sensor data from the sensors, or data derived therefrom, and at least one signal selection criterion (e.g. based on which of the sensors received signals from the acoustic communication channel having the highest received signal strength or signal to noise ratio or signal to interference and noise ratio).

Example 49: The assembly of any one of Examples 28 to 48, further comprising an acoustically insulating or non-conductive outer jacket configured with respect to the acoustic conductor to house the acoustic receiver between the outer jacket and the acoustic conductor.

Example 50: A surface assembly for downhole communication comprising the assembly of any one of Examples 28 to 49, wherein the (at least first, or first and second) acoustic receiver(s) is (are) coupled to the acoustic conductor by the coupler(s).

Example 51: A system comprising: one or more remote computing devices; and an assembly according to any one of Example 28 to 50, the assembly comprising circuitry to cause signals based on acoustic signals received by the receiver(s) to be transmitted to the one or more remote computing device(s).

Example 52: The system of Example 51, wherein the one or more remote computing device is to receive signals based on sensor data from sensors of the receiver(s), and to select sensor data from one of the sensors, or data derived therefrom, based on at least one selection criterion or based on a comparison of the sensor data from the respective sensors, or data derived therefrom, and at least one selection criterion.

Example 53: The system of Example 52, wherein the at least one selection criterion relates to a signal quality of the sensor data from the respective sensors, or a quality of data derived from the sensor data from the respective sensors.

Example 54: The system of any one of Examples 51 to Example 53, wherein the assembly comprises processing circuitry to process (e.g. demodulate) sensor data from the sensors for transmission to the one or more remote computing devices.

Example 55: The system of Example 54, wherein the processing circuitry is to cause transmission of the processed sensor data to the one or more remote computing device.

Example 56: A method of performing acoustic communication comprising receiving acoustic signals from an acoustic communication channel by way of the acoustic receiver of any one of Examples 1 to 27 or the assembly of any one of Examples 28 to 50.

Example 57: The method of Example 56 further comprising: obtaining (e.g. receiving) sensor data from sensors (e.g. including the first and second sensors) of the acoustic receiver(s) or data derived therefrom; and selecting sensor data from one of the sensors, or data derived therefrom, based on at least one selection criterion or a comparison of the sensor data from the respective sensors, or data derived therefrom, and at least one selection criterion.

Example 58: The method of Example 57, wherein the at least one selection criterion relates to a signal quality of the sensor data from the respective sensors, or a quality of data derived from the sensor data from the respective sensors.

Example 59: The method of Example 58, wherein the at least of the selection criterion relates to at least one of: signal strength; signal-to-noise ratio; signal-to-noise-and-interference ratio.

Example 60: A method of performing acoustic communication comprising transmitting acoustic signals on an acoustic communications channel by way of the acoustic transmitter(s) of the assembly of Example 33 or of any one of Examples 34-50 as dependent on Example 33.

Example 61: The acoustic receiver of Example 3 or any of Examples 4 to 27 as dependent on Example 3, wherein the acoustic conductor comprises at least one of: a drill string or a portion thereof; a top-drive; a saver-sub mounted between a top-drive and a drill string; a cement head; a casing of a borehole; production tubing; a riser; coiled tubing; production tubing; slips supporting the drill string below the top drive; a downhole acoustic conductor; at least a portion of a top-sub of a downhole tool or at least a portion of a bottom-sub of a downhole tool; an acoustic conductor of a downhole tool, such as a tool mounted below a hex plug; a portion of a downhole Acoustic Telemetry System, ATS, tool; a portion of a Bottom Hole Assembly, BHA, tool; a portion of a Drill Stem Testing, DST, string tool.

Example 62: A sub-surface (e.g., downhole) assembly for downhole communication comprising the assembly of any one of Examples 28 to 49, wherein the (at least first, or first and second) acoustic receiver(s) is (are) coupled to the acoustic conductor by the coupler(s).

Example 63: The acoustic receiver of Example 26 or Example 61, wherein the acoustic receiver is provided at or above a surface.

Example 64: The acoustic receiver of Example 26 or Example 61, wherein the acoustic receiver is provided beneath the surface (i.e. downhole).

Example 65: A system comprising: processing circuitry; and an assembly according to any one of Examples 28 to 50 or Example 62, wherein the processing circuitry is in (e.g., wired, wireless) data communication with the receiver(s).

Example 66: The system of Example 65, wherein the processing circuitry is to receive signals based on sensor data from sensors of the receiver(s), or data derived therefrom, and to select sensor data from one of the sensors, or data derived therefrom, based on at least one selection criterion or based on a comparison of the sensor data from the respective sensors, or data derived therefrom, and at least one selection criterion.

Example 67: The system of Example 66, wherein the at least one selection criterion relates to a signal quality of the sensor data from the respective sensors, or a quality of data derived from the sensor data from the respective sensors.

Example 68: A method of performing acoustic communication comprising receiving acoustic signals from an acoustic communication channel by way of the acoustic receiver of any one of Examples 61, 63 or 64 or of the assembly of Example 62.

Example 69: The method of Example 68 further comprising: obtaining (e.g. receiving) sensor data from sensors (e.g. including the first and second sensors) of the acoustic receiver(s) or data derived therefrom; and selecting sensor data from one of the sensors, or data derived therefrom, based on at least one selection criterion or a comparison of the sensor data from the respective sensors, or data derived therefrom, and at least one selection criterion.

Example 70: The method of Example 69, wherein the at least one selection criterion relates to a signal quality of the sensor data from the respective sensors, or a quality of data derived from the sensor data from the respective sensors.

Example 71: The method of Example 70, wherein the at least one selection criterion relates to at least one of: signal strength; signal-to-noise ratio; signal-to-noise-and-interference ratio.

Example 72: The acoustic receiver, assembly, system or method of any preceding Example, wherein the positions at which the first and second sensors are acoustically coupled to the waveguide are arranged (e.g., offset from each other along the length of the waveguide) such that signals detected by the first and second sensors are phase shifted with respect to each other.

Example 73: The acoustic receiver, assembly, system or method of any preceding Example wherein the spacing between the positions at which the first and second sensors are acoustically coupled to the waveguide differs from (i.e., is not equal to) an integer multiple of half of a (e.g., predetermined) wavelength of signals to be received by the first and second sensors.

The invention claimed is:

1. An acoustic receiver for receiving acoustic signals from an acoustic communication channel, the acoustic receiver comprising:

a waveguide; and at least first and second sensors for sensing the acoustic signals, the sensors being in acoustic communication with the waveguide;

wherein the first and second sensors are acoustically coupled to the waveguide at respective first and second positions spaced from each other along a length of the waveguide, and wherein the length of the waveguide between the first and second positions follows a path that changes direction to thereby limit an extent of the waveguide, and wherein the waveguide is acoustically coupled to a solid acoustic conductor, the solid acoustic conductor to provide at least part of the acoustic communication channel, wherein the path followed by the waveguide between the first and second positions comprises a plurality of substantially parallel portions, wherein at least two of the substantially parallel portions are joined by a portion of the waveguide which follows the path that changes direction, or wherein the path is a serpentine path.

2. The acoustic receiver of claim 1, wherein the waveguide is curved to conform to a curvature of at least a curved portion of a cross-section of the acoustic conductor taken perpendicular to a longitudinal axis of the acoustic communication channel.

3. The acoustic receiver of claim 1, wherein the acoustic communication channel is a downhole acoustic communication channel.

4. The acoustic receiver of claim 1 wherein the solid acoustic conductor comprises a tubular member.

5. A method of performing acoustic communication comprising receiving acoustic signals from an acoustic communication channel by way of the acoustic receiver of claim 1.

6. An assembly comprising:

the acoustic receiver of claim 1; and a coupler for coupling the acoustic receiver to an acoustic conductor, the acoustic conductor to provide at least part of an acoustic communication channel.

7. The assembly of claim 6, wherein the coupler is configured to fixedly couple a first end of the waveguide to the acoustic conductor to thereby acoustically couple the first end of the waveguide to the acoustic conductor.

8. The assembly of claim 7 further comprising a holder configured to hold a second end of the waveguide to thereby inhibit displacement of the second end of the waveguide with respect to the acoustic conductor while allowing the second end of the waveguide to vibrate in response to acoustic signals propagating on the waveguide.

9. The assembly of claim 8, wherein the holder is acoustically insulating to inhibit transmission of acoustic signals through the holder between the second end of the waveguide and the acoustic conductor.

10. The assembly of claim 6, wherein the acoustic receiver is a first acoustic receiver of the assembly, and wherein the assembly further comprises a second acoustic receiver, wherein the second acoustic receiver comprising:

a waveguide; and at least first and second sensors for sensing the acoustic signals, the sensors being in acoustic communication with the waveguide;

wherein the first and second sensors are acoustically coupled to the waveguide at respective first and second positions spaced from each other along a length of the waveguide, and wherein the length of the waveguide between the first and second positions follows a path that changes direction to thereby limit an extent of the waveguide, and wherein the waveguide is acoustically coupled to a solid acoustic conductor, the solid acoustic conductor to provide at least part of the acoustic communication channel, wherein the path followed by the waveguide between the first and second positions comprises a plurality of substantially parallel portions, wherein at least two of the substantially parallel portions are joined by a portion of the waveguide which follows the path that changes direction, or wherein the path is a serpentine path.

11. The assembly claim 10, wherein the coupler is a first coupler and the acoustic conductor is a first acoustic conductor, and wherein the second acoustic receiver is couplable to the first acoustic conductor or a second acoustic conductor of the acoustic communication channel by a second coupler.

12. The assembly of claim 11, wherein the first acoustic conductor and the second acoustic conductor are offset from each other along a longitudinal axis of the acoustic communication channel.

13. The assembly of claim 6, further comprising circuitry to cause signals based on the acoustic signals received by the receiver(s) to be transmitted to one or more remote computing devices.

14. The assembly of claim 6, further comprising processing circuitry to obtain sensor data from sensors of the acoustic receiver(s), or data derived therefrom, and to select sensor data from one of the sensors, or data derived therefrom, based on at least one signal selection criterion or based on a comparison of the sensor data from the respective sensors, or data derived therefrom, and at least one signal selection criterion.

15. The assembly of claim 6, further comprising an acoustically insulating outer jacket configured with respect to the acoustic conductor to house the acoustic receiver between the outer jacket and the acoustic conductor.

16. A system comprising:

one or more remote computing devices; and an assembly according to claim 6, the assembly comprising circuitry to cause signals based on acoustic signals received by the receiver(s) to be transmitted to the one or more remote computing device(s).

17. The system of claim 16, wherein the one or more remote computing device is to receive sensor data from sensors of the receiver(s), or data derived therefrom, and to select sensor data from one of the sensors, or data derived therefrom, based on at least one selection criterion or a comparison of the sensor data from the respective sensors, or data derived therefrom, and at least one selection criterion.

18. An assembly comprising:

an acoustic receiver for receiving acoustic signals from an acoustic communication channel, the acoustic receiver comprising: a waveguide; and at least first and second sensors for sensing the acoustic signals, the sensors being in acoustic communication with the waveguide; wherein the first and second sensors are acoustically coupled to the waveguide at respective first and second positions spaced from each other along a length of the waveguide, and wherein the length of the waveguide between the first and second positions follows a path that changes direction to thereby limit an extent of the waveguide;

a coupler for coupling the acoustic receiver to an acoustic conductor, the acoustic conductor to provide at least part of an acoustic communication channel, wherein the coupler is configured to fixedly couple a first end of the waveguide to the acoustic conductor to thereby acoustically couple the first end of the waveguide to the acoustic conductor; and a holder configured to hold a second end of the waveguide to thereby inhibit displacement of the second end of the waveguide with respect to the acoustic conductor while allowing the second end of the waveguide to vibrate in response to acoustic signals propagating on the waveguide, wherein the holder is acoustically insulating to inhibit transmission of acoustic signals through the holder between the second end of the waveguide and the acoustic conductor.

* * * * *